US007168776B2

(12) United States Patent
Mitsuzawa

(10) Patent No.: US 7,168,776 B2
(45) Date of Patent: Jan. 30, 2007

(54) PRINTING APPARATUS, COMPUTER-READABLE STORAGE MEDIUM, PRINTING SYSTEM, AND PRINTING METHOD

(75) Inventor: Toyohiko Mitsuzawa, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 271 days.

(21) Appl. No.: 10/970,728

(22) Filed: Oct. 22, 2004

(65) Prior Publication Data

US 2005/0122358 A1 Jun. 9, 2005

(30) Foreign Application Priority Data

| | | |
|---|---|---|
| Oct. 24, 2003 | (JP) | 2003-364465 |
| Dec. 8, 2003 | (JP) | 2003-409518 |
| Apr. 1, 2004 | (JP) | 2004-109337 |
| Apr. 1, 2004 | (JP) | 2004-109338 |

(51) Int. Cl.
*B41J 2/215* (2006.01)
*B41J 29/393* (2006.01)

(52) U.S. Cl. ..... 347/15; 347/19; 358/1.2; 358/1.9

(58) Field of Classification Search ..... 347/19, 347/15; 358/1.2, 1.9, 3.01
See application file for complete search history.

(56) References Cited

U.S. PATENT DOCUMENTS 5,729,259 A * 3/1998 Gotoh et al. ..... 347/43
5,767,876 A * 6/1998 Koike et al. ..... 347/43

FOREIGN PATENT DOCUMENTS

| | | |
|---|---|---|
| EP | 1 203 665 A1 | 5/2006 |
| JP | 2000-22954 | 1/2000 |
| JP | 2001-1510 A | 1/2001 |

* cited by examiner

*Primary Examiner*—Lamson Nguyen
(74) *Attorney, Agent, or Firm*—Sughrue Mion, PLLC

(57) ABSTRACT

A printing apparatus has: ink-ejecting section units, each ink-ejecting section unit having ink-ejecting sections each being provided for ejecting an ink of a different color based on a gradation value that has been converted; a memory for storing darkness-correspondence information that correlates, for each ink color, darkness of images each printed using a different one of predetermined ink-ejecting sections each having an ink-ejection amount different from one another, and a darkness of an image printed using a reference ink amount; and a converting section for converting, for every pixel, a gradation value of image data to be printed, based on a correlation in the darkness-correspondence information between a darkness of an image printed using the predetermined ink-ejecting section that ejects an amount of ink that corresponds to an average value of the ink-ejection amounts respectively ejected from the ink-ejecting sections, and the darkness of the image printed using the reference ink amount.

37 Claims, 30 Drawing Sheets

| | K | C | LC | M | LM | Y |
|---|---|---|---|---|---|---|
| ID value of first print head 28a | 50 | 48 | 50 | 51 | 48 | 51 |
| ID value of second print head 28b | 52 | 50 | 52 | 48 | 53 | 48 |
| ID value of third print head 28c | 48 | 51 | 48 | 49 | 51 | 47 |
| ID value of fourth print head 28d | 50 | 52 | 46 | 50 | 50 | 51 |
| ID value of 19-th print head 28s | 49 | 50 | 51 | 49 | 53 | 48 |
| ID value of 20-th print head 28t | 51 | 52 | 48 | 48 | 50 | 47 |

ID value: value indicating the deviation from the reference value, determined from a previously measured ink amount G-1: relation between darkness (gradation) and duty

| | K | C | LC | M | LM | Y |
|---|---|---|---|---|---|---|
| ID value of first print head 28a | 50 | 48 | 50 | 51 | 48 | 51 |
| ID value of second print head 28b | 52 | 50 | 52 | 48 | 53 | 48 |
| ID value of third print head 28c | 48 | 51 | 48 | 49 | 51 | 47 |
| ID value of fourth print head 28d | 50 | 52 | 46 | 50 | 50 | 51 |
| ID value of 19-th print head 28s | 49 | 50 | 51 | 49 | 53 | 48 |
| ID value of 20-th print head 28t | 51 | 52 | 48 | 48 | 50 | 47 |

ID value: value indicating the deviation from the reference value, determined from a previously measured ink amount

FIG.11

G-1: relation between darkness (gradation) and duty

| | K | C | LC | M | LM | Y |
|---|---|---|---|---|---|---|
| ID value of first print head 2028a | 50 | 48 | 50 | 51 | 48 | 51 |
| ID value of second print head 2028b | 52 | 50 | 52 | 48 | 52 | 48 |

ID value: value indicating the deviation from the reference value, determined from a previously measured ink amount

FIG.26

PRINTING APPARATUS, COMPUTER-READABLE STORAGE MEDIUM, PRINTING SYSTEM, AND PRINTING METHOD

CROSS-REFERENCE TO RELATED APPLICATIONS

The present application claims priority upon Japanese Patent Application No. 2003-364465 filed on Oct. 24, 2003, Japanese Patent Application No. 2003-409518 filed on Dec. 8, 2003, Japanese Patent Application No. 2004-109337 filed on Apr. 1, 2004, and Japanese Patent Application No. 2004-109338 filed on Apr. 1, 2004, which are herein incorporated by reference.

BACKGROUND OF THE INVENTION

1. Field of the Invention

The present invention relates to printing apparatuses, computer-readable storage media, printing systems, and printing methods.

2. Description of the Related Art

Inkjet printers having a plurality of print heads are known as an example of printing apparatuses including at least two ink-ejecting section units (or, ink-ejecting section groups) having a plurality of ink-ejecting sections for ejecting inks of a plurality of colors on a color-by-color basis, (see JP 2001-001510A, for example). In such an inkjet printer, each print head includes ink-ejecting sections for ejecting inks of the same color. With this printer, a single image may be printed using a plurality of print heads.

However, if a plurality of print heads are used to print a single image, then portions within this single image that are printed with the same color will be printed by a plurality of ink-ejecting sections that are arranged on different print heads. Ink ejection sections that are arranged on different print heads may have different ink ejection characteristics. If a single image is printed with ink-ejecting sections having different ejection characteristics, then there may be differences in the darkness of the printed image. This may cause color non-uniformities, and there is also a possibility that portions of the image that should have the same color are printed with different color hues. To address this, it is conceivable to adjust the darkness of the printed image by adjusting each of the ink-ejecting sections on a section-by-section basis, but if there are a plurality of print heads, then the number of ink-ejecting sections to be adjusted becomes large, thereby causing a problem that the control becomes very complex when adjusting each ink-ejecting section individually.

SUMMARY OF THE INVENTION

The present invention has been made in light of the above issues, and it is an object of the present invention to provide a printing apparatus, a computer-readable storage medium, a printing system, and a printing method, with which the occurrence of darkness differences in images printed with ink-ejecting sections provided on a plurality of print heads can be suppressed by a simple control. Another object of the present invention is to provide a printing apparatus, a computer-readable storage medium, a printing system, and a printing method, with which it is possible to easily adjust the darkness differences in images printed with ink-ejecting sections provided on a plurality of print heads.

An aspect of the present invention is a printing apparatus comprising:

at least two ink-ejecting section units, each of the ink-ejecting section units having a plurality of ink-ejecting sections, each of the ink-ejecting sections being provided for ejecting an ink of a different color from among a plurality of colors, each of the ink-ejecting sections ejecting the ink based on a gradation value that has been converted;

a memory for storing darkness-correspondence information that correlates, for each of the plurality of colors of ink, darkness of images each printed using a different one of a plurality of predetermined ink-ejecting sections, the predetermined ink-ejecting sections each having an ink-ejection amount different from one another, and a darkness of an image printed using a reference amount of ink; and a converting section for converting, for every pixel, a gradation value of image data to be printed, based on a correlation in the darkness-correspondence information between a darkness of an image printed using the predetermined ink-ejecting section that ejects an amount of ink that corresponds to an average value of the ink-ejection amounts respectively ejected from the plurality of ink-ejecting sections, and the darkness of the image printed using the reference amount of ink.

Another aspect of the present invention is a printing apparatus comprising:

at least two ink-ejecting section groups, each of the ink-ejecting section groups having a plurality of ink-ejecting sections, each of the ink-ejecting sections being provided for ejecting an ink of a different color from among a plurality of colors, each of the ink-ejecting sections ejecting the ink based on image data that has been converted;

a memory having ejection-amount information indicating a difference between a reference amount of ink taken as a reference and ink-ejection amounts respectively ejected from the plurality of ink-ejecting sections, darkness-correspondence information that correlates, for each of the plurality of colors of ink, darkness of images each printed using a different one of a plurality of predetermined ink-ejecting sections, the ejection-amount information being different among the predetermined ink-ejecting sections, and a darkness of an image printed using the reference amount of ink, and a plurality of storage areas for storing the image data separately for each of the ink-ejecting sections; and a converting section for converting the image data to be printed based the ejection-amount information and the darkness-correspondence information corresponding to the color of ink to be ejected, such that a difference between the darkness of the image printed using the reference amount of ink and darkness of images each printed using a different one of the liquid ejecting sections becomes small, the converting section converting the image data separately for each of the storage areas.

Features and objects of the present invention other than the above will become clear by reading the description of the present specification with reference to the accompanying drawings.

BRIEF DESCRIPTION OF THE DRAWINGS

FIG. 11 shows an example of a data table with ejection-amount information according to the first embodiment.

FIG. 26 shows an example of a data table with ejection-amount information according to the second embodiment.

DETAILED DESCRIPTION OF THE INVENTION

Figure 1:
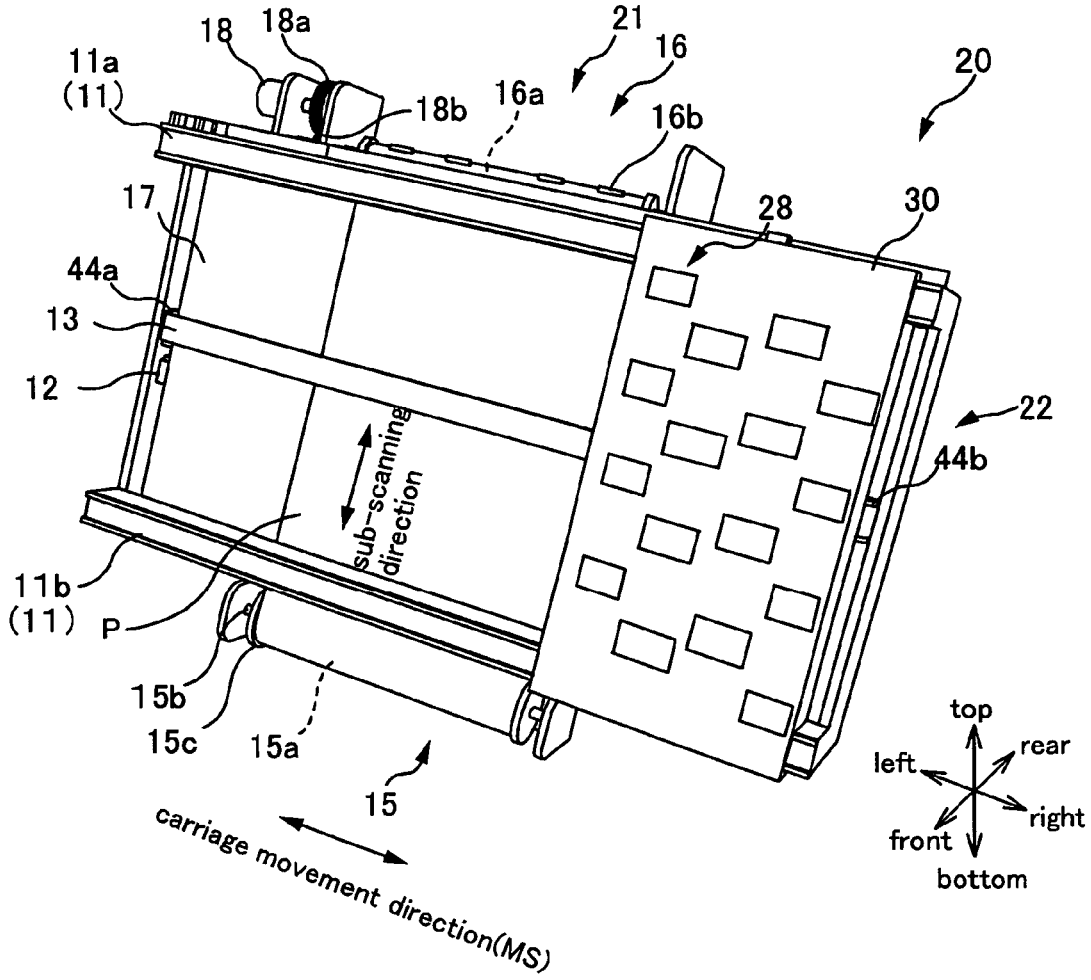
FIG. 1 is a perspective view showing an overview of the configuration of an inkjet printer, which is a printing apparatus in accordance with a first embodiment of the present invention.

At least the following matters will be made clear by the explanation in the present specification and the description of the accompanying drawings.

A printing apparatus according to the present invention comprises: at least two ink-ejecting section units, each of the ink-ejecting section units having a plurality of ink-ejecting sections, each of the ink-ejecting sections being provided for ejecting an ink of a different color from among a plurality of colors, each of the ink-ejecting sections ejecting the ink based on a gradation value that has been converted; a memory for storing darkness-correspondence information that correlates, for each of the plurality of colors of ink, darkness of images each printed using a different one of a plurality of predetermined ink-ejecting sections, the predetermined ink-ejecting sections each having an ink-ejection amount different from one another, and a darkness of an image printed using a reference amount of ink; and a converting section for converting, for every pixel, a gradation value of image data to be printed, based on a correlation in the darkness-correspondence information between a darkness of an image printed using the predetermined ink-ejecting section that ejects an amount of ink that corresponds to an average value of the ink-ejection amounts respectively ejected from the plurality of ink-ejecting sections, and the darkness of the image printed using the reference amount of ink.

The darkness-correspondence information of this printing apparatus correlates, for each of the plurality of colors of ink ejected by the ink-ejecting sections, the darkness of images each printed using a different one of a plurality of predetermined ink-ejecting sections, and the darkness of an image printed using a reference amount of ink. The plurality of predetermined ink-ejecting sections each have different ink-ejection amounts, and therefore, it is possible to correlate one of the predetermined ink-ejecting sections as the predetermined ink-ejecting section that ejects an amount of ink that corresponds to the average value of the ink-ejection amounts that are respectively ejected from the plurality of ink-ejecting sections provided in the printing apparatus. Therefore, it is possible to suppress variations of the darkness of the image printed with ink ejected from the ink-ejecting sections by converting the gradation values based on the correlation, in the darkness-correspondence information, between the darkness of an image printed using the predetermined ink-ejecting section that ejects an amount of ink that corresponds to the average value of the ink-ejection amounts respectively ejected from the plurality of ink-ejecting sections, and the darkness of the image printed using the reference amount of ink.

Moreover, the darkness of the image printed using the predetermined ink-ejecting section that ejects an amount of ink that corresponds to the average value of the ink-ejection amounts of the respective ink-ejecting sections is regarded as the darkness of an image printed with each of the ink-ejecting sections. Therefore, it is possible to convert the gradation values of an image to be printed with those ink-ejecting sections, which are provided in the printing apparatus and which eject ink of the same color, using only the correlation between the darkness of an image printed with one predetermined ink-ejecting section and the darkness of an image printed with the reference amount of ink. Therefore, it is possible to suppress variations in the darkness of the printed image with a control that is simpler compared to a case in which the individual gradation values are converted for each and every ink-ejecting section separately, and it is possible to print favorable images without darkness non-uniformities or the like.

In this printing apparatus, it is preferable that the gradation value of the image data to be printed by the ink-ejecting sections that eject ink of the same color but are provided in different ones of the ink-ejecting section units is converted based on the correlation between the darkness of the image printed using the predetermined ink-ejecting section that ejects the amount of ink that corresponds to the average value, and the darkness of the image printed using the reference amount of ink.

With this printing apparatus, it is possible to suppress, with a simple control, variations in the darkness of the image printed with all ink-ejecting sections that belong to different ink-ejecting section units but that eject the same color of ink, by converting the gradation values based on a correlation, in the darkness-correspondence information, between the darkness of the image printed using the predetermined ink-ejecting section that ejects the amount of ink that corresponds to the average value of the ink-ejection amounts of the respective ink-ejecting sections, and the darkness of the image printed using the reference amount of ink.

In the printing apparatus, it is preferable that the ink-ejecting section units are movable in a predetermined movement direction; and when forming dots on a medium to be printed by ejecting ink from the ink-ejecting sections while the ink-ejecting section units are being moved, the dots formed adjacent to one another in the movement direction are not formed by the ink-ejecting sections provided in the same ink-ejecting section unit.

When the gradation values of the image to be printed are converted not based on the ejection amounts of each individual ink-ejecting sections, but based on the average value of the ejection amounts of the ink-ejecting sections, then variations occur more easily compared to a case in which the conversion is performed for each ink-ejecting section individually. With the above-described printing apparatus, however, even though the ink-ejection amounts differ slightly among the ink-ejecting sections due to the use of an average value of the ejection amounts of the ink-ejecting sections for the conversion of the gradation values, the dots that are printed with ink-ejecting sections arranged on different ink-ejecting section units and having different ink-ejection amounts are not adjacent to one another, and therefore, it is possible to suppress the occurrence of darkness non-uniformities or the like, because dots formed with the ink-ejecting sections are scattered in the movement direction.

In the printing apparatus, it is preferable that the medium to be printed is carried intermittently in a carry direction that intersects with the movement direction; and when forming dots by ejecting ink from the ink-ejecting sections onto the medium to be printed carried in the carry direction, the dots formed adjacent to one another in the carry direction are not formed by the ink-ejecting sections provided in the same ink-ejecting section unit.

With this printing apparatus, even though the ink-ejection amounts differ slightly among the ink-ejecting sections due to the use of an average value of the ejection amounts of the ink-ejecting sections for the conversion of the gradation values, the dots that are printed with ink-ejecting sections arranged on different ink-ejecting section units and having different ink-ejection amounts are not adjacent to one another, and therefore, it is possible to suppress the occurrence of darkness non-uniformities or the like, because dots formed with the ink-ejecting sections are scattered in the carry direction.

Further, it is preferable that the printing apparatus further comprises a plurality of ink-ejecting section unit groups each including at least two ink-ejecting section units; the converting section is provided for each of the ink-ejecting section unit groups; and each of the converting sections uses an average value of the ejection amounts of the corresponding ink-ejecting section unit group to convert the gradation value for the corresponding ink-ejecting section unit group.

With this printing apparatus, the average value of the ink-ejection amounts is determined for each ink-ejecting section unit group having at least two ink-ejecting section units, and the gradation values are converted, using the determined average values, for each ink-ejecting section unit group individually, and therefore, it is possible to suppress variations in the darkness of the image printed with the ink-ejecting section unit groups. It is particularly advantageous to convert the gradation values for each of the ink-ejecting section unit groups individually when each ink-ejecting section unit group prints a different image. Since average values are not determined for more ink-ejecting section units than necessary, it is possible to achieve a small difference between the proper image darkness and the darkness of the image printed by converting the gradation values using the average value, and thus it is possible to print more favorable images.

In the printing apparatus, it is preferable that the darkness-correspondence information is indicated as ejection-amount information indicating a deviation of the ink-ejection amount of each of the predetermined ink-ejecting sections from the reference amount; the ejection-amount information indicating a deviation, from the reference amount of ink that is ejected in response to a predetermined signal, of the ink-ejection amount that is ejected from each of the plurality of ink-ejecting sections in response to the predetermined signal is provided for each of the ink-ejecting sections; and the average value of the ink-ejection amounts respectively ejected from the plurality of ink-ejecting sections is an average value of the ejection-amount information.

With this printing apparatus, the darkness-correspondence information is indicated as ejection-amount information indicating a deviation of the ink-ejection amount of each of the predetermined ink-ejecting sections from the reference amount, and the ejection-amount information indicating a deviation of the ink-ejection amount ejected from each of the plurality of ink-ejecting sections is provided for each of the ink-ejecting sections. Therefore, it is easy to correlate the ejection amount of each of the ink-ejecting sections and the reference amount, through the use of the deviations of the ejection amounts.

In the printing apparatus, it is preferable that the reference amount is a value that is obtained by measuring an ink amount that is actually ejected from an ink-ejecting section ejecting an amount of ink serving as a reference, and the ink-ejection amounts respectively ejected from the plurality of ink-ejecting sections are values that are obtained by measuring the ink amount that is actually ejected from each of the ink-ejecting sections.

With this printing apparatus, since the reference amount as well as the ink amounts ejected respectively from the plurality of ink-ejecting sections are all actually measured values, the gradation values are converted through correlating the darkness of the image printed with the plurality of ink-ejecting sections and the darkness of the image printed with the reference amount based on actually-ejected ink amounts. Therefore, darkness non-uniformities do not tend to occur in the printed image, and it is possible to prevent images from being printed with different hues.

In the printing apparatus, it is preferable that the plurality of ink-ejecting sections are capable of forming a plurality of kinds of dots having different sizes; and the ink-ejection amounts respectively ejected from the plurality of ink-ejecting sections are values that are obtained by measuring the ink amount that is ejected in order to form dots of one of the sizes from among the plurality of kinds of dots.

With this printing apparatus, the ejected ink amount is not measured for all kinds of dots of difference sizes that can be formed, so that it is possible to reduce the time that is needed to measure the ink-ejection amounts. Moreover, it is possible to estimate the amount of ink that is ejected to form other sizes of dots from the ink amounts that are ejected to form dots of one of the sizes that are actually measured. Therefore, it is possible to obtain the ink-ejection amounts also for other sizes of dots with relatively high accuracy. For this reason, it is possible to convert the gradation values by correlating the darkness of images that are printed with the plurality of ink-ejecting sections and the darkness of an image printed with the reference amount of ink, based on the actually ejected ink amounts, while reducing the time that is needed to measure the ink-ejection amounts, thus making it possible to print favorable images.

In the printing apparatus, it is preferable that the plurality of ink-ejecting sections are capable of forming a plurality of kinds of dots having different sizes; and the ink-ejection amounts respectively ejected from the plurality of ink-ejecting sections are values that are obtained by measuring the ink amount that is ejected in order to form dots of the largest size from among the plurality of kinds of dots.

With this printing apparatus, the ink amount that is ejected to form the dots of the largest size is larger than the amount of ink that is ejected to form dots of other sizes, and thus, it is possible to perform an accurate measurement without forming a mist, without affecting the conditions of the ink-ejecting sections or the measurement environment, and without measurement discrepancies. Thus, accurate ejection amounts can be obtained, so that the gradation values can be converted more appropriately.

In the printing apparatus, it is preferable that the ejection-amount information is determined based on darkness of predetermined print patterns each printed with ink ejected from a different one of the predetermined ink-ejecting sections, and a darkness of the predetermined print pattern printed by ejecting the reference amount of ink.

With this printing apparatus, it is possible to obtain the ejection-amount information based on an actually printed print pattern. Therefore, based on the darkness of images actually printed with the plurality of ink-ejecting sections and with the reference amount of ink, it is possible to suppress, more accurately, variations in the darkness of an image to be printed with ink that is ejected from the ink-ejecting sections.

Further, it is preferable that the printing apparatus further comprises a darkness-measurement section that is capable of measuring the darkness of the print patterns; and the ejection-amount information is determined based on a value obtained by measuring the darkness of the predetermined print patterns with the darkness-measurement section.

With this printing apparatus, it is possible to measure the darkness of the print patterns without removing the medium, on which the print patterns have been printed, from the printing apparatus that has printed the print patterns.

In the printing apparatus, it is preferable that the darkness-measurement section is provided in integration with the ink-ejecting section units.

With this printing apparatus, the relative position between the ink-ejecting sections and the darkness-measurement section does not change, so that it is possible to recognize the position of the darkness measurement section and the position of the print pattern, and to measure the darkness at the proper position.

In the printing apparatus, it is preferable that the print patterns are printed on a medium carried in a predetermined direction; and the darkness-measurement section is arranged downstream in the predetermined direction from the ink-ejecting section units.

With this printing apparatus, it is possible to measure the darkness with the darkness-measurement section without carrying the medium, on which the print pattern has been printed, in the opposite direction after the print pattern has been printed. Therefore, the processing for printing the print pattern and measuring its darkness becomes easy and can be executed with high efficiency in a short time.

In the printing apparatus, the ejection-amount information may be determined based on a value obtained by measuring the darkness of the print patterns with a darkness-measurement device provided external to the printing apparatus.

With this printing apparatus, it is possible to suppress variations of the darkness of the image printed with ink ejected from the ink-ejecting sections, without providing the printing apparatus with a darkness-measurement section.

In the printing apparatus, it is preferable that the darkness-correspondence information is information that correlates a pixel formation ratio between a number of pixels formed in a predetermined region to a total number of unit pixel formation regions in which a single pixel can be formed and which are provided within the predetermined region, and a darkness of an image printed using an ink-ejecting section that ejects the reference amount of ink based on the pixel formation ratio, and darkness of images each printed using a different one of the predetermined ink-ejecting sections based on the pixel formation ratio.

The "pixel formation ratio" indicates the amount of dots formed in a predetermined region. Therefore, with this printing apparatus, when printing images with the same pixel formation ratio, images of the same dot pattern are printed. Therefore, when printing images with the ink-ejecting section ejecting the reference amount of ink and with the predetermined ink-ejecting sections in accordance with the same pixel formation ratio, it is possible to compare the difference in the darkness of images printed with different sizes of dots, due to the differences in the ink amount ejected from the ink-ejecting sections. Moreover, by correlating the pixel formation ratio, the darkness of the image printed with the reference amount, and the darkness of the images printed with the predetermined ink-ejecting sections, it is possible to correlate the darkness of images printed with ink-ejecting sections having a plurality of different kinds of ejection-amount information, and the darkness of an image printed with the reference amount. That is to say, based on this darkness-correspondence information and the ejection-amount information of each ink-ejecting section, it is possible to correlate the darkness of images printed with the ink-ejecting sections and the darkness of an image printed with the reference amount of ink, and to convert the gradation values accurately.

In the printing apparatus, it is preferable that the darkness of the image printed using the ink-ejecting section that ejects the reference amount of ink based on the pixel formation ratio, and the darkness of the images each printed using a different one of the predetermined ink-ejecting sections based on the pixel formation ratio, are actually measured values.

In this printing apparatus, the darkness of the image printed, based on the pixel formation ratio, with the reference amount of ink and the darkness of images printed with the predetermined ink-ejecting sections are all actually measured values. Therefore, the gradation values of the image data are converted using the darkness-correspondence information, which is based on the actually-ejected ink amounts, such that the difference between the darkness of the images printed with the plurality of ink-ejecting sections and the darkness of the image printed with the reference amount of ink becomes small. Thus, it is possible to prevent images with darkness non-uniformities or with different color hues from being printed, and it becomes possible to print favorable images.

It is also possible to achieve a printing apparatus comprising:

at least two ink-ejecting section units, each of the ink-ejecting section units having a plurality of ink-ejecting sections, each of the ink-ejecting sections being provided for ejecting an ink of a different color from among a plurality of colors, each of the ink-ejecting sections ejecting the ink based on a gradation value that has been converted;

a memory for storing darkness-correspondence information that correlates, for each of the plurality of colors of ink, darkness of images each printed using a different one of a plurality of predetermined ink-ejecting sections, the predetermined ink-ejecting sections each having an ink-ejection amount different from one another, and a darkness of an image printed using a reference amount of ink; and a converting section for converting, for every pixel, a gradation value of image data to be printed, based on a correlation in the darkness-correspondence information between a darkness of an image printed using the predetermined ink-ejecting section that ejects an amount of ink that corresponds to an average value of the ink-ejection amounts respectively ejected from the plurality of ink-ejecting sections, and the darkness of the image printed using the reference amount of ink;

wherein the gradation value of the image data to be printed by the ink-ejecting sections that eject ink of the same color but are provided in different ones of the ink-ejecting section units is converted based on the correlation between the darkness of the image printed using the predetermined ink-ejecting section that ejects the amount of ink that corresponds to the average value, and the darkness of the image printed using the reference amount of ink;

wherein the ink-ejecting section units are movable in a predetermined movement direction;

wherein, when forming dots on a medium to be printed by ejecting ink from the ink-ejecting sections while the ink-ejecting section units are being moved, the dots formed adjacent to one another in the movement direction are not formed by the ink-ejecting sections provided in the same ink-ejecting section unit;

wherein the medium to be printed is carried intermittently in a carry direction that intersects with the movement direction;

wherein, when forming dots by ejecting ink from the ink-ejecting sections onto the medium to be printed carried in the carry direction, the dots formed adjacent to one another in the carry direction are not formed by the ink-ejecting sections provided in the same ink-ejecting section unit;

wherein the darkness-correspondence information is indicated as ejection-amount information indicating a deviation of the ink-ejection amount of each of the predetermined ink-ejecting sections from the reference amount;

wherein the ejection-amount information indicating a deviation, from the reference amount of ink that is ejected in response to a predetermined signal, of the ink-ejection amount that is ejected from each of the plurality of ink-ejecting sections in response to the predetermined signal is provided for each of the ink-ejecting sections;

wherein the average value of the ink-ejection amounts respectively ejected from the plurality of ink-ejecting sections is an average value of the ejection-amount information;

wherein the reference amount is a value that is obtained by measuring an ink amount that is actually ejected from an ink-ejecting section ejecting an amount of ink serving as a reference, and the ink-ejection amounts respectively ejected from the plurality of ink-ejecting sections are values that are obtained by measuring the ink amount that is actually ejected from each of the ink-ejecting sections;

wherein the plurality of ink-ejecting sections are capable of forming a plurality of kinds of dots having different sizes;

wherein the ink-ejection amounts respectively ejected from the plurality of ink-ejecting sections are values that are obtained by measuring the ink amount that is ejected in order to form dots of the largest size from among the plurality of kinds of dots;

wherein the darkness-correspondence information is information that correlates a pixel formation ratio between a number of pixels formed in a predetermined region to a total number of unit pixel formation regions in which a single pixel can be formed and which are provided within the predetermined region, and a darkness of an image printed using an ink-ejecting section that ejects the reference amount of ink based on the pixel formation ratio, and darkness of images each printed using a different one of the predetermined ink-ejecting sections based on the pixel formation ratio; and wherein the darkness of the image printed using the ink-ejecting section that ejects the reference amount of ink based on the pixel formation ratio, and the darkness of the images each printed using a different one of the predetermined ink-ejecting sections based on the pixel formation ratio, are actually measured values.

With this printing apparatus, all of the aforementioned effects can be attained, so that the object of the present invention is achieved in the most advantageous manner.

It is also possible to achieve a computer-readable storage medium having recorded thereon a computer program for causing a printing apparatus that includes at least two ink-ejecting section units, each of the ink-ejecting section units having a plurality of ink-ejecting sections, each of the ink-ejecting sections being provided for ejecting an ink of a different color from among a plurality of colors, each of the ink-ejecting sections ejecting the ink based on a gradation value that has been converted, and a memory for storing darkness-correspondence information that correlates, for each of the plurality of colors of ink, darkness of images each printed using a different one of a plurality of predetermined ink-ejecting sections, the predetermined ink-ejecting sections each having an ink-ejection amount different from one another, and a darkness of an image printed using a reference amount of ink, to convert, for every pixel, a gradation value of image data to be printed, based on a correlation in the darkness-correspondence information between a darkness of an image printed using the predetermined ink-ejecting section that ejects an amount of ink that corresponds to an average value of the ink-ejection amounts respectively ejected from the plurality of ink-ejecting sections, and the darkness of the image printed using the reference amount of ink.

It is also possible to achieve a printing system comprising:

a computer; and a printing apparatus that is connectable to the computer and that includes:

at least two ink-ejecting section units, each of the ink-ejecting section units having a plurality of ink-ejecting sections, each of the ink-ejecting sections being provided for ejecting an ink of a different color from among a plurality of colors, each of the ink-ejecting sections ejecting the ink based on a gradation value that has been converted;

a memory for storing darkness-correspondence information that correlates, for each of the plurality of colors of ink, darkness of images each printed using a different one of a plurality of predetermined ink-ejecting sections, the predetermined ink-ejecting sections each having an ink-ejection amount different from one another, and a darkness of an image printed using a reference amount of ink; and a converting section for converting, for every pixel, a gradation value of image data to be printed, based on a correlation in the darkness-correspondence information between a darkness of an image printed using the predetermined ink-ejecting section that ejects an amount of ink that corresponds to an average value of the ink-ejection amounts respectively ejected from the plurality of ink-ejecting sections, and the darkness of the image printed using the reference amount of ink.

It is also possible to achieve a printing method comprising the steps of:

preparing at least two ink-ejecting section units, each of the ink-ejecting section units having a plurality of ink-ejecting sections, each of the ink-ejecting sections being provided for ejecting an ink of a different color from among a plurality of colors, each of the ink-ejecting sections ejecting the ink based on a gradation value that has been converted;

storing darkness-correspondence information that correlates, for each of the plurality of colors of ink, darkness of images each printed using a different one of a plurality of predetermined ink-ejecting sections, the predetermined ink-ejecting sections each having an ink-ejection amount different from one another, and a darkness of an image printed using a reference amount of ink; and converting, for every pixel, a gradation value of image data to be printed, based on a correlation in the darkness-correspondence information between a darkness of an image printed using the predetermined ink-ejecting section that ejects an amount of ink that corresponds to an average value of the ink-ejection amounts respectively ejected from the plurality of ink-ejecting sections, and the darkness of the image printed using the reference amount of ink.

Another aspect of the present invention is a printing apparatus comprising:

at least two ink-ejecting section groups, each of the ink-ejecting section groups having a plurality of ink-ejecting sections, each of the ink-ejecting sections being provided for ejecting an ink of a different color from among a plurality of colors, each of the ink-ejecting sections ejecting the ink based on image data that has been converted;

a memory having ejection-amount information indicating a difference between a reference amount of ink taken as a reference and ink-ejection amounts respectively ejected from the plurality of ink-ejecting sections, darkness-correspondence information that correlates, for each of the plurality of colors of ink, darkness of images each printed using a different one of a plurality of predetermined ink-ejecting sections, the ejection-amount information being different among the predetermined ink-ejecting sections, and a darkness of an image printed using the reference amount of ink, and a plurality of storage areas for storing the image data separately for each of the ink-ejecting sections; and a converting section for converting the image data to be printed based the ejection-amount information and the darkness-correspondence information corresponding to the color of ink to be ejected, such that a difference between the darkness of the image printed using the reference amount of ink and darkness of images each printed using a different one of the liquid ejecting sections becomes small, the converting section converting the image data separately for each of the storage areas.

The above-described printing apparatus is provided with a plurality of ink-ejecting section groups, and each ink-ejecting section group has a plurality of ink-ejecting sections for respectively ejecting ink of different colors. Therefore, it is preferable to make the darkness of an image printed with the plurality of ink-ejecting sections that eject ink of the same color even. In the above-described printing apparatus, each of the ink-ejecting sections is correlated to a predetermined ink-ejecting section by the ejection-amount information that indicates the difference between the reference amount and the amount of ink ejected from each of the ink-ejecting sections, and the darkness of the image printed by each of the ink-ejecting sections and the darkness of the image printed using a reference amount of ink are correlated by the darkness-correspondence information. Therefore, even for ink-ejecting sections that eject ink of the same color but belong to different ink-ejecting section groups, it is possible to easily convert the image data such as to reduce the difference between the darkness of the image printed using each ink-ejecting section and the darkness of the image printed using the reference amount of ink, based on the ejection-amount information and the darkness-correspondence information. Particularly, the image data is stored separately in storage areas provided for each of the ink-ejecting sections that process the printing, and the conversion is carried out collectively and separately for each storage area. Therefore, the conversion process is easy. Further, conversion is collectively performed for each storage area at the stage of generating print data from image data; that is, the conversion process is not performed in parallel to the printing operation. Therefore, it is possible to perform the conversion process in a short time, and also, it is possible to increase throughput.

In this printing apparatus, it is preferable that the ejection-amount information is a deviation, from the reference amount of ink that is ejected in response to a predetermined signal, of the ink-ejection amount that is ejected from each of the plurality of ink-ejecting sections in response to the predetermined signal.

With this printing apparatus, the difference between the reference amount and the amount of ink ejected from each of the ink-ejecting sections is held as information that indicates the deviation from the reference value. Therefore, it is possible to precisely get hold of the difference between the reference amount and the amount of ink ejected from each of the ink-ejecting sections, without performing arithmetic processing etc.

In the printing apparatus, it is preferable that the reference amount is a value that is obtained by measuring an ink amount that is actually ejected from an ink-ejecting section ejecting an amount of ink serving as a reference, and the ink-ejection amounts respectively ejected from the plurality of ink-ejecting sections are values that are obtained by measuring the ink amount that is actually ejected from each of the ink-ejecting sections.

With this printing apparatus, since the reference amount as well as the ink amounts ejected respectively from the plurality of ink-ejecting sections are all actually measured values, the image data is converted such as to reduce the difference between the darkness of the image printed with the plurality of ink-ejecting sections and the darkness of the image printed with the reference amount of ink, based on actually-ejected ink amounts. Therefore, darkness non-uniformities do not tend to occur in the printed image, and it is possible to prevent images from being printed with different color hues.

In this printing apparatus, it is preferable that the plurality of ink-ejecting sections are capable of forming a plurality of kinds of dots having different sizes; and the ink-ejection amounts respectively ejected from the plurality of ink-ejecting sections are values that are obtained by measuring the ink amount that is ejected in order to form dots of the largest size from among the plurality of kinds of dots.

With this printing apparatus, the ink amount that is ejected to form the dots of the largest size is larger than the amount of ink that is ejected to form dots of other sizes, and thus, it is possible to perform an accurate measurement without forming a mist, without affecting the conditions of the ink-ejecting sections or the measurement environment, and with less measurement discrepancies. Thus, accurate ejection-amount information can be obtained, so that the image data can be converted more appropriately.

In the printing apparatus, it is preferable that the ejection-amount information is determined based on darkness of predetermined print patterns each printed with ink ejected from a different one of the predetermined ink-ejecting sections, and a darkness of the predetermined print pattern printed by ejecting the reference amount of ink.

With this printing apparatus, it is possible to obtain the ejection-amount information based on an actually printed print pattern. Therefore, even for ink-ejecting sections that belong to different ink-ejecting section groups but eject ink of the same color, it is possible to easily convert the image data such as to further reduce the difference between the darkness of the image printed using the reference amount of ink and the darkness of the image printed by each of the ink-ejecting sections, based on the ejection-amount information and the darkness-correspondence information that suit the apparatus that is actually used.

Further, it is preferable that the printing apparatus further comprises a darkness-measurement section that is capable of measuring the darkness of the predetermined print patterns; and the ejection-amount information is determined based on a value obtained by measuring the darkness of the predetermined print patterns with the darkness-measurement section.

With this printing apparatus, it is possible to measure the darkness of the print patterns without removing the medium, on which the print patterns have been printed, from the printing apparatus that has printed the print patterns.

In the printing apparatus, it is preferable that the darkness-measurement section is provided in integration with the ink-ejecting section groups.

With this printing apparatus, the relative position between the ink-ejecting sections and the darkness-measurement section does not change, so that it is possible to recognize the position of the darkness measurement section and the position of the print pattern, and to measure the darkness at the proper position.

In the printing apparatus, it is preferable that the print patterns are printed on a medium carried in a predetermined direction; and the darkness-measurement section is arranged downstream in the predetermined direction from the ink-ejecting section groups.

With this printing apparatus, it is possible to measure the darkness with the darkness-measurement section without carrying the medium, on which the print pattern has been printed, in the opposite direction after the print pattern has been printed. Therefore, the processing for printing the print pattern and measuring its darkness becomes easy and can be executed with high efficiency in a short time.

In the printing apparatus, the ejection-amount information may be determined based on a value obtained by measuring the darkness of the print patterns with a darkness-measurement device provided external to the printing apparatus.

With this printing apparatus, it is possible to easily convert the image data such as to reduce the difference between the darkness of the image printed using the reference amount of ink and the darkness of the image printed using each of the ink-ejecting sections, without providing the printing apparatus with a darkness-measurement section.

In the printing apparatus, it is preferable that the darkness-correspondence information is information that correlates a pixel formation ratio between a number of pixels formed in a predetermined region to a total number of unit pixel formation regions in which a single pixel can be formed and which are provided within the predetermined region, and a darkness of an image printed using an ink-ejecting section that ejects the reference amount of ink based on the pixel formation ratio, and darkness of images each printed using a different one of the predetermined ink-ejecting sections based on the pixel formation ratio.

The "pixel formation ratio" indicates the amount of dots formed in a predetermined region. Therefore, with this printing apparatus, when printing images with the same pixel formation ratio, images of the same dot pattern are printed. Therefore, when printing images with the ink-ejecting section ejecting the reference amount of ink and with the predetermined ink-ejecting sections in accordance with the same pixel formation ratio, it is possible to compare the difference in the darkness of images due to the difference in the size of the dots resulting from the difference in the amount of ink ejected from each of the ink-ejecting sections. Moreover, by correlating the pixel formation ratio, the darkness of the image printed with the reference amount, and the darkness of the images printed with the predetermined ink-ejecting sections, it is possible to correlate the darkness of images printed with ink-ejecting sections having a plurality of different kinds of ejection-amount information, and the darkness of an image printed with the reference amount. That is to say, based on this darkness-correspondence information and the ejection-amount information of each ink-ejecting section, it is possible to certainly convert the image data such as to reduce the difference between the darkness of images printed with the ink-ejecting sections and the darkness of an image printed with the reference amount of ink.

In the printing apparatus, it is preferable that the darkness of the image printed using the ink-ejecting section that ejects the reference amount of ink based on the pixel formation ratio, and the darkness of the images each printed using a different one of the predetermined ink-ejecting sections based on the pixel formation ratio, are actually measured values.

In this printing apparatus, the darkness of the image printed, based on the pixel formation ratio, with the reference amount of ink and the darkness of images printed with the predetermined ink-ejecting sections are all actually measured values. Therefore, the image data is converted using the darkness-correspondence information, which is based on the actually-ejected ink amounts, such that the difference between the darkness of the images printed with the plurality of ink-ejecting sections and the darkness of the image printed with the reference amount of ink becomes small. Thus, it is possible to prevent images with darkness non-uniformities or with different color hues from being printed, and it becomes possible to print favorable images.

In this printing apparatus, it is preferable that the image data includes gradation values, each of the gradation values indicating a darkness of a single pixel; and each of the gradation values is converted based on the ejection-amount information and the darkness-correspondence information such that, at each of the gradation values, an image having a darkness that is the same as a darkness of an image printed using an ink-ejecting section that ejects the reference amount of ink is printed.

With this printing apparatus, the gradation value of each pixel in the image data is converted based on the ejection-amount information and the darkness-correspondence information such that, at each of the gradation values, an image having a darkness that is the same as a darkness of an image printed using an ink-ejecting section that ejects the reference amount of ink is printed. Thus, images that are printed with all of the ink-ejecting sections will be printed at the same darkness as that of an image printed using an ink-ejecting section that ejects the reference amount of ink. Therefore, it is possible to print a favorable image with an even color hue, without causing any darkness non-uniformities in the printed image.

In this printing apparatus, it is preferable that the printing apparatus further comprises at least two ink-ejecting section group assemblies each including a plurality of the ink-ejecting section groups, and at least two image processing sections each provided corresponding to a different one of the ink-ejecting section group assemblies; and the image data for the ink-ejecting sections which are provided in the same ink-ejecting section group assembly and which eject ink of the same color is converted by the image processing section that is provided corresponding to that ink-ejecting section group assembly.

With this printing apparatus, since an image processing section is provided for each ink-ejecting section group assembly, it is possible to print an image with each of the ink-ejecting section group assemblies. Each ink-ejecting section group assembly has at least two ink-ejecting sections for ejecting ink of the same color. Therefore, by converting the image data such as to reduce the difference in darkness between the images printed with ink-ejecting sections that eject ink of the same color and belong to each ink-ejecting section group assembly, it becomes possible to suppress printing of images having darkness non-uniformities or difference in color hue by each of the ink-ejecting section group assemblies.

It is also possible to achieve a printing apparatus comprising:

at least two ink-ejecting section groups, each of the ink-ejecting section groups having a plurality of ink-ejecting sections, each of the ink-ejecting sections being provided for ejecting an ink of a different color from among a plurality of colors, each of the ink-ejecting sections ejecting the ink based on image data that has been converted;

a memory having ejection-amount information that indicates a deviation, from the reference amount of ink that is ejected in response to a predetermined signal, of the ink-ejection amount that is ejected from each of the plurality of ink-ejecting sections in response to the predetermined signal, darkness-correspondence information that correlates a pixel formation ratio between a number of pixels formed in a predetermined region to a total number of unit pixel formation regions in which a single pixel can be formed and which are provided within the predetermined region, and a darkness of an image printed using an ink-ejecting section that ejects the reference amount of ink based on the pixel formation ratio, and darkness of images each printed using a different one of predetermined ink-ejecting sections based on the pixel formation ratio, the ejection-amount information being different among the predetermined ink-ejecting sections, and a plurality of storage areas for storing the image data separately for each of the ink-ejecting sections; and a converting section for converting the image data to be printed based the ejection-amount information and the darkness-correspondence information corresponding to the color of ink to be ejected, such that a difference between the darkness of the image printed using the reference amount of ink and darkness of images each printed using a different one of the liquid ejecting sections becomes small;

wherein the reference amount is a value that is obtained by measuring an ink amount that is actually ejected from an ink-ejecting section ejecting an amount of ink serving as a reference, and the ink-ejection amounts respectively ejected from the plurality of ink-ejecting sections are values that are obtained by measuring the ink amount that is actually ejected from each of the ink-ejecting sections;

wherein the plurality of ink-ejecting sections are capable of forming a plurality of kinds of dots having different sizes;

wherein the ink-ejection amounts respectively ejected from the plurality of ink-ejecting sections are values that are obtained by measuring the ink amount that is ejected in order to form dots of the largest size from among the plurality of kinds of dots;

wherein the darkness of the image printed using the ink-ejecting section that ejects the reference amount of ink based on the pixel formation ratio, and the darkness of the images each printed using a different one of the predetermined ink-ejecting sections based on the pixel formation ratio, are actually measured values;

wherein the image data includes gradation values, each of the gradation values indicating a darkness of a single pixel; and wherein each of the gradation values in the image data is converted, separately for each of the storage areas, based on the ejection-amount information and the darkness-correspondence information such that, at each of the gradation values, an image having a darkness that is the same as a darkness of an image printed using an ink-ejecting section that ejects the reference amount of ink is printed.

With this printing apparatus, all of the aforementioned effects can be attained, so that the object of the present invention is achieved in the most advantageous manner.

It is also possible to achieve a computer-readable storage medium having recorded thereon a computer program for causing a printing apparatus that includes at least two ink-ejecting section groups, each of the ink-ejecting section groups having a plurality of ink-ejecting sections, each of the ink-ejecting sections being provided for ejecting an ink of a different color from among a plurality of colors, each of the ink-ejecting sections ejecting the ink based on image data that has been converted, and a memory having ejection-amount information indicating a difference between a reference amount of ink taken as a reference and ink-ejection amounts respectively ejected from the plurality of ink-ejecting sections, darkness-correspondence information that correlates, for each of the plurality of colors of ink, darkness of images each printed using a different one of a plurality of predetermined ink-ejecting sections, the ejection-amount information being different among the predetermined ink-ejecting sections, and a darkness of an image printed using the reference amount of ink, and a plurality of storage areas for storing the image data separately for each of the ink-ejecting sections, to convert the image data to be printed based the ejection-amount information and the darkness-correspondence information corresponding to the color of ink to be ejected, such that a difference between the darkness of the image printed using the reference amount of ink and darkness of images each printed using a different one of the liquid ejecting sections becomes small, the converting section converting the image data separately for each of the storage areas.

It is also possible to achieve a printing system comprising:

a computer; and a printing apparatus that is connectable to the computer and that includes:

at least two ink-ejecting section groups, each of the ink-ejecting section groups having a plurality of ink-ejecting sections, each of the ink-ejecting sections being provided for ejecting an ink of a different color from among a plurality of colors, each of the ink-ejecting sections ejecting the ink based on image data that has been converted;

a memory having ejection-amount information indicating a difference between a reference amount of ink taken as a reference and ink-ejection amounts respectively ejected from the plurality of ink-ejecting sections, darkness-correspondence information that correlates, for each of the plurality of colors of ink, darkness of images each printed using a different one of a plurality of predetermined ink-ejecting sections, the ejection-amount information being different among the predetermined ink-ejecting sections, and a darkness of an image printed using the reference amount of ink, and a plurality of storage areas for storing the image data separately for each of the ink-ejecting sections; and a converting section for converting the image data to be printed based the ejection-amount information and the darkness-correspondence information corresponding to the color of ink to be ejected, such that a difference between the darkness of the image printed using the reference amount of ink and darkness of images each printed using a different one of the liquid ejecting sections becomes small, the converting section converting the image data separately for each of the storage areas.

It is also possible to achieve a printing method comprising the steps of:

preparing at least two ink-ejecting section groups, each of the ink-ejecting section groups having a plurality of ink-ejecting sections, each of the ink-ejecting sections being provided for ejecting an ink of a different color from among a plurality of colors, each of the ink-ejecting sections ejecting the ink based on image data that has been converted;

preparing a plurality of storage areas for storing the image data separately for each of the ink-ejecting sections;

storing ejection-amount information indicating a difference between a reference amount of ink taken as a reference and ink-ejection amounts respectively ejected from the plurality of ink-ejecting sections;

storing darkness-correspondence information that correlates, for each of the plurality of colors of ink, darkness of images each printed using a different one of a plurality of predetermined ink-ejecting sections, the ejection-amount information being different among the predetermined ink-ejecting sections, and a darkness of an image printed using the reference amount of ink; and converting, separately for each of the storage areas, the image data to be printed based the ejection-amount information and the darkness-correspondence information corresponding to the color of ink to be ejected, such that a difference between the darkness of the image printed using the reference amount of ink and darkness of images each printed using a different one of the liquid ejecting sections becomes small.

<<<First Embodiment>>>

===Overall Configuration of Printing Apparatus===

Figure 2:
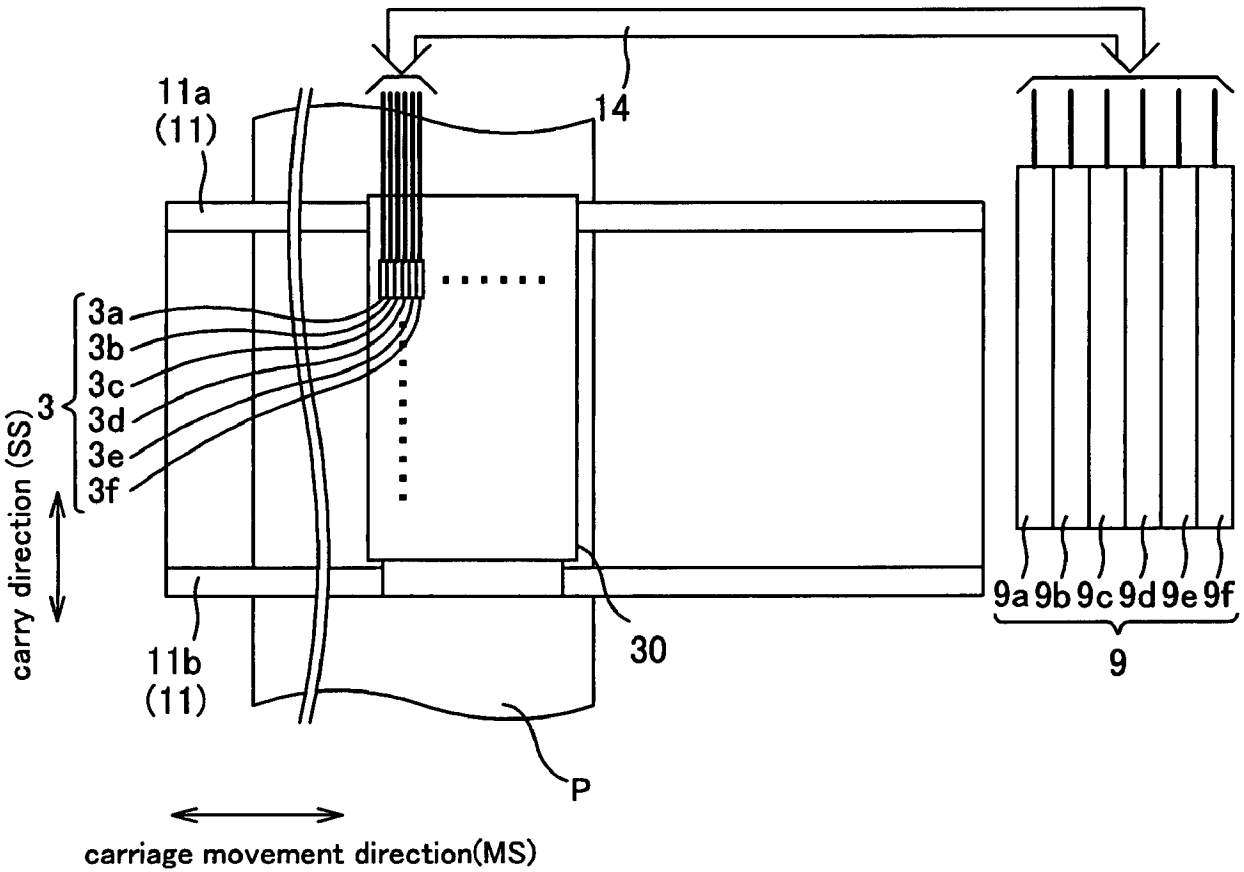
FIG. 2 is an explanatory diagram showing an overview of the configuration of a print section of the inkjet printer of the first embodiment.
Figure 3:
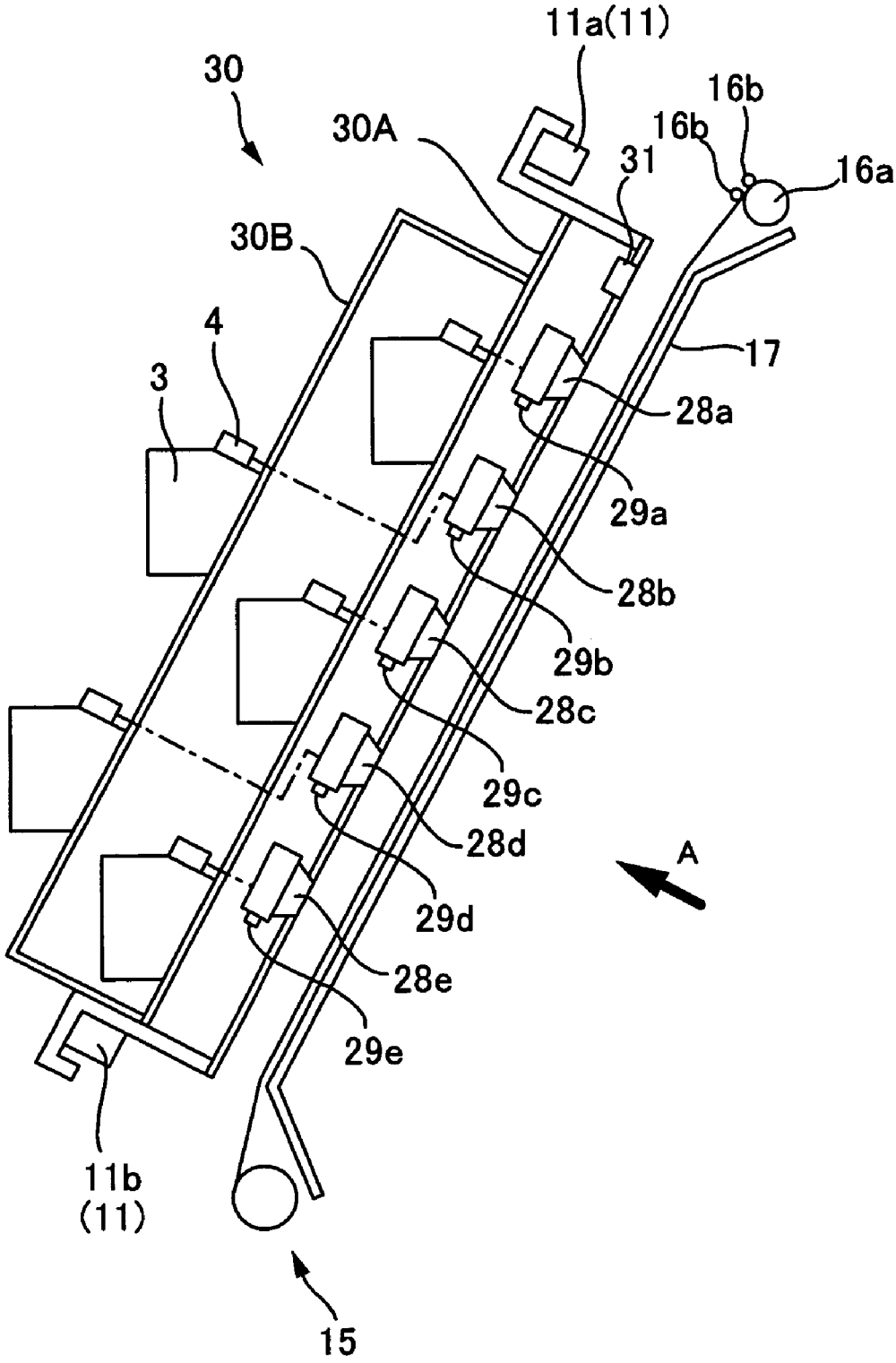
FIG. 3 is a sectional view illustrating the print section of the first embodiment.

FIG. 1 is a perspective view showing an overview of the configuration of an inkjet printer, which is a printing apparatus in accordance with the present invention. FIG. 2 is an explanatory diagram showing an overview of the configuration of a print section of the inkjet printer. FIG. 3 is a sectional view illustrating the print section.

The inkjet printer (in the following also referred to as "printer") 20, which is a printing apparatus in accordance with the present invention, is a printer adapted to handle relatively large print paper P such as roll paper or A0 or B0 size paper according to the JIS standard. The printer 20 has a print section 22 for printing on print paper P by ejecting ink, and a print paper carry section 21 for carrying the print paper P. The various sections are described below.

===Print Section===

The print section 22 is provided with a carriage 30 holding a plurality of print heads 28 serving as ink-ejecting section units, a pair of upper and lower guide rails 11 for guiding the carriage 30 such that it can move back and forth in a direction (also referred to as the "carriage movement direction" or the "left-to-right direction" in the following) that is substantially perpendicular to the direction in which the print paper P is carried, a carriage motor 12 for moving the carriage 30 back and forth, and a drive belt 13 for transmitting the motive force of the carriage motor 12 and moving the carriage 30 back and forth.

The two guide rails 11 are arranged at the top and the bottom and extend along the carriage movement direction with a certain spacing in the carry direction between them, and are supported at their left and right ends by a frame (not shown in the drawings) serving as a base. The two guide rails 11 are arranged such that the lower guide rail 11*b* is located further to the front than the upper guide rail 11*a*. For this reason, the carriage 30, which spans the two guide rails 11*a* and 11*b*, moves in a tilted orientation in which its upper portion is arranged to the rear.

The drive belt 13, which is band-shaped and made of metal, is spanned over two pulleys 44*a* and 44*b*, which are disposed at a spacing that is substantially the same as the length of the guide rails 11*a* and 11*b*, at an intermediate position between the upper and lower guide rails 11*a* and 11*b*. Of these pulleys 44*a* and 44*b*, one pulley 44*b* is fixed to a shaft of the carriage motor 12. The drive belt 13 is fixed to the left edge and the right edge of the carriage 30.

The carriage 30 is provided with twenty print heads 28 for ejecting ink of a plurality of colors. Each of these print heads 28 has nozzle rows serving as ink ejecting sections. In each of the nozzle rows, a plurality of nozzles n for ejecting ink of the same color are arranged in a row. Ink is ejected from predetermined nozzles n under the control of a later-described drive control circuit 330 (see FIG. 6). The arrangement of the print heads 28 and the nozzles n will be discussed in greater detail later. Moreover, a plurality of sub-tanks 3 for temporarily storing the ink that is ejected by the twenty print heads 28 are mounted on the carriage 30. A main tank 9 for supplying ink to the sub-tanks 3 is provided outside of the movement range in the carriage movement direction of the carriage 30. Moreover, on the side in opposition to the print paper or the like, the carriage 30 is provided with a reflective optical sensor 31 for detecting, for example, the front end position or the paper width of the print paper or the like. This reflective optical sensor 31 is also used as a darkness-measurement section for measuring the darkness of a print pattern or the like.

Moreover, the carriage 30 is provided with sub-tank plates 30A and 30B arranged in two levels, as shown in FIG. 3. The plurality of sub-tanks 3 are respectively mounted on these sub-tank plates 30A and 30B. The sub-tanks 3 are respectively connected via valves 4 to the print heads 28. Moreover, the sub-tanks 3 are connected by an ink supply duct 14 (see FIG. 2) to the main tank 9. The main tank 9 stores six types of inks that can be ejected by the print heads 28: black K, cyan C, light cyan LC, magenta M, light magenta LM and yellow Y.

In this embodiment, sub-tanks 3*a* to 3*f* for the six colors black K, cyan C, light cyan LC, magenta M, light magenta LM and yellow Y are provided. These six sub-tanks 3*a* to 3*f* are respectively connected to six corresponding main tanks 9*a* to 9*f*. It should be noted, however, that the inks to be used are not limited to six colors, and it is also possible to use four colors of inks (for example, black K, cyan C, magenta M and yellow Y), or seven colors of inks (for example, black K, light black LK, cyan C, light cyan LC, magenta M, light magenta LM and yellow Y).

The printer 20 prints on print paper P that is carried by the print paper carry section 21 by pulling the carriage 30 with the drive belt 13, which is driven by the carriage motor 12, moving the carriage 30 in the carriage moving direction along the guide rails 11, and ejecting ink from the twenty print heads 28 with which the carriage 30 is provided.

===Arrangement of Nozzles and Print Heads===

Figure 4:
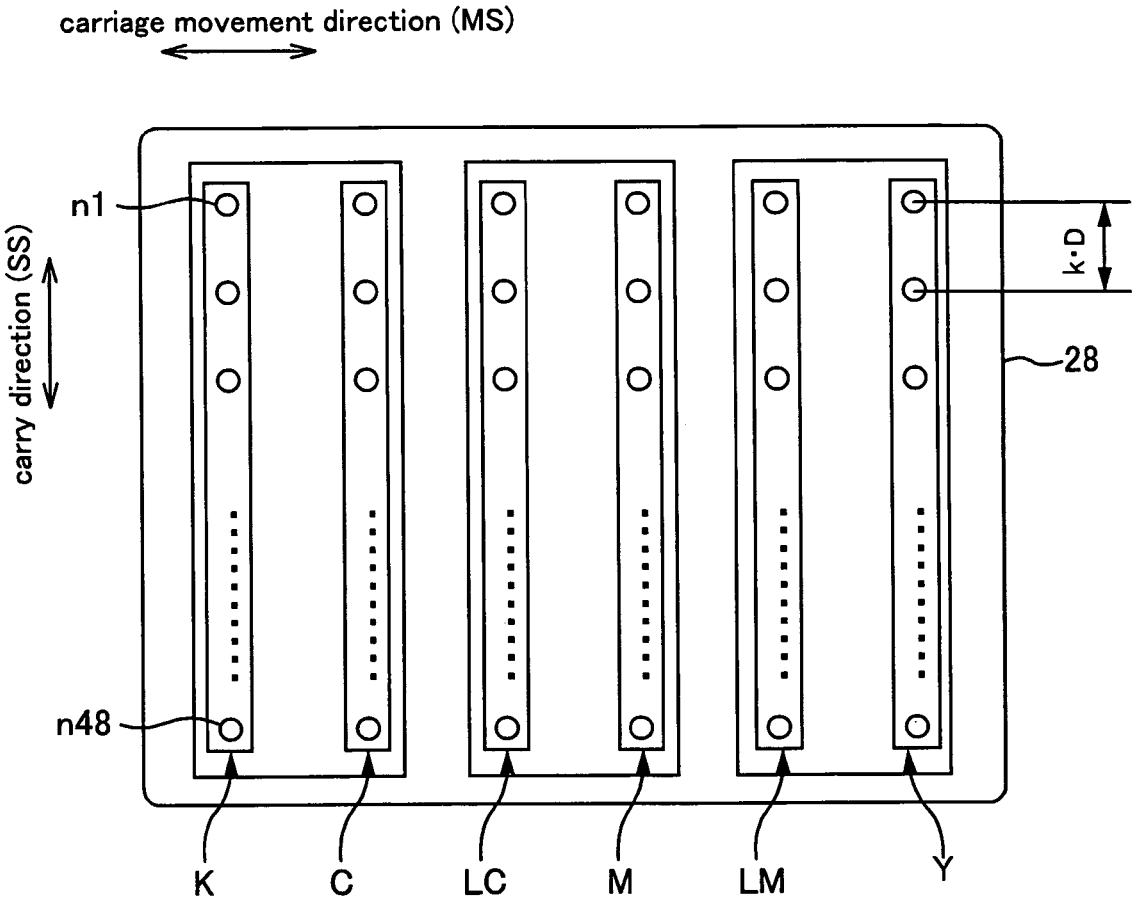
FIG. 4 is a diagram illustrating the nozzle arrangement on the bottom surface of one print head.

FIG. 4 is a diagram illustrating the nozzle arrangement on the bottom surface of one print head 28. Nozzle rows, in which 48 nozzles are arranged in rows in the carry direction of the print paper P, are arranged on the lower surface of the print head 28, with one nozzle row for each of the ejected ink colors. The nozzle rows of the various ink colors, that is, a black nozzle row K, a cyan nozzle row C, a light cyan nozzle row LC, a magenta nozzle row M, a light magenta nozzle row LM and a yellow nozzle row Y, are arranged next to one another at a certain interval in the direction along the guide rails 11. Each of the nozzles is provided with a piezo element PE (see FIG. 7) as a drive element for ejecting ink from the nozzles.

Figure 5:
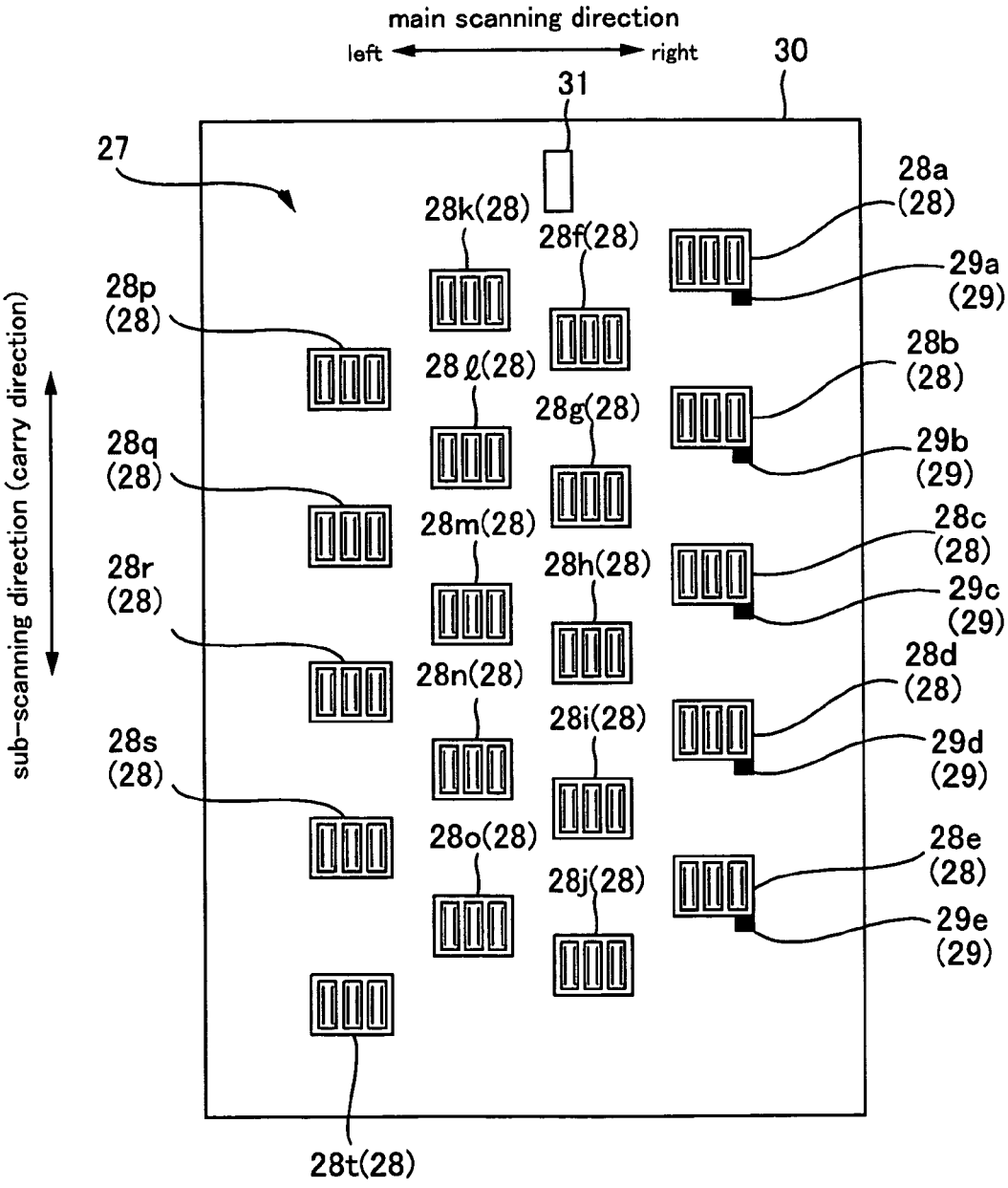
FIG. 5 shows the carriage as viewed from the direction of arrow A in FIG. 3.

FIG. 5 shows the carriage 30 as viewed from the direction of arrow A (see FIG. 3). Needless to say, left and right in FIG. 5 are opposite from left and right in FIG. 1. The carriage 30 is provided with the twenty print heads 28*a*, 28*b*, . . . , 28*t*. The twenty print heads 28 are disposed in four rows arranged in the carriage movement direction. Each of those rows contain five print heads arranged at a certain interval in the carry direction of the print paper P. The positions of the nozzles of each print head 28*a*, 28*b*, . . . , 28*t* are arranged such that they do not match in the carry direction of the print paper. For example, as shown in FIG. 5, of the four print heads 28*a*, 28*f*, 28*k* and 28*p* positioned at the uppermost positions in the rows, the print head 28*a* located furthest to the right in FIG. 5 is positioned furthest upward, the print head 28*k* at the uppermost position in the third row from the right is positioned second from the top, the print head 28*f* at the uppermost position in the second row from the right is positioned third from the top, and the print head 28*p* at the uppermost position in the leftmost row is positioned fourth from the top. The print heads are arranged such that the distance in the carry direction between the 48-th nozzle of the print head 28*a* positioned furthest upward and the first nozzle of the print head 28*k* positioned second from the top matches the nozzle pitch k·D of the nozzle rows. Also the print head 28*k* (second from the top), the print head 28*f* (third from the top), and the print head 28*p* (fourth from the top) are arranged such that the distance between the print head 28*k* and the print head 28*f*, as well as the distance between the print head 28*f* and the print head 28*p*, matches the nozzle pitch k·D. Furthermore, also the four print heads 28 arranged at similar positions in the vertical direction of the print head rows are arranged similarly to the four print heads 28 at the uppermost positions. Consequently, the nozzles are arranged at equal pitch in the carry direction from the first nozzle of the print head 28*a*, which is positioned furthest to the top in the rightmost row, up to the 48-th nozzle of the print head 28*t*, which is positioned furthest to the bottom in the leftmost row.

The reflective optical sensor 31 is provided on the upper side of the carriage 30. This reflective optical sensor 31 is arranged such that it is positioned to the downstream side with respect to the print head group 27 in the carry direction in which the paper is carried during printing.

===Print Paper Carry Section===

The print paper carry section 21 for carrying the print paper P is provided on the rear side of the two guide rails 11. Also, the print paper carry section 21 has a paper holding section 15 for rotatively holding the print paper P below the lower guide rail 11*b*, a paper carry holder 16 for carrying the print paper P above the upper guide rail 11, and a platen 17, which guides the print paper P that is carried between the paper holding section 15 and the paper carry holder 16.

The platen 17 has a flat surface spanning the entire width of the carried print paper P. Moreover, this flat surface functions as a support surface by which the print paper P that is carried in the carry direction is supported also in the carry direction.

The paper holding section 15 is provided with a holder 15*a* for rotatively holding the print paper P. The holder 15*a* has a shaft member 15*b* serving as a rotation shaft that rotates with the print paper P in a held state, and on both ends of the shaft member 15*b* are provided guide disks 15*c* for keeping the supplied roll paper P from zigzagging or tilting.

The paper carry holder 16 is provided with a carry roller 16*a* for carrying the print paper P, sandwiching rollers 16*b* that are provided in opposition to the carry roller 16*a* and that sandwich the print paper P in cooperation with the carry roller 16*a*, and a carry motor 18 for rotating the carry roller 16*a*.

A drive gear 18*a* is provided on the shaft of the carry motor 18, and a relay gear 18*b* that meshes with the drive gear 18 is provided on the shaft of the carry roller 16*a*. The drive force of the carry motor 18 is transmitted to the carry roller 16*a* via the drive gear 18*a* and the relay gear 18*b*.

That is to say, the print paper P that is held by the holder 15*a* is sandwiched between the carry roller 16*a* and the sandwiching rollers 16*b* and is carried along the platen 17 by the carry motor 18.

===Controller of the Printer===

Figure 6:
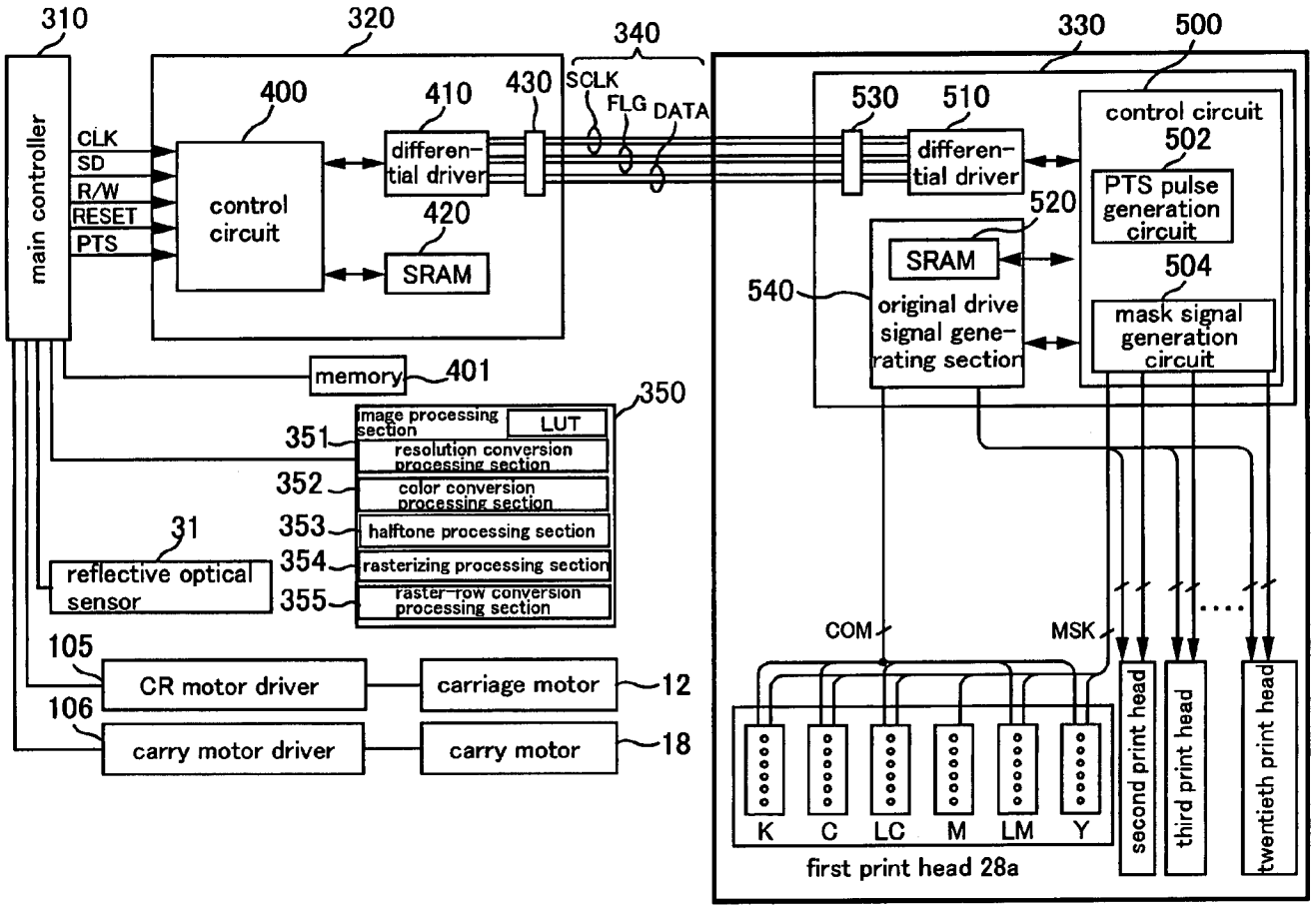
FIG. 6 is a block diagram showing the electrical configuration of the printer of the first embodiment.

FIG. 6 is a block diagram showing the electrical configuration of the printer.

The printer 20 is provided with, for example, one main controller 310, a plurality of data processing sections 320 respectively corresponding to the print heads 28 on the carriage 30, an image processing section 350 for converting image data to be printed, which has been input from a computer connected to the printer 20, into print data that can be printed by the printer 20, a CR motor driver 105 for driving the carriage motor 12, and a carry motor driver 106 for driving the carry motor 18. The print heads 28 are connected to a drive controller 330 arranged on the carriage 30, and this drive controller 330 is connected to the data processing sections 320 provided on the main unit side of the printer 20 by one flexible cable 340.

The main controller 310 is a control circuit performing the control of the overall printer, and is configured so that it can access a memory 401 which serves as a storage section storing later-described ejection-amount information and a conversion data table.

The data processing sections 320 are control circuits for bi-directional communication between the printer 20 and the carriage 30. Each data processing section 320 has a control circuit 400, a differential driver 410, an SRAM 420 and an interface 430.

The drive controller 330 is a control circuit for controlling the ejection of ink by the print heads 28 as described above and performing bi-directional communication with the data processing sections 320. The drive controller 330 includes a control circuit 500, a differential driver 510, an SRAM 520, an interface 530 and an original drive signal generating section 540. The control circuit 500 includes a PTS pulse generation circuit 502 and a mask signal generation circuit 504.

It should be noted that the control circuit 400 and the differential driver 410 constitute a printer-side send/receive section (data processing section). Moreover, the control circuit 500 and the differential driver 510 constitute a carriage-side send/receive section (drive controller). The PTS pulse generation circuit 502, the mask signal generation circuit 504 and the original drive signal generating section 540 constitute a head drive controller.

The flexible cable 340 that connects the interfaces 430 and 530 includes a clock signal line for transmitting a clock signal SCLK, a flag signal line pair for transmitting a flag signal FLG, and a serial signal line pair for transmitting data DATA serially. It should be noted that throughout this specification, the same symbols are used for signals and for the signal lines (or signal line pairs) carrying those signals.

The image processing section 350 includes a resolution conversion processing section 351, a color conversion processing section 352, a halftone processing section 353, a rasterizing processing section 354, a raster-row conversion processing section 355, and a plurality of color conversion data tables LUT.

The resolution conversion processing section 351 has the function of converting the resolution of entered image data to the print resolution. Image data whose resolution has been converted is still image information composed of the three color components RGB. The color conversion processing section 352 references the color conversion data table LUT and converts the RGB image data pixel-by-pixel into multi-gradation data of a plurality of ink colors that can be used by the printer 20. Moreover, the color conversion processing section 352 performs a "color calibration process" for reducing the differences between the ink-ejection amounts ejected based on the same print data from each of the nozzle rows that are provided in different print heads 28 and that eject ink of the same color. This "color calibration process" will be explained further below.

The color-calibrated multi-gradation data has 256 gradation values, for example. The halftone processing section 353 performs so-called halftone processing such as dithering, and generates binary image data expressing a halftone image by binary data. The binary image data is rearranged by the rasterizing processing section 354 and the raster-row conversion processing section 355 into the data order in which they are to be transferred to the printer 20, and are output as the final print data PD. The print data PD includes raster data indicating how dots are to be formed during each movement of the carriage 30 as well as data indicating the paper carry amount.

===Driving the Print Heads===

The driving of the print heads 28 is described with reference to FIG. 7.

Figure 7:
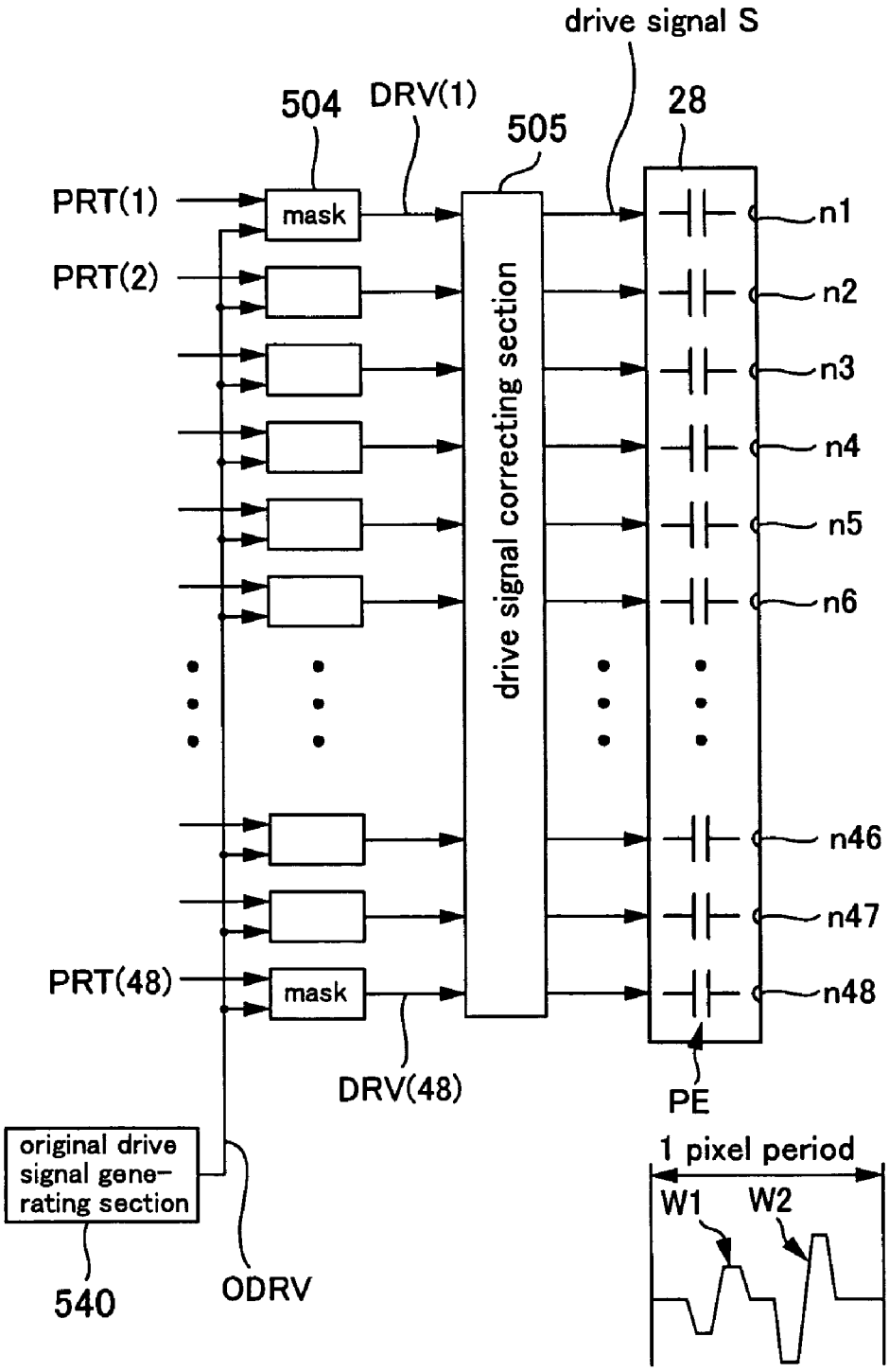
FIG. 7 is a block diagram showing the configuration of the original drive signal generating section provided inside the drive controller in FIG. 6.
Figure 8:
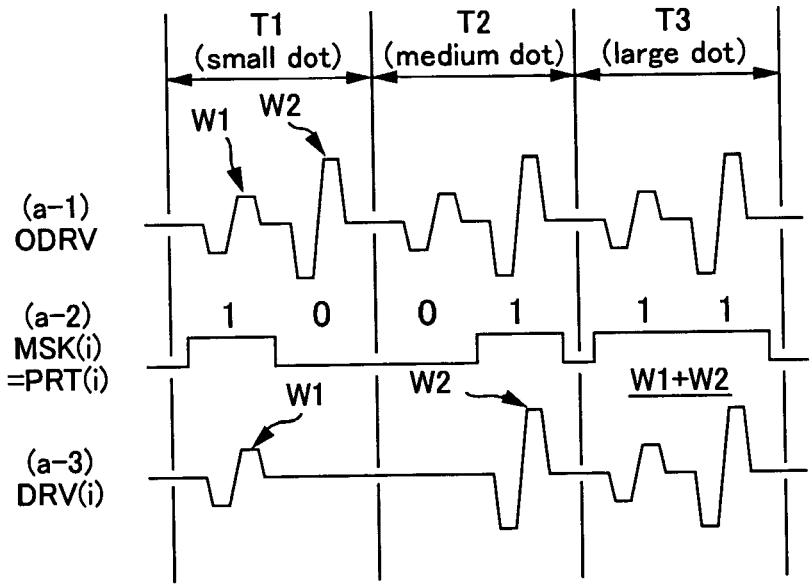
FIG. 8 is a timing chart of the original signal ODRV, the print signal PRT(i), and the drive signal DRV(i) illustrating the operation of the original drive signal generating section of the first embodiment.

FIG. 7 is a block diagram showing the configuration of an original drive signal generating section provided within the drive controller (see FIG. 6). FIG. 8 is a timing chart for an original signal ODRV, a print signal PRT(i), and a drive signal DRV(i), illustrating the operation of the original drive signal generating section.

In FIG. 7, the drive controller 330 is provided with a plurality of mask signal generation circuits 504, an original drive signal generating section 540, and a drive signal correcting section 505. The mask signal generation circuits 504 are provided corresponding to the plurality of piezo elements for driving the respective nozzles n1 to n48 of the print heads 28. It should be noted that in FIG. 7 the numbers in parentheses following each signal name indicate the number of the nozzle to which that signal is supplied.

The original drive signal generating section 540 generates an original drive signal ODRV that is used in common among all nozzles n1 to n48. This original drive signal ODRV is a signal that includes two pulses, namely a first pulse W1 and a second pulse W2, within the period in which the carriage moves over a distance corresponding to a single pixel. This original drive signal ODRV serves as a reference ejection signal for ejecting ink from the nozzles. That is to say, all of the nozzles of each print head 28 eject ink based on the same original drive signal ODRV. The output of the original drive signal ODRV is started when it is detected from the output of a linear encoder or the like that the carriage 30 has reached a predetermined position. Therefore, when forming dot rows at the same target position on the print paper by ejecting ink from the nozzle rows of the print heads 28, the output timing of the original drive signal ODRV is adjusted such that the positions of the dot rows in the carriage movement direction match.

As shown in FIG. 7, the serial print signal PRT(i) is input to the mask signal generation circuits 504 together with the original drive signal ODRV that is output from the original drive signal generating section 540. The serial print signal PRT(i) is a serial signal with two bits per pixel, and the bits correspond to the first pulse W1 and the second pulse W2, respectively. The mask signal generation circuits 504 are gates for masking the original drive signal ODRV in accordance with the level of the serial print signals PRT(i). That is to say, when the serial print signal PRT(i) is at level "1", the mask signal generation circuit 504 passes the corresponding pulse of the original drive signal ODRV without changing it and supplies it to the piezo element as a drive signal DRV, whereas when the serial print signal PRT(i) is at level "0", the mask signal generation circuit 504 blocks the corresponding pulse of the original drive signal ODRV.

As shown in FIG. 8, the original drive signal ODRV generates a first pulse W1 and a second pulse W2 in that order during each pixel period T1, T2, and T3. It should be noted that "pixel period" has the same meaning as the period during which the carriage moves for a distance corresponding to one pixel.

As shown in FIG. 8, when the print signal PRT(i) corresponds to the two bits of pixel data "1,0" then only the first pulse W1 is output in the first half of the pixel period. Accordingly, a small ink droplet is output from the nozzle, forming a small-sized dot (small dot) on the medium to be printed. When the print signal PRT(i) corresponds to the two bits of pixel data "0,1" then only the second pulse W2 is output in the second half of the pixel period. Accordingly, a medium-sized ink droplet is ejected from the nozzle, forming a medium-sized dot (medium dot) on the medium to be printed. Furthermore, when the print signal PRT(i) corresponds to the two bits of pixel data "1,1" then both the first pulse W1 and the second pulse W2 are output during the pixel period. Accordingly, a large ink droplet is ejected from the nozzle, forming a large-sized dot (large dot) on the medium to be printed. As described above, the drive signal DRV(i) in a single pixel period is shaped so that it may have three different waveforms corresponding to the three different values of the print signal PRT(i), and based on these signals, the print heads 28 can form dots of three different sizes.

===Example Configuration of the Reflective Optical Sensor===

Figure 9:
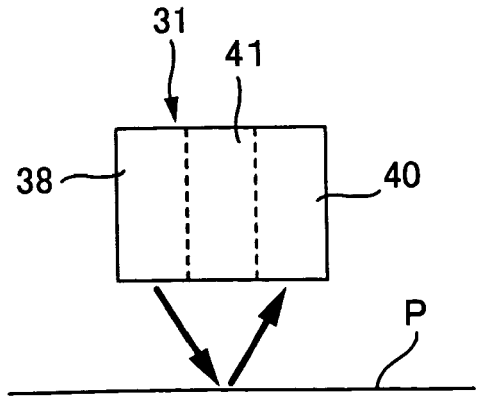
FIG. 9 is a schematic drawing illustrating an example of a reflective optical sensor 31 of the first embodiment.

FIG. 9 is a schematic drawing illustrating an example of a reflective optical sensor 31. The reflective optical sensor 31 includes a light emitting section 38 that is made of a light-emitting diode, for example, and a regular reflection light receiving section 40 and a diffused reflection light receiving section 41 that are made of phototransistors, for example.

This reflective optical sensor 31 is set up so that the light emitted by the light emitting section 38 is irradiated at a predetermined angle with respect to the print paper serving as the medium to be printed, and the regular reflection light receiving section 40 is arranged at such a position that mainly the regularly reflected components of the reflection light irradiated onto the print paper are incident on it. Moreover, the diffused reflection light receiving section 41 is arranged at a position between the light emitting section 38 and the regular reflection light receiving section 40, that is to say, vertically above the irradiation position on the print paper P. The light emitting section 38, the regular reflection light receiving section 40 and the diffused reflection light receiving section 41 are lined up in the paper carry direction. The incident light that is received by the regular reflection light receiving section 40 and the diffused reflection light receiving section 41 is converted into electrical signals, and the intensity of the electrical signals is measured as the output value of the reflective optical sensor 31 corresponding to the light amount of the received reflection light. In this case, light that is reflected by glossy paper increases the output of the regular reflection light receiving section 40, whereas light that is reflected by plain paper increases the output of the diffused reflection light receiving section 41, so that paper types can be discriminated. Then, the reflective optical sensor 31 detects the front edge position and the width of the paper based on differences in the output of the light receiving sections 40 and 41 when the light emitted from the light emitting section 38 is reflected by the paper and the output of the light receiving sections 40 and 41 when the light is reflected by the platen 17. Moreover, the reflective optical sensor 31 can also measure the darkness of printed locations based on the output of the light receiving sections 40 and 41 when the light emitted from the light emitting section 38 is reflected by printed locations on the paper and the output of the light receiving sections 40 and 41 when the light is reflected by non-printed locations on the paper. That is to say, in the case of high darkness, a large amount of ink is ejected onto a predetermined region, and the surface area occupied by dots formed with the ejected ink is large. Therefore, the white portions without dots become small, so that the output of the light receiving sections 40 and 41 due to the reflected light becomes low. On the other hand, in the case of low darkness, a small amount of ink is ejected onto a predetermined region, and the surface area occupied by dots formed with the ejected ink is small. Therefore, the white portions without dots become large, so that the output of the light receiving sections 40 and 41 due to the reflected light becomes high. In this way, the darkness of print patterns can be measured based on differences in the output of the light receiving sections 40 and 41.

It should be noted that in the above description, as shown in the drawings, the light emitting section 38, the regular reflection light receiving section 40 and the diffuse reflection light receiving section 41 are configured in a single unit as the reflective optical sensor 31, but they may also be configured as separate devices, namely as a light-emitting device and two light receiving devices.

Also, in the above description, in order to obtain the light amount of the received reflection light, the intensity of the electric signals is measured after the reflection light is converted into electrical signals, but there is no limitation to this, and it is sufficient if the value that is output by the light-receiving sensor, which corresponds to the light amount of the received reflection light, can be measured.

===Color Calibration Process===

As for the ink that is ejected from the nozzles, not always is the same amount of ink ejected even when driving with the same print data, because of individual differences among the individual nozzles and the piezo elements and because of the different types of inks, for example. Further, the printer 20 is controlled based on the theoretical design values, so that when nozzle rows in which the ink-ejection amount differs from the theoretical value are driven by the same control as a nozzle row in which a theoretical amount (i.e., reference amount) of ink is ejected (in the following, such a nozzle row is referred to as "reference nozzle row"), then images that should be printed with uniform darkness will be printed at different darkness with the different nozzle rows, resulting in color non-uniformities or in printed images with different color hues.

Therefore, a "color calibration process" is executed such as to reduce the differences in the darkness of the images printed with ink ejected from nozzle rows that eject ink of the same color but are arranged on different print heads. The color calibration process of the printer according to the first embodiment of the present invention is a process for suppressing darkness non-uniformities in images printed with a plurality of nozzle rows ejecting ink of the same color by performing a conversion with regard to the nozzle rows ejecting ink of the same color but arranged on different print heads, based on an average value of ejection-amount information indicating the amounts of ink that are ejected from the nozzle rows as well as darkness-correspondence information corresponding to the color of the ejected ink.

Here, as a first implementation, an example is explained in which the ejection-amount information is information representing deviations in the amount of ink that is ejected from the respective nozzle rows in response to a predetermined signal, as compared to a reference amount of ink that is ejected in response to this predetermined signal. In the first implementation, the reference amount is determined, for example, during the manufacturing process of the printing apparatus, by measuring the amount of ink that is actually ejected from a reference nozzle row. Then, the amount of ink that is ejected by each of the nozzle rows of the printer 20 is determined, and the deviation, from the reference amount, of the amount of ink ejected from each of the nozzle rows is determined based on those actually measured values, and the deviation is stored as ejection-amount information in the memory 401. Here, the nozzle row ejecting an amount of ink that is taken as the reference is a nozzle row ejecting an amount of ink consistent with the theoretical design value, and is a nozzle row that is different from the nozzle rows installed on the printer 20.

More specifically, in order to obtain the ejection-amount information, the amounts of ink that are ejected from the nozzle rows in response to a predetermined drive signal is measured first.

The measurement of the amount of ink that is ejected from each of the nozzle rows and from the reference nozzle row is performed using electronic scales and an evaluation pulse generation circuit that outputs a predetermined driving pulse (referred to as "evaluation pulse" below). For example, a print head is electrically connected to the evaluation pulse generation circuit, and ink is ejected from a nozzle row by driving the piezo elements in accordance with the evaluation pulses generated by the evaluation pulse generation circuit. Then, the ejected ink is measured with the electronic scales. In this case, drive signals for ejecting ink for forming large dots from all nozzles of the nozzle row to be measured are used as the evaluation pulses.

The amount of ink that should be ejected from the reference nozzle row when driven with the evaluation pulses, that is, the theoretical value of the amount of ink that is ejected, is set to the reference value "50". As for the amount of ink ejected from the measured nozzle rows, the deviations from this reference value are determined, and the determined values are stored as the ejection-amount information in the memory 401. Here, the ejection-amount information is expressed by prefixing "ID" before the value indicating the deviation, as in "ID50" for example, and the ejection-amount information is referred to herein as "ID values." For example, the ID value of a nozzle row ejecting an ink amount that is consistent with the theoretical value when driven with the evaluation pulses is "ID50". On the other hand, the ID values of nozzle rows that eject less ink than the theoretical value are "ID49", "ID48" . . . in accordance with the deviation from the theoretical value, whereas the ID values of nozzle rows that eject more ink than the theoretical value are "ID51", "ID52" . . . in accordance with the deviation from the theoretical value.

The darkness-correspondence information is a conversion data table that is used by the color conversion processing section 352 when performing the color calibration process with respect to CMYK image data with 256 gradations, after the color conversion processing section 352 of the above-mentioned image processing section 350 has converted the RGB image data with 256 gradations for every pixel of the image data into CMYK image data with 256 gradations that can be utilized by the printer 20. That is to say, the color conversion processing section 352 is a converting section that converts, pixel by pixel, the gradation values of image data to be printed, based on the ink-ejection amount that is ejected by the respective nozzle rows serving as the ink-ejecting sections and the reference amount of ink serving as the reference.

Figure 10:
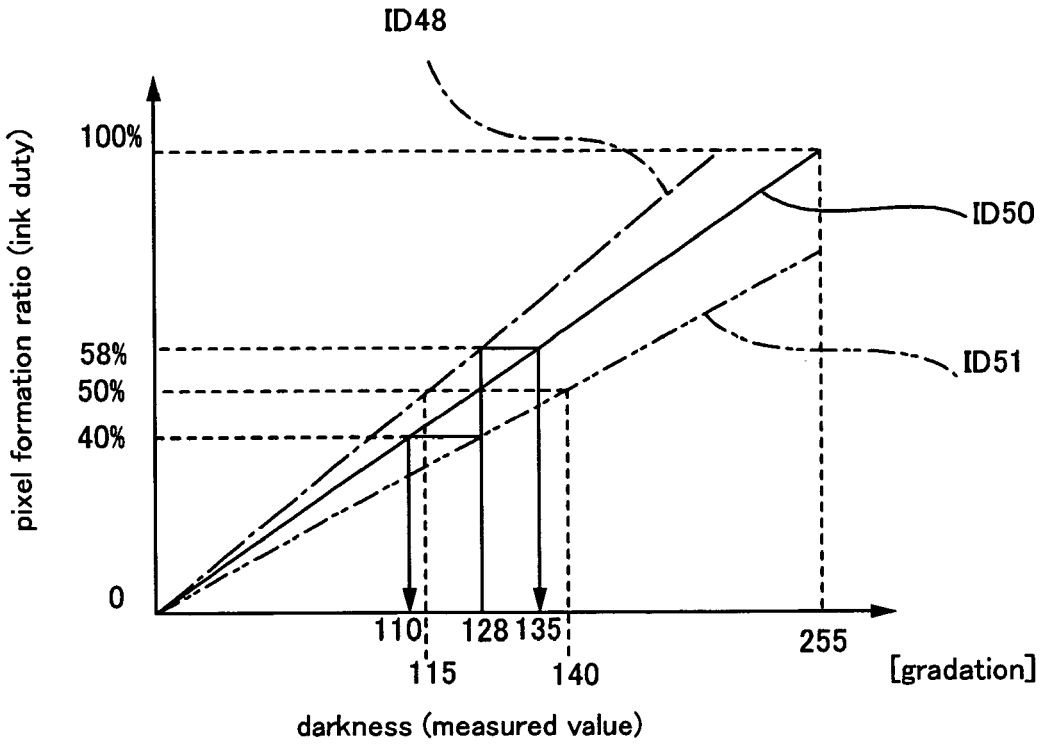
FIG. 10 is a diagram illustrating the principle of the conversion data table used for color calibration according to the first embodiment.

FIG. 10 is a diagram illustrating the principle of the conversion data table used for the color calibration in this first implementation.

FIG. 10 shows the correlation between measured values of the printed image darkness and the pixel formation ratio, when ink is ejected with the evaluation pulses, and the reference nozzle row and the nozzle rows with different ejection amounts, that is, a plurality of predetermined nozzle rows serving as predetermined ink-ejecting sections with different ID values are used to print images with different pixel formation ratios in a predetermined region. Here, "pixel formation ratio" means the ratio that is given by the number of pixels formed in a predetermined region to the total number of unit pixel formation regions in which a single pixel can be formed and which are provided within the predetermined region. In FIG. 10, the vertical axis indicates the pixel formation ratio, and the horizontal axis indicates the darkness of the printed image. Here, the darkness of the printed image is indicated by gradation values of 256 gradations. A gradation value of "255" indicates a darkness of an image in which ink is ejected onto the entire predetermined region, and a gradation value of "0" indicates a darkness of an image in which no ink is ejected at all. This conversion data table is provided separately for each of the plurality of ink colors (K, C, LC, M, LM, Y) that can be used by the printer 20, and the 256 gradation values correspond to the values indicating the darkness in the 256-gradation data for CMYK when generating the print data from the image data to be printed.

FIG. 10 shows three graphs correlating the pixel formation ratio of the printed image to the darkness of the image that is printed when the reference nozzle row with the ID value (ID50) serving as the reference is used, and the darkness of the images printed, while stepwise changing the pixel formation ratio, with nozzle rows of ID48 and ID51. The graph for ID50 is obtained by printing a plurality of images using the reference nozzle row while stepwise changing the pixel formation ratio, measuring the darkness of the printed images with a darkness measurement device, and plotting the measured values substituting them with gradation values.

For example, an image with an pixel formation ratio of 100%, that is, an image in which 100 pixels are formed within a region in which 100 pixels can be formed, is printed using the reference nozzle row, the darkness of the printed image is measured, and the measured value is plotted at the intersection between the pixel formation ratio of 100% and the gradation value "255" indicating the darkness. For an pixel formation ratio of 50%, the reference nozzle row is used to print an image in which 50 pixels are formed within a region in which 100 pixels can be formed, the darkness of the printed image is measured, and the measured value is plotted at the intersection between the pixel formation ratio of 50% and the gradation value "128" indicating the darkness. Then, images with stepwise changing pixel formation ratio are printed using the reference nozzle row, and the measured values of the darkness of the printed images are plotted, thus completing the graph for ID50. Similarly, also the graphs for ID48 and ID51 are graphs in which the measured values when using predetermined nozzle rows with ID48 and ID51, respectively, are plotted. Printing an image with an pixel formation ratio of 50% using a nozzle row with ID48 and measuring the darkness of the printed image results in a gradation value of "115", for example.

Moreover, printing an image with an pixel formation ratio of 50% using a nozzle row with ID51 and measuring the darkness of the printed image results in a gradation value of "140". In this manner, a plurality of images with different pixel formation ratios are printed, and the measured values of the darkness of the printed images are individually plotted, thus producing the graphs shown in FIG. 10. In this example, three graphs are shown, but at least a number of graphs is formed that corresponds to the ID values that can occur in the nozzle rows. A conversion data table represented by these graphs is stored in the memory 401.

The color calibration is performed as follows, based on the conversion data table and the average ID value of the nozzle rows that eject the same color of ink but are provided in different print heads.

Let us assume that, when color-converting the resolution-converted RGB data corresponding to a predetermined pixel that is formed by the dark magenta nozzle row M of the first print head 28*a*, the gradation value indicating the darkness of magenta at this pixel is set to "128" in the color conversion table LUT. This gradation value "128" is the gradation value of the darkness for the case that the image is formed by a nozzle row with ID50. Therefore, the image that actually should be formed based on the data of the gradation value "128" is an image with a pixel formation ratio of 50% formed by the nozzle row with ID50, based on the data of the gradation value "128". Let us further assume that the average ID value of the dark magenta nozzle rows M provided in the print heads 28*a* to 28*t* is ID51.

The graph in FIG. 10 shows that, for a predetermined nozzle row corresponding to the average ID value (ID51) of the dark magenta nozzle rows M provided in the print heads 28*a* to 28*t*, an image with the same darkness as with the gradation value "128" formed by the reference nozzle row corresponds to an image with a pixel formation ratio of 40% formed by the reference nozzle row. Therefore, the data of the gradation value "128" to be printed by the dark magenta nozzle rows M of the print heads 28*a* to 28*t* is converted to the gradation value "110", which corresponds to the darkness of an image with a pixel formation ratio of 40% formed by the reference nozzle row. That is to say, the data of the gradation value "128" to be printed by the dark magenta nozzle rows M of the first print head 28*a* is also converted to the gradation value "110".

Moreover, the graph in FIG. 10 shows that, if the average ID value of the dark magenta nozzle rows M provided in the print heads 28*a* to 28*t* were ID48, then an image with the same darkness as with the gradation value "128" formed by the reference nozzle corresponds to an image with a pixel formation ratio of 58% formed by the reference nozzle row. Therefore, the data of the gradation value "128" printed by the dark magenta nozzle rows M of the print heads 28*a* to 28*t* is converted to the gradation value "135", which corresponds to the darkness of an image with a pixel formation ratio of 58% formed by the reference nozzle row.

Thus, it becomes possible to suppress darkness non-uniformities in images formed by nozzle rows with different ID values, that is, nozzle rows with different ink ejection properties, by converting the gradation values of image data based on the average value of the ID values of the nozzle rows and the conversion data table.

===Printing Operation===

FIG. 11 shows an example of a data table with ejection-amount information. The ejection-amount information data table correlates the ID values (ejection-amount information) with each of the nozzle rows of the print heads, and is stored in the memory 401. In FIG. 11, the light cyan nozzle row of the first print head, which ejects light cyan LC, has an ID value of 50, the light cyan nozzle row of the second print head has an ID value of 52, and the light cyan nozzle row of the third print head has an ID value of 48, and so forth, and this information is stored in the memory 401. Let us assume that the average ID value for the light cyan nozzle rows LC of all print heads 28*a* to 28*t* is 51. This means that the average value of the amount of ink ejected from all light cyan rows LC is an amount of ink that corresponds to a deviation of 51 (ID51) with respect to the reference amount, when the reference amount of ink ejected from the reference nozzle rows is 50. That is to say, in this case, images printed by the light cyan nozzle rows LC of the print heads on the whole tend to have a greater darkness than images printed with the reference amount. Therefore, the gradation value of the image data printed by the light cyan nozzle rows LC is converted such that the difference between the darkness of images printed by the light cyan ink and the darkness of images printed by the reference amount of ink becomes small and darkness non-uniformities are suppressed.

Figure 12:
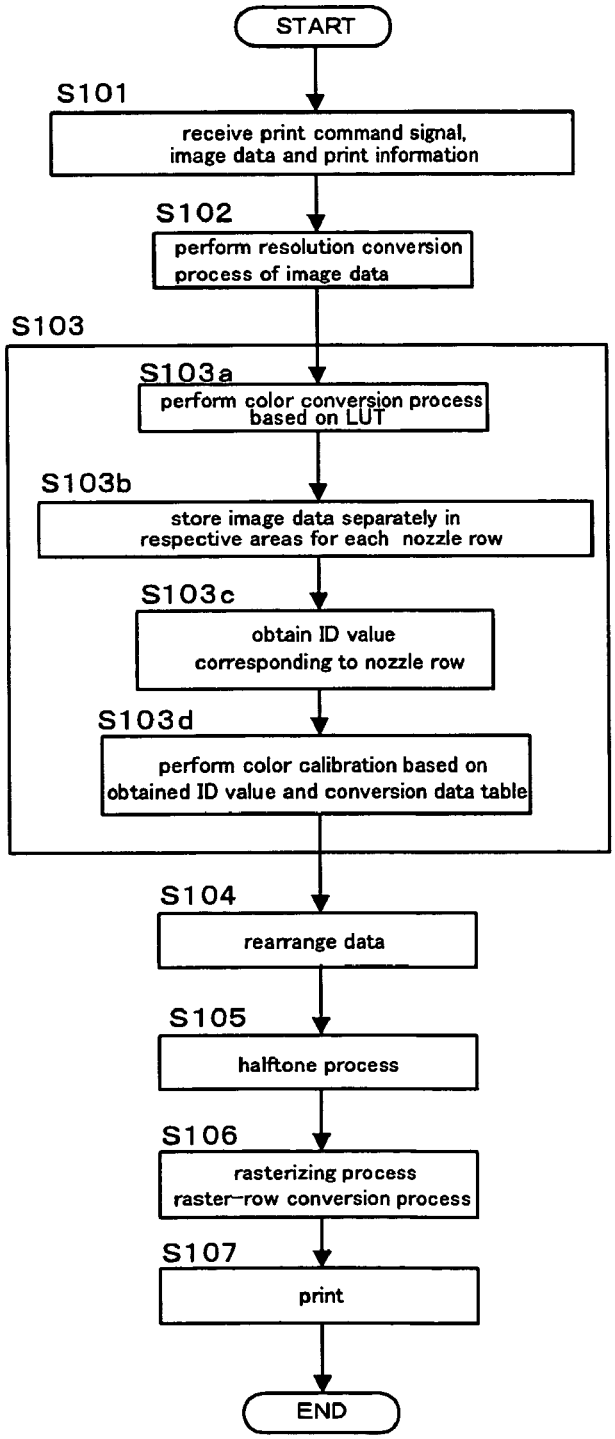
FIG. 12 is a flowchart illustrating the process of generating print data according to the first embodiment.

The process of converting the gradation values of the image data and printing images based on the converted gradation values is explained together with the operation of the printer 20. FIG. 12 is a flowchart illustrating the process of printing images with converted gradation values. Here, an example is explained in which images are printed after converting the gradation values of the image data to be printed by the dark magenta nozzle rows M.

First, the printer 20 receives the image data together with print command signals and print information from a computer connected to the printer 20 (S101). The print information is data indicating all sorts of parameters regarding the printing, such as the resolution of the image to be printed, or the printing method, such as band printing or interlaced printing.

The resolution conversion processing section 351 of the image processing section 350 converts the image data from the resolution of the entered RGB image data to the resolution for printing (S102). At this time, each of the pieces of the converted data corresponds to one of the pixels constituting the printed image. That is to say, the converted data corresponds to the pixels of the image to be printed, and the printer 20 can specify the nozzles by which the pixels are to be formed, based on the print information obtained together with the image data.

The resolution-converted data is subjected to a data conversion process with the color conversion processing section 352 (S103). Referencing the color conversion data table LUT, the color conversion process color converts, pixel-by-pixel, the RGB 256-gradation data into CMYK 256-gradation data to be printed by the printer 20 (S103*a*).

The color converted image data is then subjected to the "color calibration process" with the image processing section 350 (S103*b*). To do so, the main controller 310 first obtains the ID value of each nozzle row corresponding to the magenta nozzle rows M from the memory 401, and determines their average value by arithmetic processing. Based on the conversion data table, the determined average ID value is converted into the gradation value indicating the darkness of the 256 gradations that corresponds to a darkness of ID50 (S103*c*).

The color-converted and rearranged data is then subjected to a so-called halftone process by the halftone processing section, and binary halftone image data is generated (S104). The halftone image data is subjected to a rasterizing process and a raster-row conversion process, in which they are rearranged by the rasterizing processing section and the raster-row conversion processing section into the data order in which they are to be transferred to the printer 20, and are output as the final print data PD (S105). At this time, data indicating the paper carry amount is output together with the print data PD.

Based on a command from the main controller 310, the control circuit 500 generates PTS signals at a predetermined timing with the PTS pulse generation circuit, performs synchronization with the original drive signal generating section 540, outputs drive signals corresponding to each of the nozzle rows generated by a suitable masking process based on the print data PD, and performs printing by driving the print heads 28 (S106).

Figure 13A:
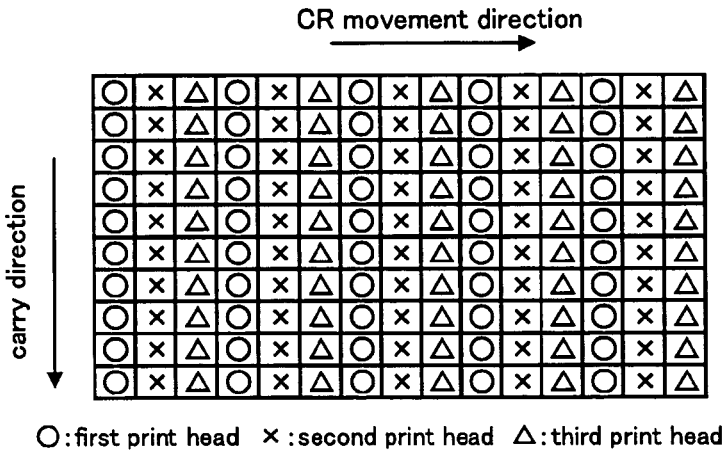
FIG. 13A is a schematic diagram showing an image printed such that dots that are adjacent in the CR movement direction are not printed with nozzle rows of the same print heads.
Figure 13B:
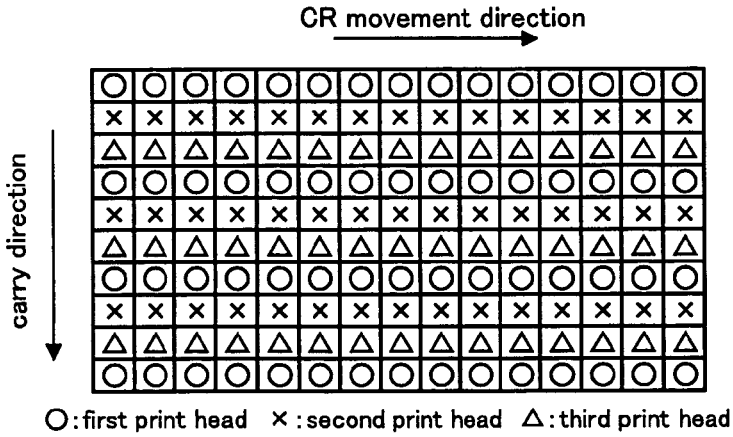
FIG. 13B is a schematic diagram showing an image printed such that dots that are adjacent in the carry direction are not printed with nozzle rows of the same print heads.
Figure 13C:
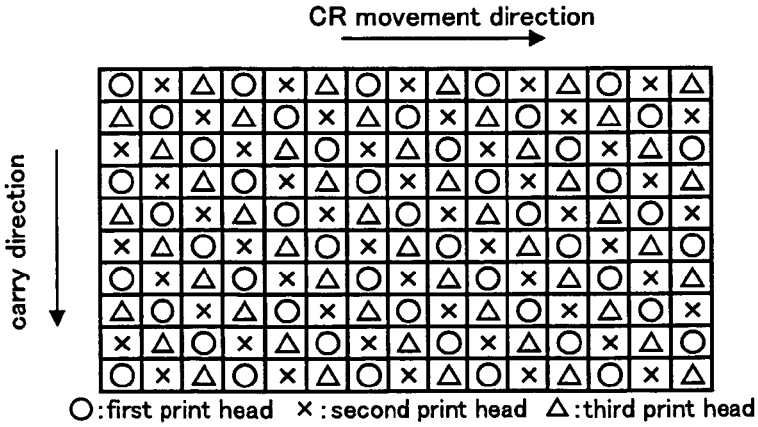
FIG. 13C is a schematic diagram showing an image printed such that dots that are adjacent in both the CR movement direction and in the carry direction are not printed with nozzle rows of the same print heads.

FIG. 13 is a diagram illustrating a printing method according to the present invention. FIG. 13A is a schematic diagram illustrating an image that is printed such dots that are adjacent in the CR movement direction are not printed by nozzle rows of the same print head. FIG. 13B is a schematic diagram illustrating an image that is printed such dots that are adjacent in the carry direction are not printed by nozzle rows of the same print head. FIG. 13C is a schematic diagram illustrating an image that is printed such dots that are adjacent in both the CR movement direction and the carry direction are not printed by nozzle rows of the same print head. As examples of such printed images, FIGS. 13A, 13B and 13C each show images that are printed by three print heads. In these figures, a circle (○) denotes dots formed by a first print head, a cross (x) denotes dots formed by a second print head, and a triangle (Δ) denotes dots formed by a third print head.

As shown in these figures, it is preferable to perform printing using a print method in which, regarding the print heads with which one image is printed, dots formed by nozzle rows that eject ink of the same color but belong to different print heads are not adjacent in at least one of the CR movement direction and the carry direction of the print paper. That is to say, it is preferable that printing is performed in such a manner that dots formed by nozzle rows that eject ink of the same color but belong to different print heads are scattered substantially uniformly over the entire printed image. Since the gradation values of the image data are converted in the above-described color calibration process in accordance with the average ID value of the nozzle rows and the conversion data table, the darkness of images formed by nozzle rows of different print heads will be slightly different. Thus, by scattering dots formed by nozzle rows of different print heads over the entire image instead of letting them be adjacent, it is possible to print an image with little darkness non-uniformities in the overall image.

With the printer 20 of the present embodiment, the conversion data table serving as the darkness-correspondence information of the printer 20 correlates, for each of the ink colors ejected from the nozzle rows, the darkness of the image printed using each of a plurality of predetermined ink-ejecting sections to the darkness of an image printed with the reference amount of ink. Moreover, the plurality of predetermined ink-ejecting sections have different ink-ejection amounts, so that it is possible to correlate one of the predetermined ink-ejecting sections as a predetermined nozzle row ejecting an amount of ink that corresponds to the average value of the ink-ejection amounts that is ejected by the plurality of nozzle rows of the printer 20. For this reason, it is possible to suppress variations in the darkness of the image printed with ink ejected from nozzle rows ejecting the same color of ink, by converting the gradation values based on a correlation, in the conversion data table, between the darkness of the image printed using a predetermined nozzle row ejecting an amount of ink corresponding to an average ejecting amount of a plurality of nozzle rows and the darkness of an image printed with the reference amount of ink.

Moreover, by regarding the darkness of the image printed with the predetermined nozzle row ejecting an ink amount corresponding to the average ejection amount of each of the nozzle rows as the darkness of the image printed by the each of the nozzle rows, the gradation values of the image to be printed by the nozzle rows ejecting ink of the same color can be converted using only the correlation between the darkness of the image printed by one predetermined ink-ejecting section and the darkness of the image printed with the reference amount of ink. Therefore, non-uniformities in the darkness of the printed image can be suppressed with a simpler control than in the case that the individual gradation values are converted for each of the nozzle rows, and it becomes possible to print a favorable image without darkness non-uniformities or the like.

Moreover, in the conversion data table, the ink-ejection amounts of the predetermined nozzle rows are indicated as ejection-amount information indicating the deviation from the reference amount, and ejection-amount information indicating the deviations of the ink-ejection amounts ejected from the nozzle rows is provided separately for each of the nozzle rows, so that, with the ejection amount deviations, it is easy to correlate the ejection amount of each of the nozzle rows with the reference amount.

Moreover, the reference amount that is necessary for converting the gradation values and the ink amount that is ejected from each of the nozzle rows are both actually measured values. Therefore, the gradation values are converted by correlating the darkness of the image printed with the nozzle rows and the darkness of the image printed with the ink of the reference amount, based on the ink amounts that are actually ejected. Thus, darkness non-uniformities are less likely to occur in the printed image, and it is possible to prevent images from being printed with different hues.

Moreover, in measuring the ink-ejection amount, the amount of ink ejected for forming the dots of the largest size are measured. By ejecting a greater amount of ink than is ejected to form dots of other sizes, it is possible to perform an accurate measurement without forming a mist, without affecting the nozzle conditions or the measurement environment and without measurement discrepancies. Thus, accurate ejection-amount information can be obtained, so that the gradation values can be converted more appropriately.

Furthermore, the images used as the basic data for the conversion data table are printed based on the pixel formation ratio, so that when an image is printed based on the same pixel formation ratio, then an image with the same dot pattern will be printed. Therefore, it is possible to compare the difference of the image darkness resulting from different sizes of dots due to the different amounts of ink ejected from each of the nozzle rows when printing an image with nozzle rows ejecting the reference amount of ink and with the predetermined nozzle rows, in accordance with the same pixel formation ratio. By correlating the pixel formation ratios with the darkness of an image printed with the reference amount and with the darkness of images printed with the predetermined nozzle rows, it is possible to correlate the darkness of images printed with nozzle rows of a plurality of different kinds of ejection-amount information with the darkness of an image printed with the reference amount. That is to say, based on the conversion data table and the ejection-amount information of each of the nozzle rows, it is possible to correlate the darkness of the images printed with each of the nozzle rows and the darkness of the image printed with the reference amount of ink, and thus to convert the gradation values with precision.

Furthermore, the darkness of the images printed based on the pixel formation ratios are actually measured values. Therefore, the gradation values of the image data are converted with the conversion data table based on the actually ejected amount of ink, in such a manner that the difference between the darkness of the images printed by each of the nozzle rows and the darkness of the image printed with the reference amount of ink becomes small. Thus, it is possible to prevent images with darkness non-uniformities or different hues from being printed, and favorable images can be printed.

In this embodiment, an example was described in which the conversion of the darkness is performed in accordance with the ID values of the nozzle rows when performing the color conversion process. It is also possible, however, to color convert the RGB image data in accordance with the color conversion data table LUT, and to change the ratio with which large, medium and small dots are distributed within a predetermined region of the image, based on the average ID value for every nozzle row ejecting the various color of ink when subjecting the color-converted data to halftone processing. In this case, if, for example, dithering is used for the halftone processing, then this can be realized by converting the threshold value given for each of the pixels by the dither matrix in accordance with the average ID values for the respective nozzle rows ejecting the various colors of ink.

Figure 14:
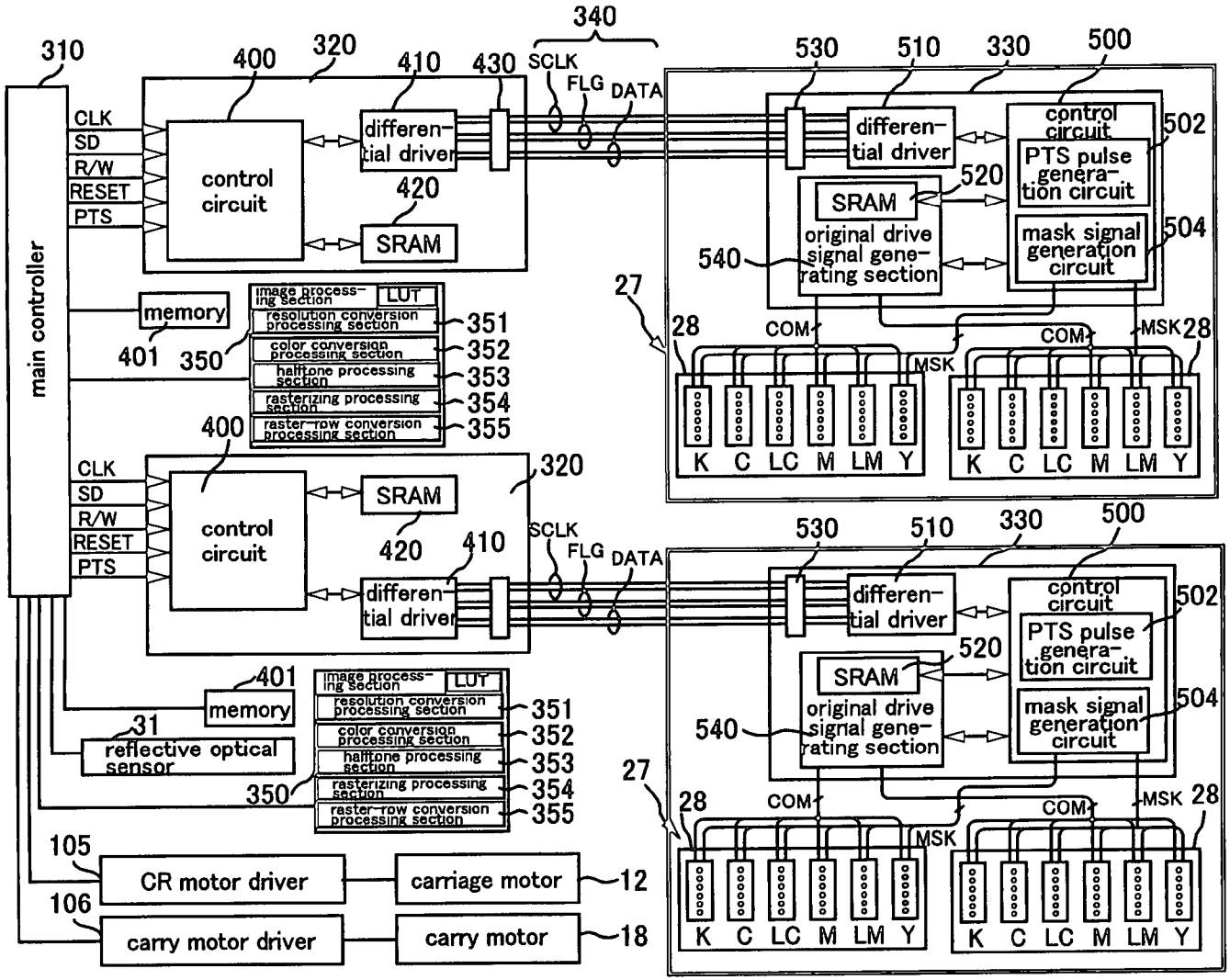
FIG. 14 is a block diagram showing another configuration in accordance with the first embodiment of the present invention.

FIG. 14 is a block diagram showing another configuration in accordance with the present invention.

The foregoing embodiment explained an example in which all print heads 28 perform printing based on print data that is generated by one image processing section 350. However, as shown in FIG. 14, it is also possible that one image processing section 350 is associated with each print head group (ink-ejecting section unit group) 27 (see FIG. 5) including a plurality of the print heads 28, and images are printed by individual print heads 28 associated with the image processing section 350, based on the print data generated by the image processing section 350. In this case, the color calibration process that is executed by the color conversion processing section 352 is performed for every nozzle row ejecting the same color of ink in the print head group 27, which is constituted by the plurality of print heads 28.

In this case, there is an image processing section 350 for each print head group 27, so that it is possible to print an image with each print head group 27. That is to say, the average ID value is determined for each of the print head groups 27, which have at least two print heads 28 and eject the same color of ink, and the gradation values are converted separately for every print head group 27 using the determined average value. Therefore, it is possible to suppress darkness non-uniformities in the images printed with each of the print head groups 27. Thus, converting the gradation values separately for each of the print head groups 27 is particularly advantageous if different images are printed with the respective print head groups 27, and since average values are not determined for more print heads 28 than necessary, it is possible to achieve a small difference between the proper image darkness and the darkness of the image printed by converting the gradation values based on the average value, and thus it is possible to print more favorable images.

===Second Implementation Concerning Ejection-Amount Information===

In the above-described first implementation, the deviation of the ink amount that is ejected respectively from a plurality of nozzle rows in response to a predetermined signal from a reference amount of ink that is ejected in response to this predetermined signal is determined from the weight of the ejected ink, and such a deviation is adopted as the ejection-amount information. In this second implementation, an example is explained, in which the darkness of a pattern that is actually printed with the each nozzle row is measured, and this measured darkness information is taken as the ejection-amount information.

The darkness information of each of the nozzle rows indicates the ID values representing the deviation, from a reference darkness, of the darkness of print patterns respectively printed with each of the nozzle rows, based on image data for printing a print pattern of a predetermined darkness, for example. This darkness information is stored in the memory 401 as a darkness data table correlating the ID values with the nozzle rows. If 256 gradations of darkness given by the values 0 to 255 can be rendered, then the print pattern of predetermined darkness is an image corresponding to the darkness given by one of the 256 gradations. In the case of halftone in which the gradation is expressed with, for example, 128 values, the print pattern is printed based on image data that has been subjected to a known halftone process.

<Example of Method for Generating Darkness Data Table>

Figure 15:
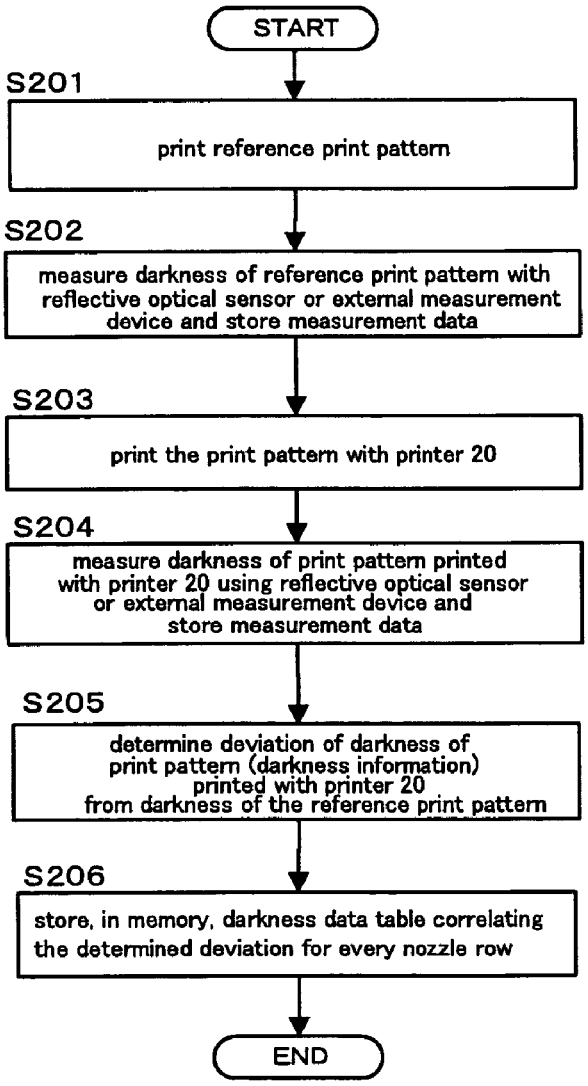
FIG. 15 is a diagram illustrating an example of a method for generating a darkness data table.

FIG. 15 is a diagram illustrating an example of a method for generating a darkness data table.

First, based on the image data for printing a print pattern of a predetermined darkness, a predetermined print pattern is printed with each of the nozzle rows using a reference printer or a reference print head with which a print pattern having a reference darkness can be printed, when printing a predetermined print pattern (S201). In the following, this predetermined print pattern printed using the reference printer or reference print head is referred to as "reference print pattern."

The print paper on which the reference print pattern has been printed is set in the printer 20 which is to be color calibrated, and is carried by the print paper carry section 21. In this situation, the carriage 30 is moved while the print paper is being carried, and when the reflective optical sensor 31 mounted on the carriage 30 comes into opposition to the reference print pattern, the darkness of the reference print pattern is measured with the reflective optical sensor 31. Then, the output of the reflective optical sensor 31 is stored, for each nozzle row, as the darkness of the reference print pattern (S202).

Next, a predetermined print pattern is printed with each of the nozzle rows of the printer 20, using the same image data as for the reference print pattern (S203). After this, the carriage 30 is moved while carrying, with the print paper carry section 21, the print paper on which the print pattern has been printed, and the output of the reflective optical sensor 31 is stored, for each nozzle row, as the darkness of the print pattern printed with the printer 20 (S204). In the printer 20, the reflective optical sensor 31 is arranged downstream in the paper carry direction, so that the darkness can be measured without carrying the paper in the opposite direction after printing the print pattern.

Then, the deviation, from the output of the reflective optical sensor 31 for the reference print pattern, of the output of the reflective optical sensor 31 for the print pattern printed with the printer 20 is taken as the ID value. Here, the output of the reflective optical sensor 31 for the reference print pattern is taken as the reference value "50". This ID value is determined for every nozzle row (S205). A darkness data table correlating the determined ID values and the nozzle rows is generated for every print head, and is stored in the memory 401 (S206). The ID values are determined by the following Equation 1, where IDx is the ID value to be determined, V0 is the darkness of the reference print pattern, and Vs is the darkness of the print pattern printed with the printer 20.

$$IDx = Vs/V0 \times 50 \quad \text{(Equation 1)}$$

In this case, when the darkness of the reference print pattern that is output by the reflective optical sensor 31 is, for example, 3.0V for white, then it is 0.5V for black, 1.5V for cyan, 1.7V for light cyan, 1.5V for magenta, 1.7V for light magenta, and 2.0V for yellow. That is, the higher the darkness is, the lower is the value that is output. Here, the ID values are determined under the assumption that the output of the reflective optical sensor 31 changes linearly with respect to the darkness of the print pattern.

The principle of the darkness data table that is generated in this manner is similar to the data table of the ejection-amount information shown in FIG. 11. For example, assuming that the data table of the ejection-amount information in FIG. 11 is the darkness data table, then the characteristic information for the nozzle row ejecting black ink K in the first head indicates that an image with the same darkness as when printed using the reference printer or the reference print head will be printed because ink with the theoretical design value (ID50) will be ejected. This darkness data table further shows that, when a print pattern based on the same image data is printed with the nozzle row ejecting black ink in the first head and with the nozzle row ejecting black ink in the second print head, the print pattern printed with the second print head will be printed with higher darkness.

The process of generating the drive signal in this second implementation is similar to the process in the first implementation, in which the ink-ejection amount was measured, so further explanation thereof has been omitted.

By performing the color calibration using such a darkness data table, it is easy to convert the image data such that the non-uniformities in the darkness of the image printed with the nozzle rows are small and such that the difference from the darkness of the image printed with the reference amount of ink becomes small, based on the darkness-correspondence information and the ejection-amount information obtained by measuring the darkness of the print pattern that has been actually printed. Consequently, an appropriate color calibration suitable for actual printers can be performed, and more favorable images with the proper color tone can be printed with little darkness non-uniformities.

Moreover, for the darkness measuring section that measures the darkness of the print pattern, it is possible to use the reflective optical sensor 31 mounted on the carriage 30 as the paper detection sensor or the sensor for detecting the paper width. Therefore, it is not necessary to mount a sensor only for performing color calibration, so that the manufacturing costs can be kept low.

In the foregoing embodiment, an example has been explained, in which the reflective optical sensor 31 is provided downstream in the paper carry direction from the print heads, but the reflective optical sensor 31 does not necessarily have to be provided downstream from the print heads. For example, it is also possible to arrange the reflective optical sensor 31 upstream from the print heads. In this case, the print pattern will be positioned further upstream than the reflective optical sensor when the print pattern has been printed. Therefore, the paper on which the print pattern has been printed needs to be carried in a direction that is opposite to the direction when printing. On the other hand, with the printer of the foregoing embodiment, in which the reflective optical sensor 31 is provided downstream in the paper carry direction from the print heads, the darkness can be measured without carrying the paper, on which the print pattern is printed, in the opposite direction. The foregoing embodiment is therefore more preferable in terms that the process of printing the print pattern and measuring its darkness becomes easy, and can be performed in shorter time and with greater efficiency. Furthermore, in the foregoing embodiment, an example was explained in which one reflective optical sensor is provided, but it is also possible to provide a plurality of reflective optical sensors. In this case, it is possible to shorten the time that is needed to measure the darkness of the print pattern, but there is the possibility that discrepancies are introduced to the measurement values due to variations among individual reflective optical sensors. Therefore, the printer of the first implementation, which is provided with only one reflective optical sensor, can print a more favorable image.

In the foregoing two embodiments, examples were explained in which the measurement of the darkness of the reference print pattern and the print pattern printed with the printer 20 is performed with the reflective optical sensor 31 of the printer 20, but it is also possible to perform this measurement with a separate darkness measurement device (for example an X-Rite938™ by X-Rite Ltd.) that is arranged external to the printer 20, to determined the ID values. In this case, it is not necessary to provide the printer 20 with a sensor for measuring the darkness, and it is possible to measure the darkness without setting the reference print pattern to the printer 20. However, the above-described second implementation using the reflective optical sensor 31 is superior with regard to the fact that a color calibration with higher precision is possible because the measurement is performed with the actual device.

In the first implementation, an example was described in which a data table based on the ink amount ejected from each of the nozzle rows is stored in the memory 401 as the ejection-amount information; and in the second implementation, an example was described in which a darkness data table based on the measured darkness of the print patterns printed with ink ejected from each of the nozzle rows is stored in the memory 401 as the ejection-amount information. These embodiments were explained as separated examples. However, they do not necessarily need to be separate embodiments. For example, it is also possible to store a data table based on the ejection amounts in the memory 401 when manufacturing the printer, let the user print the print pattern when necessary, measure the darkness of the printed print pattern, and to overwrite the data table based on the ejection amounts with the darkness data table. In such a printer, even after the user has obtained the printer, it is possible to eject ink consistently while suppressing fluctuations of the ejection amount from the nozzles due to temperature and to print a favorable image, by using a data table based on the ejection amount. Furthermore, it is possible to print even more favorable images by overwriting the data table based on the ejection amounts with a darkness data table obtained by printing the print pattern with the printer set up at the location where it is used and in the actual usage environment of the printer. In this case, if, for example, the user overwrites the data table based on the ejection amounts with the darkness data table, then it is preferable that the information indicating the darkness of the reference print pattern is stored in the memory in advance.

===Other Considerations===

(1) In the foregoing embodiment, the data table of the ejection-amount information stored in the memory 401 was set using the ID values of the nozzle rows, but it is also possible to store average values of the ID values of a plurality of nozzle rows in the data table. In this case, the average values may be the average value for the nozzle rows ejecting ink of the same color in all print heads 28, and it may also be the average value for the nozzle rows ejecting ink of the same color for each print head group 27. Moreover, it is also possible to store, as the ejection-amount information, the actually measured ink amounts that are ejected from each of the nozzle rows in response to a predetermined signal. In this case, it is also possible to determine the average value of the actually measured ejection amounts, and to convert the gradation values based on the conversion data table and the deviation of the determined average value from the actually measured reference amount.

(2) In the foregoing embodiments, examples are explained in which drive signals for ejecting ink to form large dots were used as the evaluation pulse for measuring the ink amount that is ejected from each of the nozzle rows and from the reference nozzle row, but there is no limitation to this. It is also possible to use the drive signals for ejecting ink to form dots of any other size. It is also possible to measure the ink amounts that are ejected in order to form dots of the various sizes, using the drive signals for ejecting ink to form the dots of all sizes. In this case, it is possible to convert the gradation values with greater accuracy for each of the dot sizes, but the time needed for measuring the ink-ejection amounts and for the conversion processing increases. Therefore, it is preferable to use the drive signals for ejecting ink to form large dots, for which the ejection amount is more consistent.

===Second Embodiment===

Overall Configuration of Printing Apparatus

Figure 16:
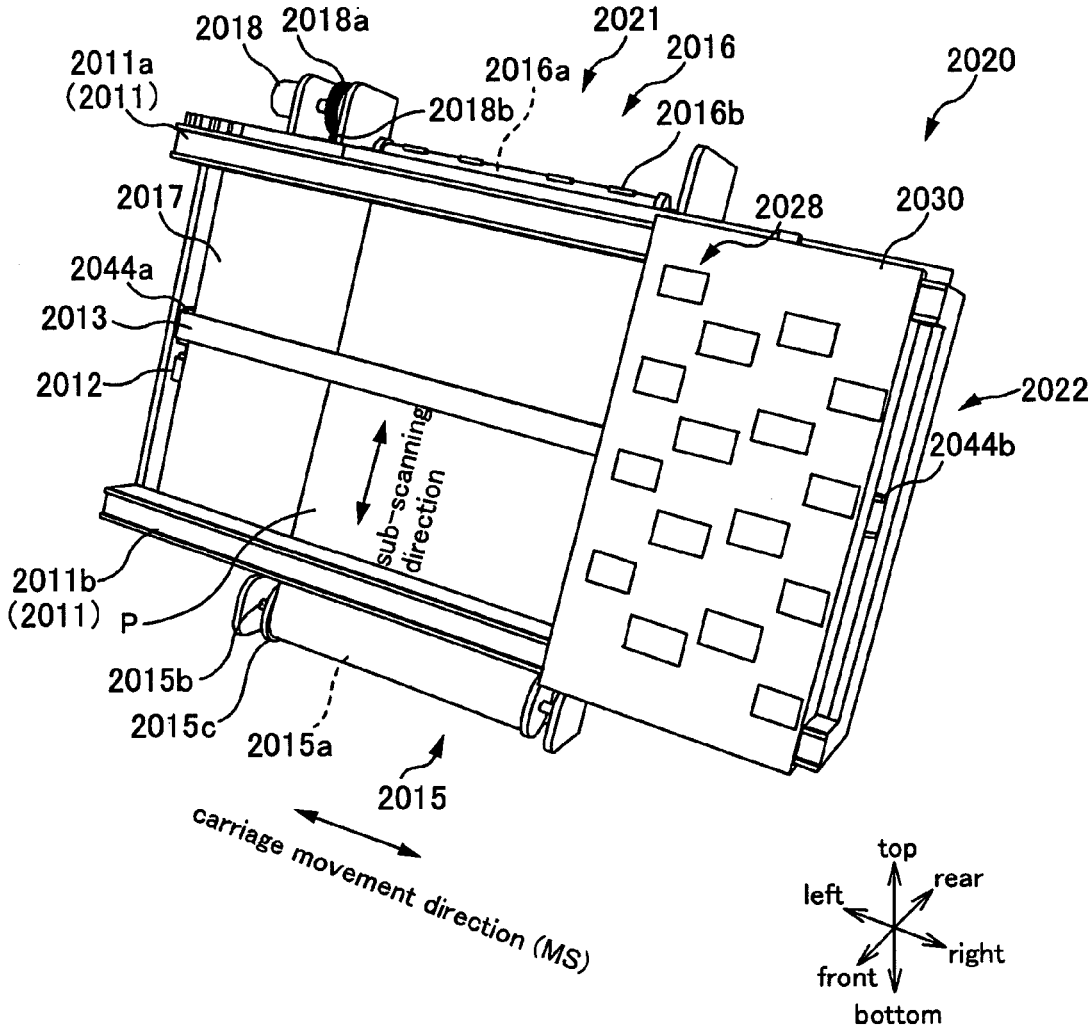
FIG. 16 is a perspective view showing an overview of the configuration of an inkjet printer, which is a printing apparatus in accordance with a second embodiment of the present invention.
Figure 17:
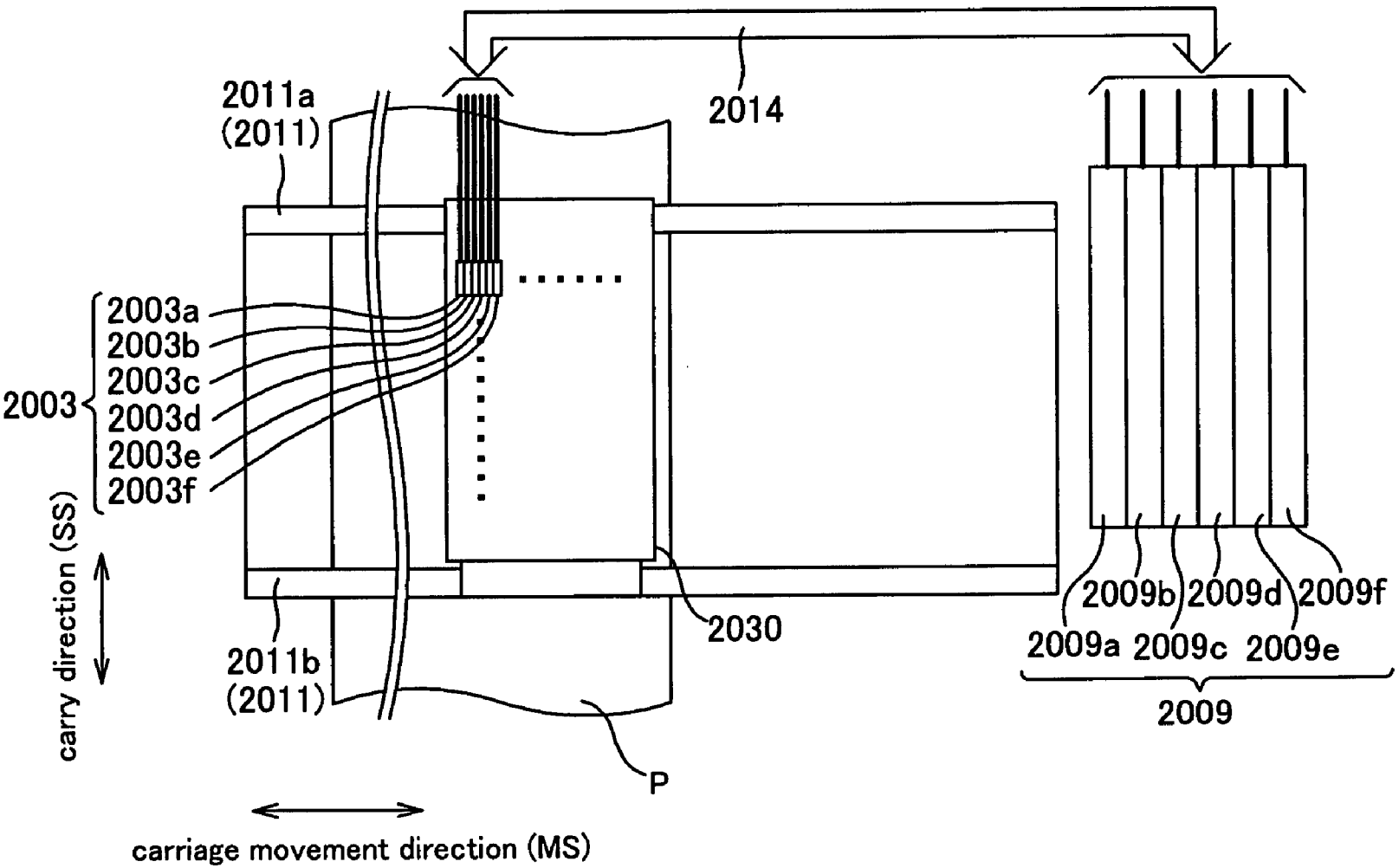
FIG. 17 is an explanatory diagram showing an overview of the configuration of a print section of the inkjet printer of the second embodiment.
Figure 18:
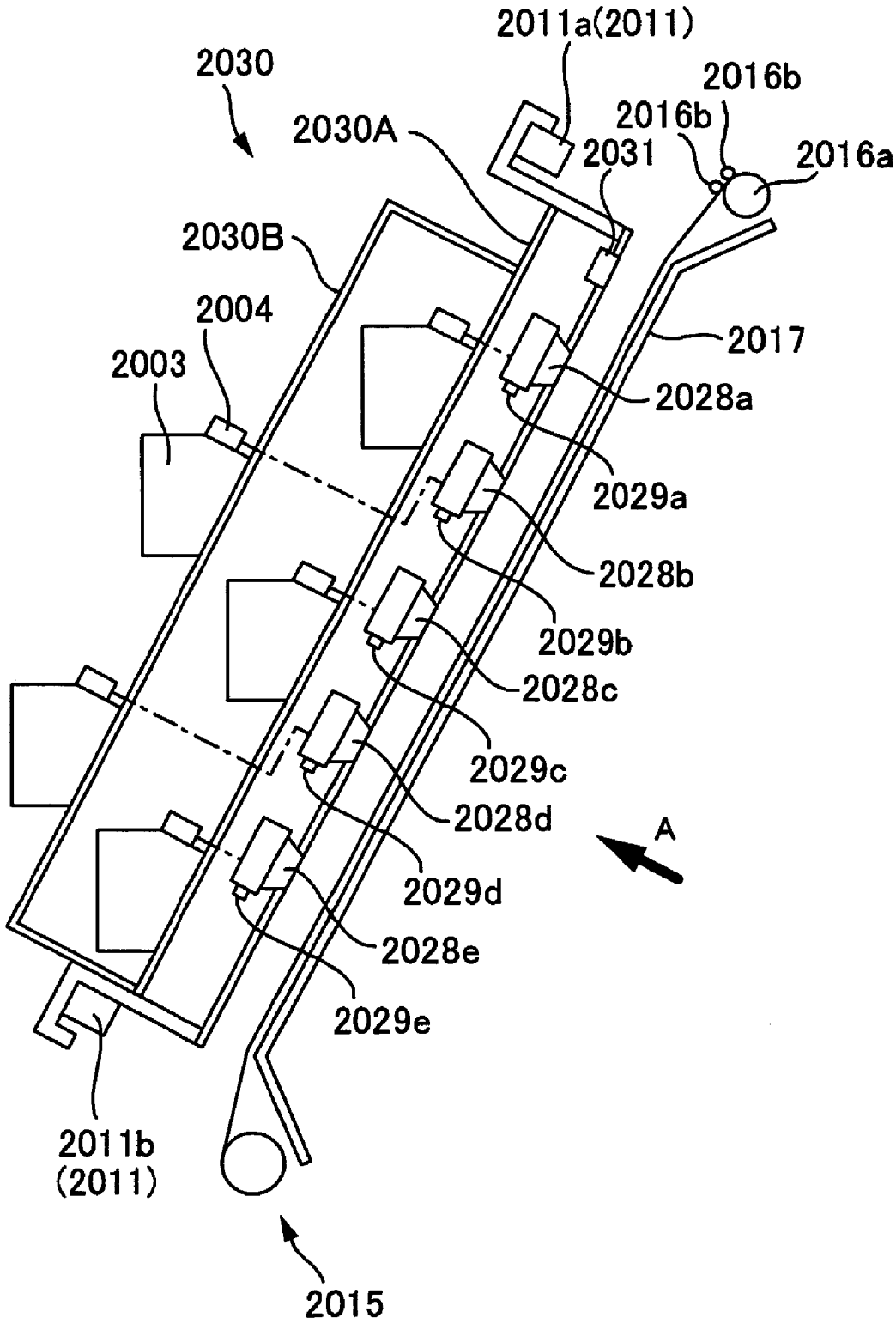
FIG. 18 is a sectional view illustrating the print section of the second embodiment.

FIG. 16 is a perspective view showing an overview of the configuration of an inkjet printer, which is a printing apparatus in accordance with a second embodiment of the present invention. FIG. 17 is an explanatory diagram showing an overview of the configuration of a print section of the ink-jet printer of the second embodiment. FIG. 18 is a sectional view illustrating the print section.

The inkjet printer (in the following also referred to as "printer") 2020, which is a printing apparatus in accordance with the present invention, is a printer adapted to handle relatively large print paper P such as roll paper or A0 or B0 size paper according to the JIS standard. The printer 2020 has a print section 2022 for printing on print paper P by ejecting ink, and a print paper carry section 2021 for carrying the print paper P. The various sections are described below.

Print Section

The print section 2022 is provided with a carriage 2030 holding a plurality of print heads 2028 serving as ink-ejecting section groups, a pair of upper and lower guide rails 2011 for guiding the carriage 2030 such that it can move back and forth in a direction (also referred to as the "carriage movement direction" or the "left-to-right direction" in the following) that is substantially perpendicular to the direction in which the print paper P is carried, a carriage motor 2012 for moving the carriage 2030 back and forth, and a drive belt 2013 for transmitting the motive force of the carriage motor 2012 and moving the carriage 2030 back and forth.

The two guide rails 2011 are arranged at the top and the bottom and extend along the carriage movement direction with a certain spacing in the carry direction between them, and are supported at their left and right ends by a frame (not shown in the drawings) serving as a base. The two guide rails 2011 are arranged such that the lower guide rail 2011*b* is located further to the front than the upper guide rail 2011*a*. For this reason, the carriage 2030, which spans the two guide rails 2011*a* and 2011*b*, moves in a tilted orientation in which its upper portion is arranged to the rear.

The drive belt 2013, which is band-shaped and made of metal, is spanned over two pulleys 2044*a* and 2044*b*, which are disposed at a spacing that is substantially the same as the length of the guide rails 2011*a* and 2011*b*, at an intermediate position between the upper and lower guide rails 2011*a* and 2011*b*. Of these pulleys 2044*a* and 2044*b*, one pulley 2044*b* is fixed to a shaft of the carriage motor 2012. The drive belt 2013 is fixed to the left edge and the right edge of the carriage 2030.

The carriage 2030 is provided with twenty print heads 2028 for ejecting ink of a plurality of colors. Each of these print heads 2028 has nozzle rows serving as ink ejecting sections. In each of the nozzle rows, a plurality of nozzles n for ejecting ink of the same color are arranged in a row. Ink is ejected from predetermined nozzles n under the control of a later-described drive control circuit 2330 (see FIG. 21). The arrangement of the print heads 2028 and the nozzles n will be discussed in greater detail later. Moreover, a plurality of sub-tanks 2003 for temporarily storing the ink that is ejected by the twenty print heads 2028 are mounted on the carriage 2030. A main tank 2009 for supplying ink to the sub-tanks 2003 is provided outside of the movement range in the carriage movement direction of the carriage 2030. Moreover, on the side in opposition to the print paper or the like, the carriage 2030 is provided with a reflective optical sensor 2031 for detecting, for example, the front end position or the paper width of the print paper or the like. This reflective optical sensor 2031 is also used as a darkness-measurement section for measuring the darkness of a print pattern or the like.

Moreover, the carriage 2030 is provided with sub-tank plates 2030A and 2030B arranged in two levels, as shown in FIG. 18. The plurality of sub-tanks 2003 are respectively mounted on these sub-tank plates 2030A and 2030B. The sub-tanks 2003 are respectively connected via valves 2004 to the print heads 2028. Moreover, the sub-tanks 2003 are connected by an ink supply duct 2014 (see FIG. 17) to the main tank 2009. The main tank 2009 stores six types of inks that can be ejected by the print heads 2028: black K, cyan C, light cyan LC, magenta M, light magenta LM and yellow Y.

In this embodiment, sub-tanks 2003*a* to 2003*f* for the six colors black K, cyan C, light cyan LC, magenta M, light magenta LM and yellow Y are provided. These six sub-tanks 2003*a* to 2003*f* are respectively connected to six corresponding main tanks 2009*a* to 2009*f*. It should be noted, however, that the inks to be used are not limited to six colors, and it is also possible to use four colors of inks (for example, black K, cyan C, magenta M and yellow Y), or seven colors of inks (for example, black K, light black LK, cyan C, light cyan LC, magenta M, light magenta LM and yellow Y).

The printer 2020 prints on print paper P that is carried by the print paper carry section 2021 by pulling the carriage 2030 with the drive belt 2013, which is driven by the carriage motor 2012, moving the carriage 2030 in the carriage moving direction along the guide rails 2011, and ejecting ink from the twenty print heads 2028 with which the carriage 2030 is provided.

===Arrangement of Nozzles and Print Heads===

Figure 19:
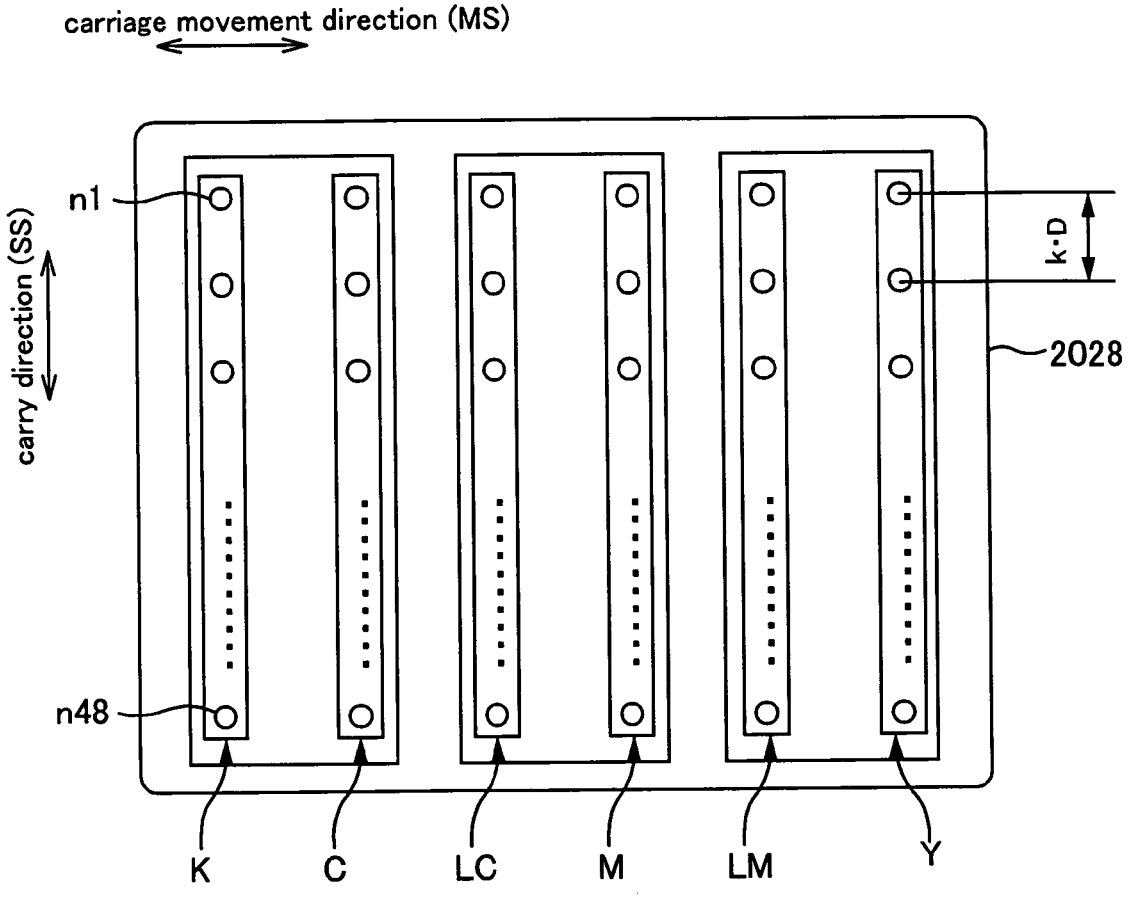
FIG. 19 is a diagram illustrating the nozzle arrangement on the bottom surface of one print head.

FIG. 19 is a diagram illustrating the nozzle arrangement on the bottom surface of one print head 2028. Nozzle rows, in which 48 nozzles are arranged in rows in the carry direction of the print paper P, are arranged on the lower surface of the print head 2028, with one nozzle row for each of the ejected ink colors. The nozzle rows of the various ink colors, that is, a black nozzle row K, a cyan nozzle row C, a light cyan nozzle row LC, a magenta nozzle row M, a light magenta nozzle row LM and a yellow nozzle row Y, are arranged next to one another at a certain interval in the direction along the guide rails 2011. Each of the nozzles is provided with a piezo element PE (see FIG. 22) as a drive element for ejecting ink from the nozzles.

Figure 20:
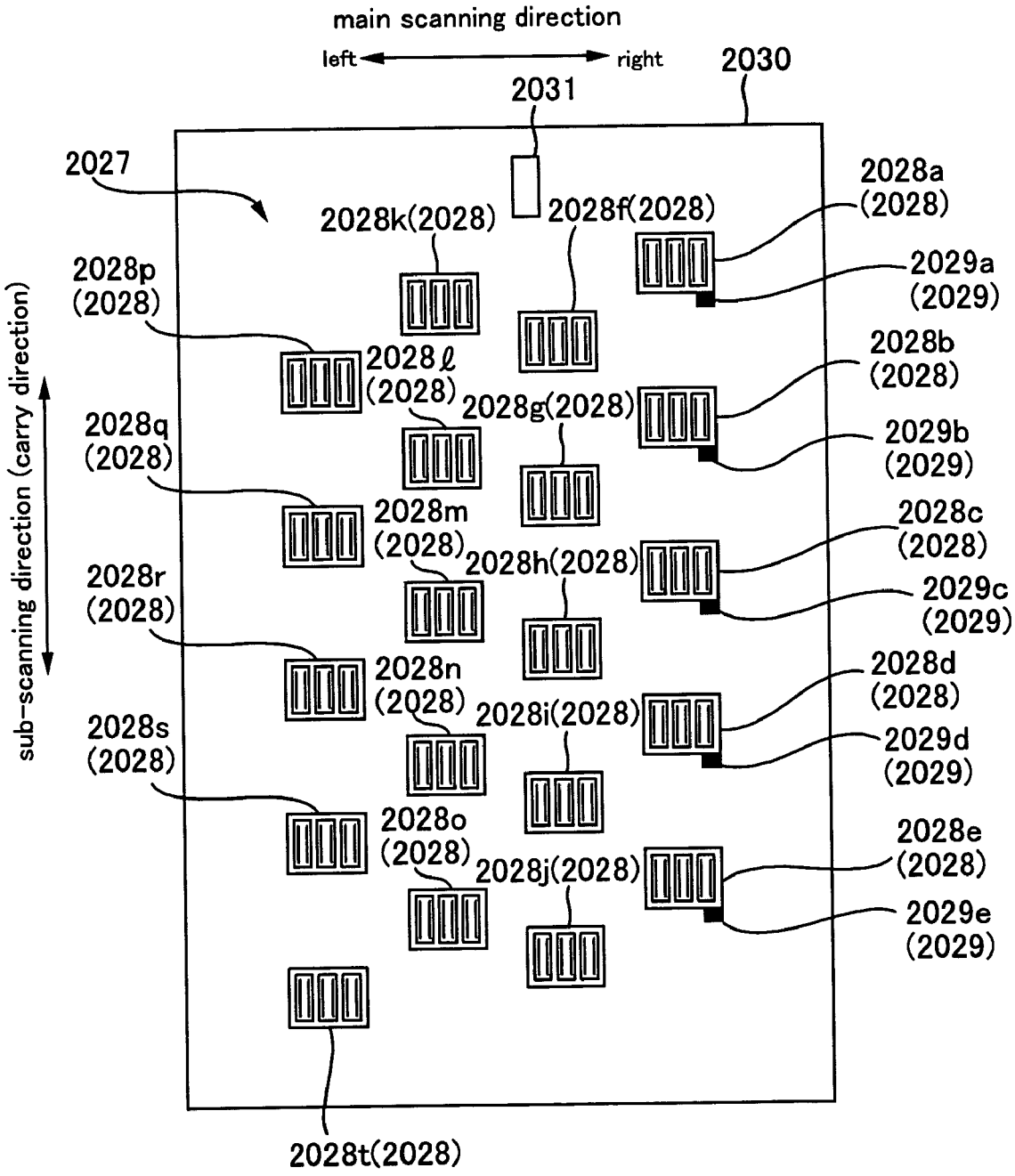
FIG. 20 shows the carriage as viewed from the direction of arrow A in FIG. 18.

FIG. 20 shows the carriage 2030 as viewed from the direction of arrow A (see FIG. 18). Needless to say, left and right in FIG. 20 are opposite from left and right in FIG. 16. The carriage 2030 is provided with a print head group 2027 made up of the twenty print heads 2028*a*, 2028*b*, . . . , 2028*t*. The twenty print heads 2028 are disposed in four rows arranged in the carriage movement direction. Each of those rows contain five print heads arranged at a certain interval in the carry direction of the print paper P. The positions of the nozzles of each print head 2028*a*, 2028*b*, . . . , 2028*t* are arranged such that they do not match in the carry direction of the print paper. For example, as shown in FIG. 20, of the four print heads 2028*a*, 2028*f*, 2028*k* and 2028*p* positioned at the uppermost positions in the rows, the print head 2028*a* located furthest to the right in FIG. 20 is positioned furthest upward, the print head 2028*k* at the uppermost position in the third row from the right is positioned second from the top, the print head 2028*f* at the uppermost position in the second row from the right is positioned third from the top, and the print head 2028*p* at the uppermost position in the leftmost row is positioned fourth from the top. The print heads are arranged such that the distance in the carry direction between the 48-th nozzle of the print head 2028*a* positioned furthest upward and the first nozzle of the print head 2028*k* positioned second from the top matches the nozzle pitch k·D of the nozzle rows. Also the print head 2028*k* (second from the top), the print head 2028*f* (third from the top), and the print head 2028*p* (fourth from the top) are arranged such that the distance between the print head 2028*k* and the print head 2028*f*, as well as the distance between the print head 2028*f* and the print head 2028*p*, matches the nozzle pitch k·D. Furthermore, also the four print heads 2028 arranged at similar positions in the vertical direction of the print head rows are arranged similarly to the four print heads 2028 at the uppermost positions. Consequently, the nozzles are arranged at equal pitch in the carry direction from the first nozzle of the print head 2028*a*, which is positioned furthest to the top in the rightmost row, up to the 48-th nozzle of the print head 2028*t*, which is positioned furthest to the bottom in the leftmost row.

The reflective optical sensor 2031 is provided on the upper side of the carriage 2030. This reflective optical sensor 2031 is arranged such that it is positioned to the downstream side with respect to the print head group 2027 in the carry direction in which the paper is carried during printing.

===Print Paper Carry Section===

The print paper carry section 2021 for carrying the print paper P is provided on the rear side of the two guide rails 2011. Also, the print paper carry section 2021 has a paper holding section 2015 for rotatively holding the print paper P below the lower guide rail 2011*b*, a paper carry holder 2016 for carrying the print paper P above the upper guide rail 2011, and a platen 2017, which guides the print paper P that is carried between the paper holding section 2015 and the paper carry holder 2016.

The platen 2017 has a flat surface spanning the entire width of the carried print paper P. Moreover, this flat surface functions as a support surface by which the print paper P that is carried in the carry direction is supported also in the carry direction.

The paper holding section 2015 is provided with a holder 2015*a* for rotatively holding the print paper P. The holder 2015*a* has a shaft member 2015*b* serving as a rotation shaft that rotates with the print paper P in a held state, and on both ends of the shaft member 2015*b* are provided guide disks 2015*c* for keeping the supplied roll paper P from zigzagging or tilting.

The paper carry holder 2016 is provided with a carry roller 2016*a* for carrying the print paper P, sandwiching rollers 2016*b* that are provided in opposition to the carry roller 2016*a* and that sandwich the print paper P in cooperation with the carry roller 2016*a*, and a carry motor 2018 for rotating the carry roller 2016*a*. A drive gear 2018*a* is provided on the shaft of the carry motor 2018, and a relay gear 2018*b* that meshes with the drive gear 2018 is provided on the shaft of the carry roller 2016*a*. The drive force of the carry motor 2018 is transmitted to the carry roller 2016*a* via the drive gear 2018*a* and the relay gear 2018*b*. That is to say, the print paper P that is held by the holder 2015*a* is sandwiched between the carry roller 2016*a* and the sandwiching rollers 2016*b* and is carried along the platen 2017 by the carry motor 2018.

===Controller of the Printer===

Figure 21:
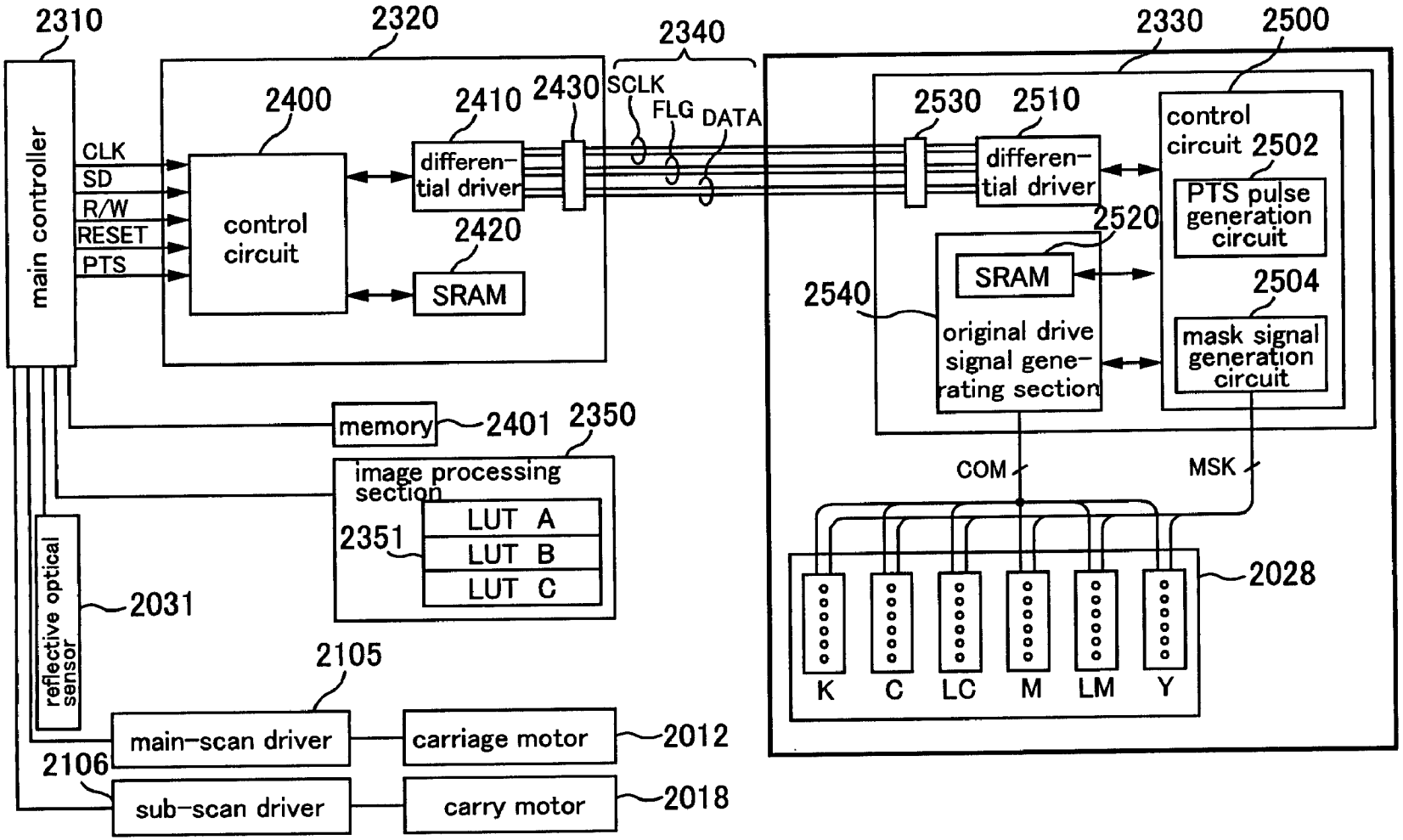
FIG. 21 is a block diagram showing the electrical configuration of the printer of the second embodiment.

FIG. 21 is a block diagram showing the electrical configuration of the printer.

The printer 2020 is provided with, for example, one main controller 2310, a plurality of data processing sections 2320 respectively corresponding to the print heads 2028 on the carriage 2030, an image processing section 2350 for converting image data, which has been input from a computer connected to the printer 2020, into print data that can be printed by the printer 2020, a CR motor driver 2105 for driving the carriage motor 2012, and a carry motor driver 2106 for driving the carry motor 2018. In the carriage 2030, each of the print heads 2028 is provided as a single unit with its corresponding drive controller 2330. Further, in the printer 2020, the data processing sections 2320 are provided respectively for each of the drive controllers 2330. The drive controller 2330 and its corresponding data processing section 2320 are connected via a flexible cable 2340.

The main controller 2310 is a control circuit for controlling the entire printer. The main controller 2310 is configured to be capable of accessing a memory 2401, which serves as a storing section for storing ejection-amount information. This ejection-amount information indicates, for each nozzle row, a deviation of an ink-ejection amount ejected when printing a pattern using each nozzle row in each of the print heads 2028, from a theoretical ejection amount for when printing the same pattern. The ejection-amount information is described in detail further below.

The data processing section 2320 is a control circuit for enabling bi-directional communication between the printer 2020 and the carriage 2030. The drive controller 2330 is a control circuit for executing control to cause the print head 2028 to eject ink as described above, as well as for enabling bi-directional communication with the data processing section 2320.

Each data processing section 2320 has a control circuit 2400, a differential driver 2410, an SRAM 2420 and an interface 2430.

The drive controller 2330 includes a control circuit 2500, a differential driver 2510, an SRAM 2520, an interface 2530 and an original drive signal generating section 2540. The control circuit 2500 includes a PTS pulse generation circuit 2502 and a mask signal generation circuit 2504.

It should be noted that the control circuit 2400 and the differential driver 2410 constitute a printer-side send/receive section (data processing section). Moreover, the control circuit 2500 and the differential driver 2510 constitute a carriage-side send/receive section (drive controller). The PTS pulse generation circuit 2502, the mask signal generation circuit 2504 and the original drive signal generating section 2540 constitute a head drive controller.

The flexible cable 2340 that connects the interfaces 2430 and 2530 includes a clock signal line for transmitting a clock signal SCLK, a flag signal line pair for transmitting a flag signal FLG, and a serial signal line pair for transmitting data DATA serially. It should be noted that throughout this specification, the same symbols are used for signals and for the signal lines (or signal line pairs) carrying those signals.

The image processing section 2350 includes a resolution conversion processing section, a color conversion processing section, a halftone processing section, a rasterizing processing section, and a plurality of color conversion data tables LUT.

The resolution conversion processing section has the function of converting the resolution of entered image data to the print resolution. Image data whose resolution has been converted is still image information composed of the three color components RGB. The color conversion processing section references the color conversion data table LUT and converts the RGB image data pixel-by-pixel into multi-gradation data of a plurality of ink colors that can be used by the printer 2020. Moreover, the color conversion processing section performs a "color calibration process" for reducing the differences between the ink-ejection amounts ejected based on the same print data from each of the nozzle rows that are provided in different print heads 2028 and that eject ink of the same color. This "color calibration process" will be explained further below.

The color-calibrated multi-gradation data has 256 gradation values, for example. The halftone processing section performs so-called halftone processing such as dithering, and generates binary image data expressing a halftone image by binary data. The binary image data is rearranged by the rasterizing processing section and the raster-row conversion processing section into the data order in which they are to be transferred to the printer 2020, and are output as the final print data PD. The print data PD includes raster data indicating how dots are to be formed during each movement of the carriage 2030 as well as data indicating the paper carry amount.

===Driving the Print Heads===

The driving of the print heads 2028 is described with reference to FIG. 22.

Figure 22:
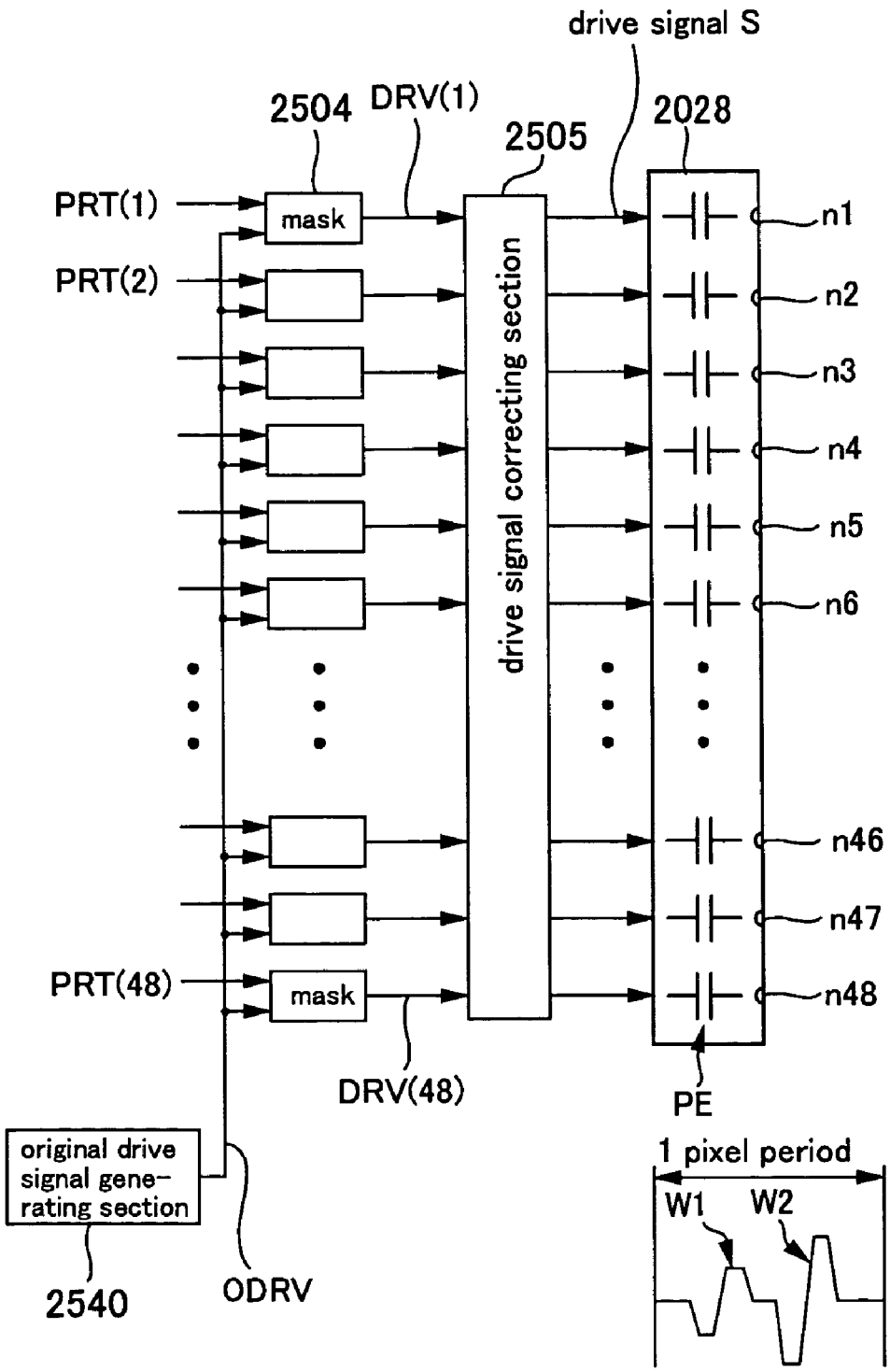
FIG. 22 is a block diagram showing the configuration of the drive signal generating section provided inside the drive controller in FIG. 21.
Figure 23:
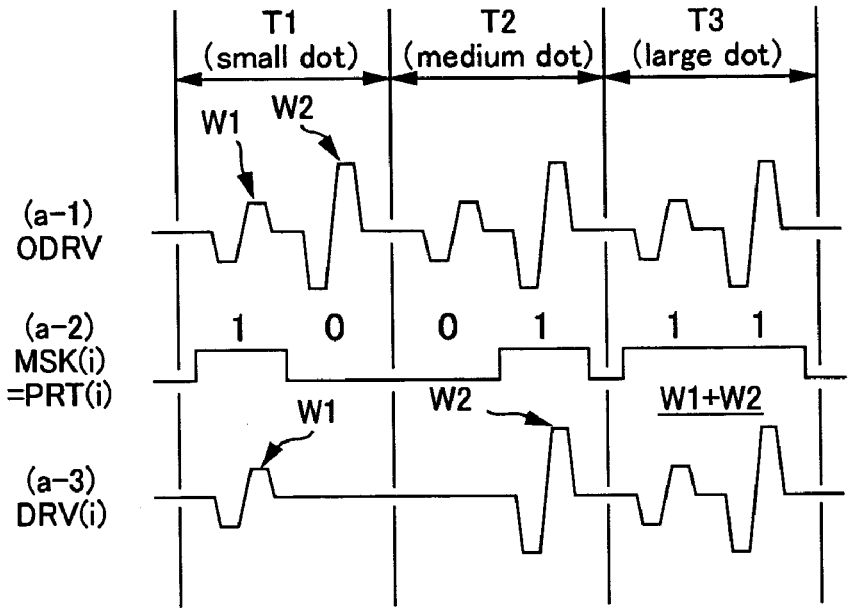
FIG. 23 is a timing chart of the original signal ODRV, the print signal PRT(i), and the drive signal DRV(i) illustrating the operation of the drive signal generating section of the second embodiment.

FIG. 22 is a block diagram showing the configuration of a drive signal generating section provided within the drive controller (see FIG. 21). FIG. 23 is a timing chart for an original signal ODRV, a print signal PRT(i), and a drive signal DRV(i), illustrating the operation of the drive signal generating section.

In FIG. 22, the drive controller 2330 is provided with a plurality of mask signal generation circuits 2504, an original drive signal generating section 2540, and a drive signal correcting section 2505. The mask signal generation circuits 2504 are provided corresponding to the plurality of piezo elements for driving the respective nozzles n1 to n48 of the print heads 2028. It should be noted that in FIG. 22 the numbers in parentheses following each signal name indicate the number of the nozzle to which that signal is supplied.

The original drive signal generating section 2540 generates an original drive signal ODRV that is used in common among all nozzles n1 to n48. This original drive signal ODRV is a signal that includes two pulses, namely a first pulse W1 and a second pulse W2, within the period in which the carriage moves over a distance corresponding to a single pixel. This original drive signal ODRV serves as a reference ejection signal for ejecting ink from the nozzles. That is to say, all of the nozzles of each print head 2028 eject ink based on the same original drive signal ODRV. The output of the original drive signal ODRV is started when it is detected from the output of a linear encoder or the like that the carriage 2030 has reached a predetermined position. Therefore, when forming dot rows (as liquid-droplet mark rows) at the same target position on the print paper by ejecting ink from the nozzle rows of the print heads 2028, the output timing of the original drive signal ODRV is adjusted such that the positions of the dot rows in the carriage movement direction match.

As shown in FIG. 22, the serial print signal PRT(i) is input to the mask signal generation circuits 2504 together with the original drive signal ODRV that is output from the original drive signal generating section 2540. The serial print signal PRT(i) is a serial signal with two bits per pixel, and the bits correspond to the first pulse W1 and the second pulse W2, respectively. The mask signal generation circuits 2504 are gates for masking the original drive signal ODRV in accordance with the level of the serial print signals PRT(i). That is to say, when the serial print signal PRT(i) is at level "1", the mask signal generation circuit 2504 passes the corresponding pulse of the original drive signal ODRV without changing it and supplies it to the piezo element as a drive signal DRV, whereas when the serial print signal PRT(i) is at level "0", the mask signal generation circuit 2504 blocks the corresponding pulse of the original drive signal ODRV.

As shown in FIG. 23, the original drive signal ODRV generates a first pulse W1 and a second pulse W2 in that order during each pixel period T1, T2, and T3. It should be noted that "pixel period" has the same meaning as the period during which the carriage moves for a distance corresponding to one pixel.

As shown in FIG. 23, when the print signal PRT(i) corresponds to the two bits of pixel data "1,0" then only the first pulse W1 is output in the first half of the pixel period. Accordingly, a small ink droplet is output from the nozzle, forming a small-sized dot (small dot) on the medium to be printed. When the print signal PRT(i) corresponds to the two bits of pixel data "0,1" then only the second pulse W2 is output in the second half of the pixel period. Accordingly, a medium-sized ink droplet is ejected from the nozzle, forming a medium-sized dot (medium dot) on the medium to be printed. Furthermore, when the print signal PRT(i) corresponds to the two bits of pixel data "1,1" then both the first pulse W1 and the second pulse W2 are output during the pixel period. Accordingly, a large ink droplet is ejected from the nozzle, forming a large-sized dot (large dot) on the medium to be printed. As described above, the drive signal DRV(i) in a single pixel period is shaped so that it may have three different waveforms corresponding to the three different values of the print signal PRT(i), and based on these signals, the print heads 2028 can form dots of three different sizes.

===Example Configuration of the Reflective Optical Sensor===

Figure 24:
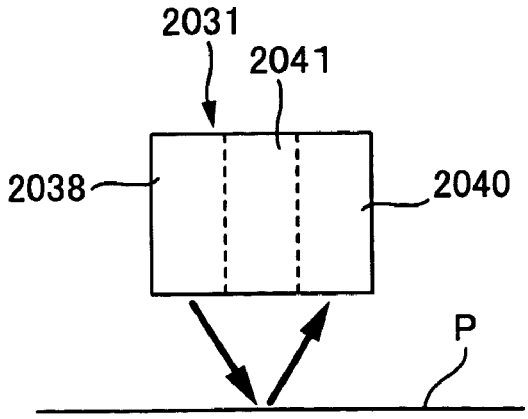
FIG. 24 is a schematic drawing illustrating an example of a reflective optical sensor 2031 of the second embodiment.

FIG. 24 is a schematic drawing illustrating an example of a reflective optical sensor 2031. The reflective optical sensor 2031 includes a light emitting section 2038 that is made of a light-emitting diode, for example, and a regular reflection light receiving section 2040 and a diffused reflection light receiving section 2041 that are made of phototransistors, for example.

This reflective optical sensor 2031 is set up so that the light emitted by the light emitting section 2038 is irradiated at a predetermined angle with respect to the print paper serving as the medium to be printed, and the regular reflection light receiving section 2040 is arranged at such a position that mainly the regularly reflected components of the reflection light irradiated onto the print paper are incident on it. Moreover, the diffused reflection light receiving section 2041 is arranged at a position between the light emitting section 2038 and the regular reflection light receiving section 2040, that is to say, vertically above the irradiation position on the print paper P. The light emitting section 2038, the regular reflection light receiving section 2040 and the diffused reflection light receiving section 2041 are lined up in the paper carry direction. The incident light that is received by the regular reflection light receiving section 2040 and the diffused reflection light receiving section 2041 is converted into electrical signals, and the intensity of the electrical signals is measured as the output value of the reflective optical sensor 2031 corresponding to the light amount of the received reflection light. In this case, light that is reflected by glossy paper increases the output of the regular reflection light receiving section 2040, whereas light that is reflected by plain paper increases the output of the diffused reflection light receiving section 2041, so that paper types can be discriminated. Then, the reflective optical sensor 2031 detects the front edge position and the width of the paper based on differences in the output of the light receiving sections 2040 and 2041 when the light emitted from the light emitting section 2038 is reflected by the paper and the output of the light receiving sections 2040 and 2041 when the light is reflected by the platen 2017. Moreover, the reflective optical sensor 2031 can also measure the darkness of printed locations based on the output of the light receiving sections 2040 and 2041 when the light emitted from the light emitting section 2038 is reflected by printed locations on the paper and the output of the light receiving sections 2040 and 2041 when the light is reflected by non-printed locations on the paper. That is to say, in the case of high darkness, a large amount of ink is ejected onto a predetermined region, and the surface area occupied by dots formed with the ejected ink is large. Therefore, the white portions without dots become small, so that the output of the light receiving sections 2040 and 2041 due to the reflected light becomes low. On the other hand, in the case of low darkness, a small amount of ink is ejected onto a predetermined region, and the surface area occupied by dots formed with the ejected ink is small. Therefore, the white portions without dots become large, so that the output of the light receiving sections 2040 and 2041 due to the reflected light becomes high. In this way, the darkness of print patterns can be measured based on differences in the output of the light receiving sections 2040 and 2041.

It should be noted that in the above description, as shown in the drawings, the light emitting section 2038, the regular reflection light receiving section 2040 and the diffuse reflection light receiving section 2041 are configured in a single unit as the reflective optical sensor 2031, but they may also be configured as separate devices, namely as a light-emitting device and two light receiving devices.

Also, in the above description, in order to obtain the light amount of the received reflection light, the intensity of the electric signals is measured after the reflection light is converted into electrical signals, but there is no limitation to this, and it is sufficient if the value that is output by the light-receiving sensor, which corresponds to the light amount of the received reflection light, can be measured.

===Color Calibration Process===

As for the ink that is ejected from the nozzles, not always is the same amount of ink ejected even when driving with the same print data, because of individual differences among the individual nozzles and the piezo elements and because of the different types of inks, for example. Further, the printer 2020 is controlled based on the theoretical design values, so that when nozzle rows in which the ink-ejection amount differs from the theoretical value are driven by the same control as a nozzle row that ejects ink in accordance with a theoretical value (in the following, such a nozzle row is referred to as "reference nozzle row"), then images that should be printed with uniform darkness will be printed at different darkness with the different nozzle rows, resulting in color non-uniformities or in printed images with different color hues.

Therefore, a "color calibration process" is executed such as to reduce the differences in the darkness of the images printed with ink ejected from nozzle rows that eject ink of the same color but are arranged on different print heads.

The color calibration process according to the second embodiment of the present invention is a process for reducing the difference between the darkness of images each printed using the plurality of nozzle rows and the darkness of the image printed using a reference amount of ink, that is, an amount of ink that serves as a reference and that theoretically should be ejected, by converting the image data to be printed based on the ejection-amount information and the darkness-correspondence information corresponding to the color of ink to be ejected.

Here, as a first implementation, an example is explained in which the ejection-amount information is information representing deviations in the amount of ink that is ejected from the respective nozzle rows in response to a predetermined signal, as compared to a reference amount of ink that is ejected in response to this predetermined signal. In the first implementation, the reference amount is determined, for example, during the manufacturing process of the printing apparatus, by measuring the amount of ink that is actually ejected from a reference nozzle row. Then, the amount of ink that is ejected by each of the nozzle rows of the printer 2020 is determined, and the deviation, from the reference amount, of the amount of ink ejected from each of the nozzle rows is determined based on those actually measured values, and the deviation is stored as ejection-amount information in the memory 2401. Here, the nozzle row ejecting an amount of ink that is taken as the reference is a nozzle row ejecting an amount of ink consistent with the theoretical design value, and is a nozzle row that is different from the nozzle rows installed on the printer 2020.

More specifically, in order to obtain the ejection-amount information, the amounts of ink that are ejected from the nozzle rows in response to a predetermined drive signal is measured first.

The measurement of the amount of ink that is ejected from each of the nozzle rows and from the reference nozzle row is performed using electronic scales and an evaluation pulse generation circuit that outputs a predetermined driving pulse (referred to as "evaluation pulse" below). For example, a print head is electrically connected to the evaluation pulse generation circuit, and ink is ejected from a nozzle row by driving the piezo elements in accordance with the evaluation pulses generated by the evaluation pulse generation circuit. Then, the ejected ink is measured with the electronic scales. In this case, drive signals for ejecting ink for forming large dots from all nozzles of the nozzle row to be measured are used as the evaluation pulses.

The amount of ink that should be ejected from the reference nozzle row when driven with the evaluation pulses, that is, the theoretical value of the amount of ink that is ejected, is set to the reference value "50". As for the amount of ink ejected from the measured nozzle rows, the deviations from this reference value are determined, and the determined values are stored as the ejection-amount information in the memory 2401. Here, the ejection-amount information is expressed by prefixing "ID" before the value indicating the deviation, as in "ID50", for example, and the ejection-amount information is referred to herein as "ID values." For example, the ID value of a nozzle row ejecting an ink amount that is consistent with the theoretical value when driven with the evaluation pulses is "ID50". On the other hand, the ID values of nozzle rows that eject less ink than the theoretical value are "ID49", "ID48" . . . in accordance with the deviation from the theoretical value, whereas the ID values of nozzle rows that eject more ink than the theoretical value are "ID51", "ID52" . . . in accordance with the deviation from the theoretical value.

The darkness-correspondence information is a conversion data table that is used by the color conversion processing section when performing the color calibration process with respect to CMYK image data with 256 gradations, after the color conversion processing section of the above-mentioned image processing section 2350 has converted the RGB image data with 256 gradations for every pixel of the image data into CMYK image data with 256 gradations that can be utilized by the printer 2020.

Figure 25:
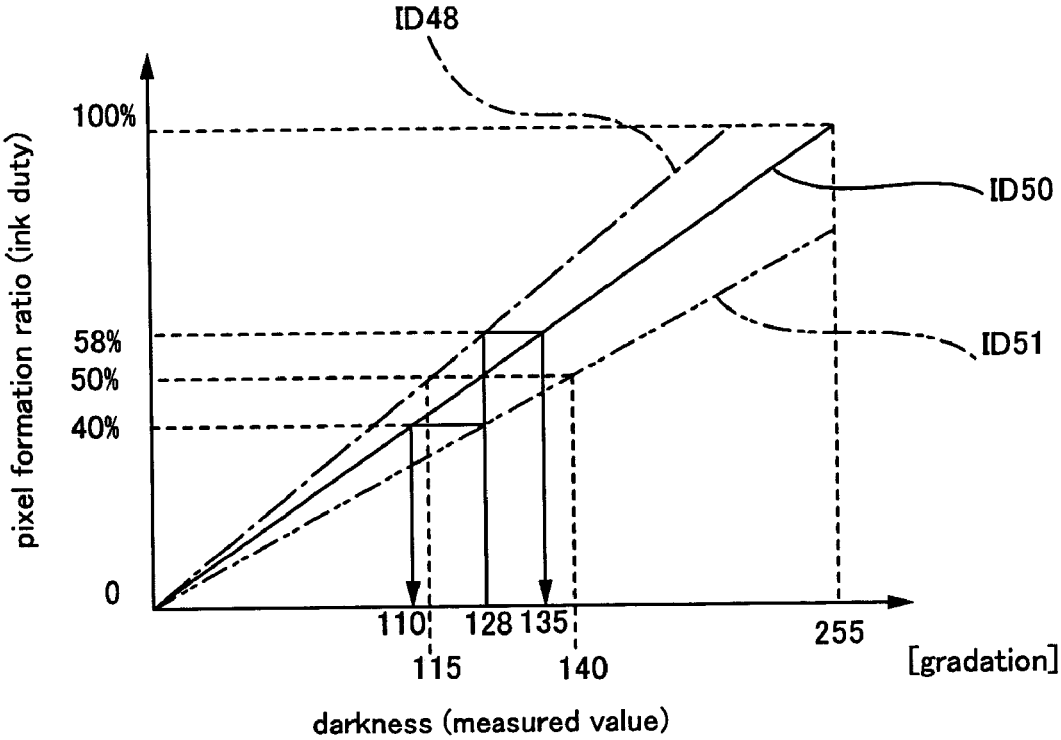
FIG. 25 is a diagram illustrating the principle of the conversion data table used for color calibration according to the second embodiment.

FIG. 25 is a diagram illustrating the principle of the conversion data table used for the color calibration in this first implementation.

FIG. 25 shows the correlation between measured values of the printed image darkness and the pixel formation ratio, when ink is ejected with the evaluation pulses, and the reference nozzle row and the nozzle rows with different ejection amounts, that is, a plurality of predetermined nozzle rows serving as predetermined ink-ejecting sections with different ID values are used to print images with different pixel formation ratios in a predetermined region. Here, "pixel formation ratio" means the ratio that is given by the number of pixels formed in a predetermined region to the total number of unit pixel formation regions in which a single pixel can be formed and which are provided within the predetermined region. In FIG. 25, the vertical axis indicates the pixel formation ratio, and the horizontal axis indicates the darkness of the printed image. Here, the darkness of the printed image is indicated by gradation values of 256 gradations. A gradation value of "255" indicates a darkness of an image in which ink is ejected onto the entire predetermined region, and a gradation value of "0" indicates a darkness of an image in which no ink is ejected at all. This conversion data table is provided separately for each of the plurality of ink colors (K, C, LC, M, LM, Y) that can be used by the printer 2020, and the 256 gradation values correspond to the values indicating the darkness in the 256-gradation data for CMYK when generating the print data from the image data to be printed.

FIG. 25 shows three graphs correlating the pixel formation ratio of the printed image to the darkness of the image that is printed when the reference nozzle row with the ID value (ID50) serving as the reference is used, and the darkness of the images printed, while stepwise changing the pixel formation ratio, with nozzle rows of ID48 and ID51. The graph for ID50 is obtained by printing a plurality of images using the reference nozzle row while stepwise changing the pixel formation ratio, measuring the darkness of the printed images with a darkness measurement device, and plotting the measured values substituting them with gradation values. For example, an image with an pixel formation ratio of 100%, that is, an image in which 100 pixels are formed within a region in which 100 pixels can be formed, is printed using the reference nozzle row, the darkness of the printed image is measured, and the measured value is plotted at the intersection between the pixel formation ratio of 100% and the gradation value "255" indicating the darkness. For an pixel formation ratio of 50%, the reference nozzle row is used to print an image in which 50 pixels are formed within a region in which 100 pixels can be formed, the darkness of the printed image is measured, and the measured value is plotted at the intersection between the pixel formation ratio of 50% and the gradation value "128" indicating the darkness. Then, images with stepwise changing pixel formation ratio are printed using the reference nozzle row, and the measured values of the darkness of the printed images are plotted, thus completing the graph for ID50. Similarly, also the graphs for ID48 and ID51 are graphs in which the measured values when using predetermined nozzle rows with ID48 and ID51, respectively, are plotted. Printing an image with an pixel formation ratio of 50% using a nozzle row with ID48 and measuring the darkness of the printed image results in a gradation value of "115", for example. Moreover, printing an image with an pixel formation ratio of 50% using a nozzle row with ID51 and measuring the darkness of the printed image results in a gradation value of "140". In this manner, a plurality of images with different pixel formation ratios are printed, and the measured values of the darkness of the printed images are individually plotted, thus producing the graphs shown in FIG. 25. In this example, three graphs are shown, but at least a number of graphs is formed that corresponds to the ID values that can occur in the nozzle rows. A conversion data table represented by these graphs is stored in the memory 2401.

The color calibration is performed as follows, based on the conversion data table and the ID value of each of the nozzle rows.

Let us assume that, when color-converting the resolution-converted RGB data corresponding to a predetermined pixel that is formed by the dark magenta nozzle row M of the first print head 2028*a*, the darkness of magenta at this pixel is set to "128" in the color conversion table LUT. This darkness "128" is the darkness for the case that the image is formed by a nozzle row with ID50. Therefore, the image that actually should be formed based on the data of the darkness "128" is an image with a pixel formation ratio of 50% formed by the nozzle row with ID50, based on the data of the darkness "128".

However, the ID value of the dark magenta nozzle row M of the first print head 2028*a* is ID51. The graph in FIG. 25 shows that, for the dark magenta nozzle row M of the first print head 2028*a*, an image with the same darkness as with the gradation value "128" formed by the reference nozzle row corresponds to an image with a pixel formation ratio of 40% formed by the reference nozzle row. Therefore, the data of the gradation value "128" to be printed by a nozzle row with ID51 is converted to the gradation value "110", which corresponds to the darkness of an image with a pixel formation ratio of 40% formed by the reference nozzle row.

Next, let us assume a case in which a dot of a darkness "128" as with the above-mentioned pixel is formed using the dark magenta nozzle row M of the second print head 2028*b*. The ID value of the dark magenta nozzle row M of the second print head 2028*b* is ID48. The graph in FIG. 25 shows that, for the dark magenta nozzle row M of the second print head 2028*b*, an image with the same darkness as with the gradation value "128", formed by the reference nozzle corresponds to an image with a pixel formation ratio of 58% formed by the reference nozzle row. Therefore, the data of the gradation value "128" printed by a nozzle row of ID48 is converted to the gradation value "135", which corresponds to the darkness of an image with a pixel formation ratio of 58% formed by the reference nozzle row.

Thus, it becomes possible to suppress variations in the darkness of images formed by nozzle rows with different ID values, that is, nozzle rows with different ink ejection properties, by generating converted data in which the darkness of each of the nozzle rows, which respectively eject different colors of ink, has been converted based on the ID value of each nozzle row and the conversion data table.

===Printing Operation===

FIG. 26 shows an example of a data table including ejection-amount information. For the sake of convenience, a data table including ejection-amount information for two print heads is shown in FIG. 26, but a data table for every nozzle row in the print heads is stored in the memory 2401. In FIG. 26, for example, the ID value of a light cyan nozzle row in the first head and that ejects light cyan LC is 50, and ejects ink at a theoretic, design value (ID50). On the other hand, the ID value of the light cyan nozzle row in the second head is 52, which indicates that this nozzle row ejects an amount of ink corresponding to a deviation 52 (ID52) with respect to the reference amount, assuming that the reference amount of ink ejected from the reference nozzle row is 50. That is, in this case, when the nozzle row ejecting light cyan ink LC is driven according to the same print data, the darkness of the image printed by the light cyan nozzle row of the second head becomes darker than the darkness of the image formed by the light cyan nozzle row of the first head 2028*a*. In view of the above, print data is generated such that the difference in darkness between images that are formed according to the same print data but with ink ejected from nozzle rows having different ID values becomes small.

Figure 27:
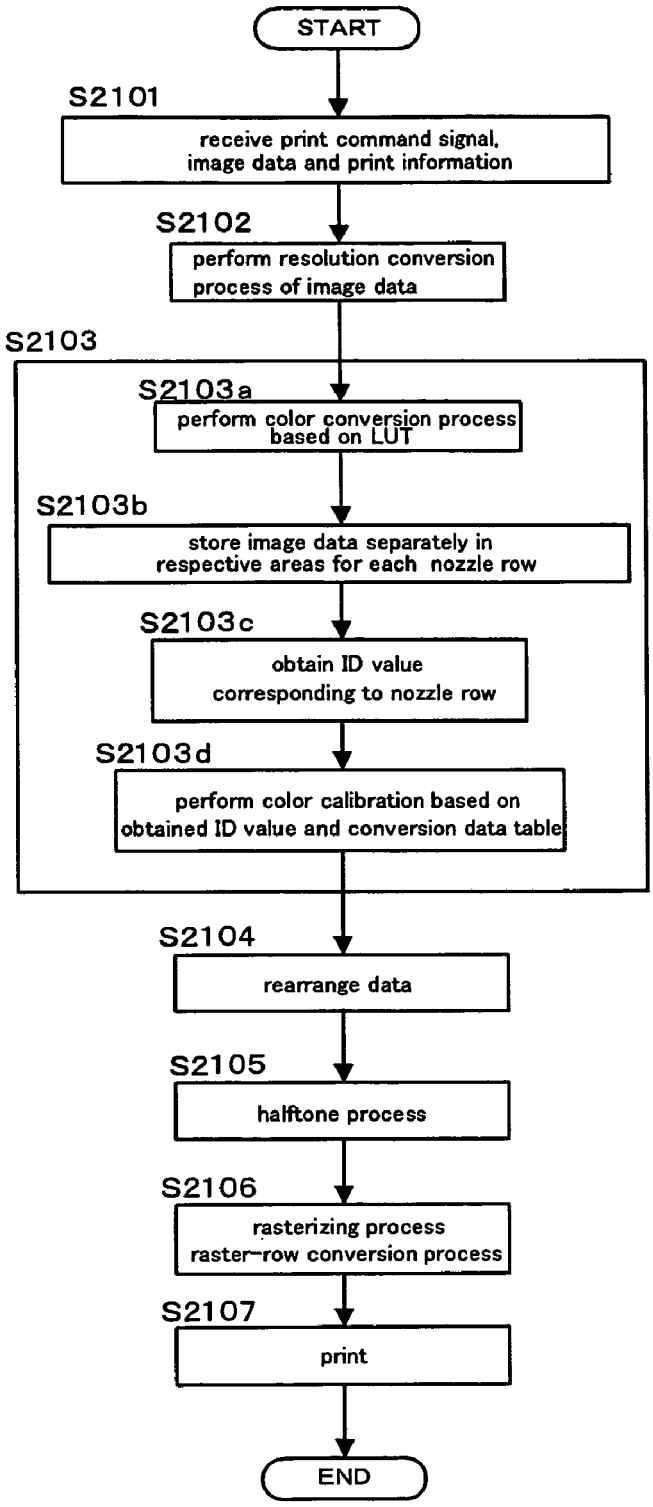
FIG. 27 is a flowchart illustrating the process of generating print data according to the second embodiment.

The process of generating the print data is described in conjunction with the operations of the printer 2020. FIG. 27 is a flowchart for illustrating the process for generating the print data. Below, an example is described in which print data is generated such as to reduce the difference in darkness between images formed using the dark magenta nozzle rows M of the first print head 2028*a* and the second print head 2028*b*.

First, the printer 2020 receives the image data together with print command signals and print information from a computer connected to the printer 2020 (S2101). The print information is data indicating all sorts of parameters regarding the printing, such as the resolution of the image to be printed, or the printing method, such as band printing or interlaced printing. That is, by obtaining this print information, it is possible for the printer 2020 to specify, for the present printing operation, the carry amount by which the print paper is intermittently carried, the number of times of movements of the carriage 2030 to print one raster line, the nozzles that are to eject ink during each movement of the carriage 2030, and so forth.

The image processing section 2350 converts the resolution of the received RGB image data to the resolution for printing (S2102). At this time, each of the pieces of the converted data corresponds to one of the pixels constituting the printed image. That is to say, the converted data corresponds to the pixels of the image to be printed, and the printer 2020 can specify the nozzles by which the pixels are to be formed, based on the print information obtained together with the image data.

The resolution-converted data is subjected to a data conversion process with the color conversion processing section (S2103). Referencing the color conversion data table LUT, the color conversion process color converts, pixel-by-pixel, the RGB 256-gradation data into CMYK 256-gradation data to be printed by the printer 2020 (S2103*a*).

Figure 28:
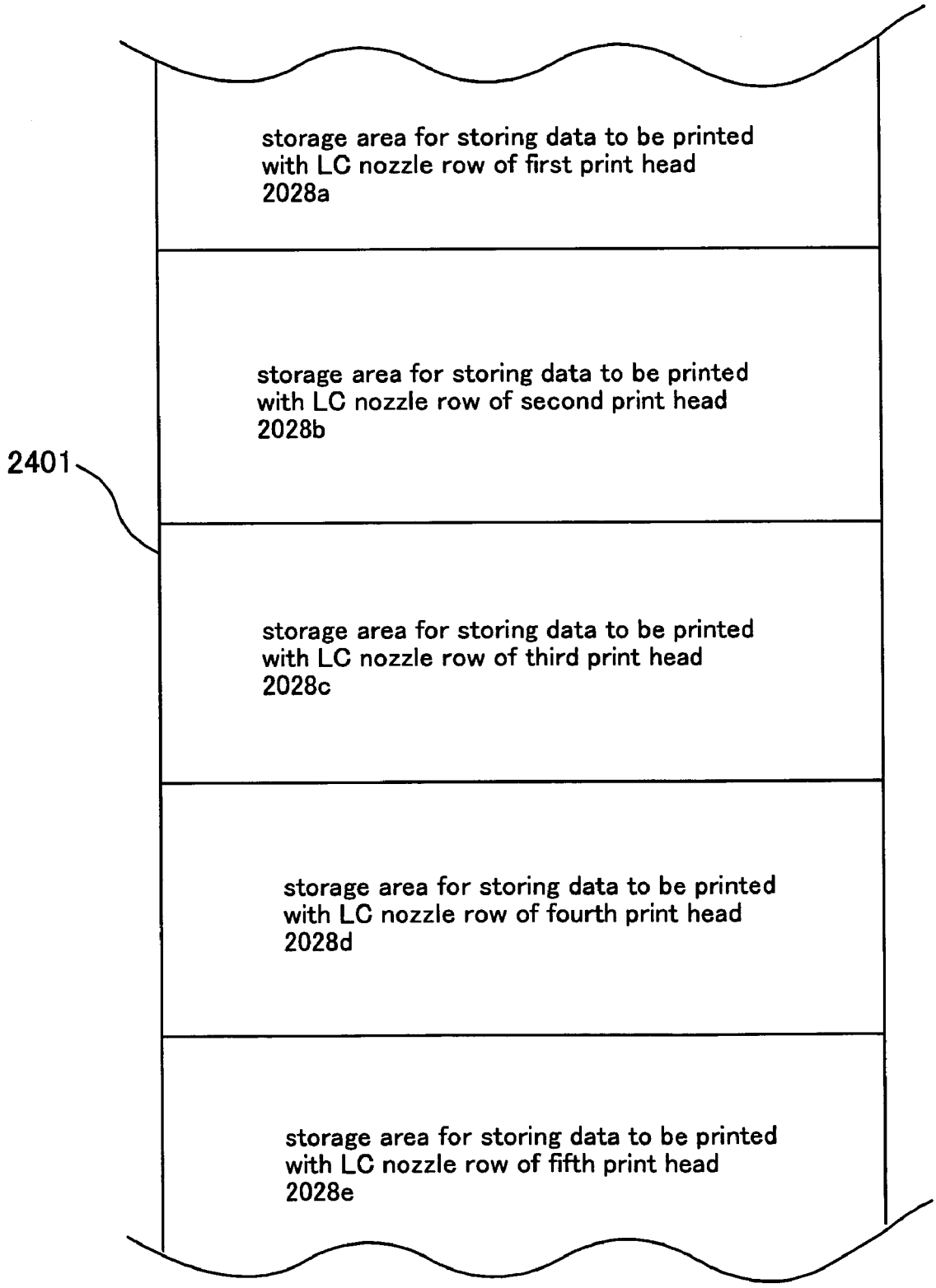
FIG. 28 is a conceptual diagram showing a memory in which data is divided and stored in each storage area provided separately for each nozzle row that processes the printing.

At the image processing section 2350, the color-converted image data is divided and stored separately in a memory that is partitioned into regions provided for each of the nozzle rows that process printing (S2103*b*). FIG. 28 is a conceptual diagram showing the memory 2401 in which the data is divided and stored in each of the storage areas provided separately for each nozzle row that processes the printing. The memory 2401 is partitioned into areas, for each nozzle row of each print head 2028, that store data to be printed by the corresponding nozzle row. It is possible to designate the data stored in a predetermined area by designating that partitioned area using a memory address etc.

The data stored in each storage area assigned to each nozzle row is subjected to the color calibration process described above, separately for each storage area (S2103*c*, S2103*d*). Here, the main controller 2310 obtains the ID values corresponding to the nozzle rows (S2103*c*), and based on the obtained ID values and the conversion data table, the data is collectively converted, area-by-area, for each of the storage areas into data indicating darkness in 256 gradations corresponding to the darkness at ID50 (S2103*d*).

The pieces of color-converted data that have been color converted are gathered again into one piece of data for each color. That is, the pieces of data stored separately in the storage areas for each nozzle row are rearranged such that they return to the state of the image data for each color before being divided (S2104).

The color-converted and rearranged data is then subjected to a so-called halftone process by the halftone processing section, and binary halftone image data is generated (S2105). The halftone image data is subjected to a rasterizing process and a raster-row conversion process, in which they are rearranged by the rasterizing processing section and the raster-row conversion processing section into the data order in which they are to be transferred to the printer 2020, and are output as the final print data PD (S2106). At this time, data indicating the paper carry amount is output together with the print data PD.

Based on a command from the main controller 2310, the control circuit 2500 generates PTS signals at a predetermined timing with the PTS pulse generation circuit, performs synchronization with the original drive signal generating section 2540, outputs drive signals corresponding to each of the nozzle rows generated by a suitable masking process based on the print data PD, and performs printing by driving the print heads 2028 (S2107).

With the printer 2020 of the present implementation, the nozzle rows that eject ink of the same color but belong to different print heads 2028 are driven in accordance with print data that has been generated based on the conversion data table and the ID values serving as the ejection-amount information. Therefore, it is possible to allow the darkness of an image formed using different nozzle rows that eject ink of the same color to be substantially even. Thus, even when a single image is printed using different print heads 2028, the darkness of the image formed by ink of the same color but ejected from different print heads 2028 becomes substantially the same, and also, the size of the dots formed becomes substantially the same. Therefore, non-uniformities in color hue etc. in a printed image are less likely to occur, enabling a favorable image to be printed.

Further, when performing the color calibration process, the image data is stored in storage areas that are provided separately for each of the nozzle rows that process the printing, and the image data is collectively converted, area-by-area, separately for each storage area that stores the data. Therefore, the conversion process is simple, and processing can be carried out in a short time.

In this first implementation, an example was described in which the conversion of the darkness is performed in accordance with the ID values of the nozzle rows when performing the color conversion process. It is also possible, however, to color convert the RGB image data in accordance with the color conversion data table LUT, and, when subjecting the color-converted data to halftone processing, store the data in the memory separately for each of the nozzle rows that process the printing, and change the ratio with which large, medium and small dots are distributed within a predetermined region in the image, based on the ID values of the nozzle rows. In this case, if, for example, dithering is used for the halftone processing, then this can be realized by converting the threshold value given for each of the pixels by the dither matrix in accordance with the ID values of the nozzle rows.

Figure 29:
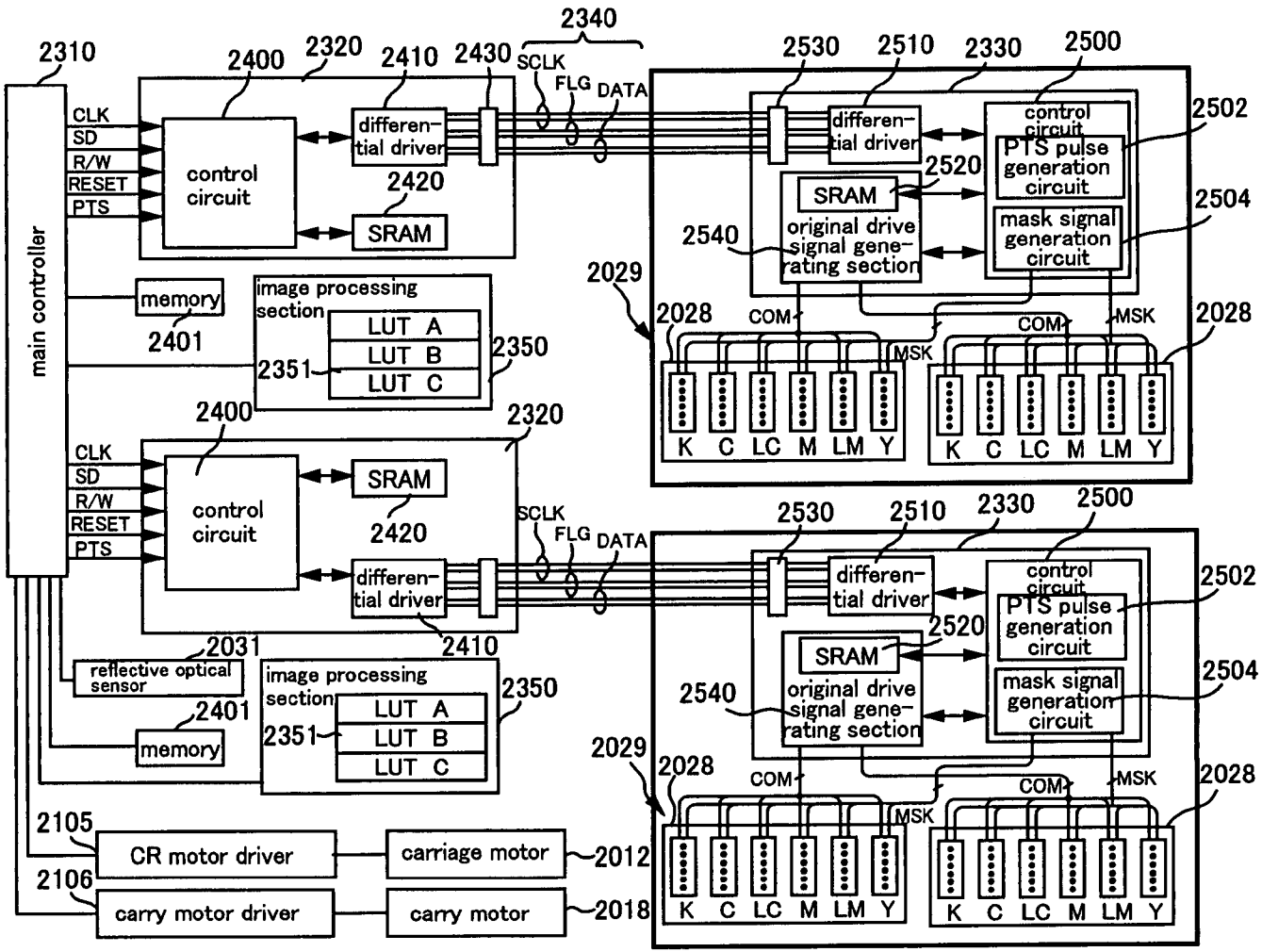
FIG. 29 is a block diagram for illustrating another configuration of the second embodiment of the present invention.

FIG. 29 is a block diagram showing another configuration in accordance with the present invention.

The foregoing embodiment explained an example in which all print heads 2028 perform printing based on print data that is generated by one image processing section 2350. However, as shown in FIG. 29, it is also possible that one image processing section 2350 is associated with a plurality of the print heads (in this example, two print heads), and images are printed in units of the print heads associated with one image processing section 2350, based on the print data generated by the image processing section 2350. In this case, the color calibration process that is executed by the color conversion processing section is performed for every nozzle row ejecting the same color of ink in a print head assembly 2029, which is constituted by the plurality of print heads 2028 and which serves as an ink-ejecting section group assembly. In this case, there is an image processing section 2350 for each print head assembly 2029, so that it is possible to print an image with each print head assembly 2029. Further, each print head assembly 2029 includes at least two nozzle rows that eject ink of the same color. Therefore, by converting the image data such as to reduce the difference between the darkness of the image printed using nozzle rows that belong to each print head assembly 2029 and that eject ink of the same color, it is possible to suppress occurrence of darkness non-uniformities in the image printed by each print head assembly 2029 and to prevent an image having different color hues from being printed.

===Second Implementation Concerning Ejection-Amount Information===

In the above-described first implementation, the deviation of the ink amount that is ejected respectively from a plurality of nozzle rows in response to a predetermined signal from a reference amount of ink that is ejected in response to this predetermined signal is determined from the weight of the ejected ink, and such a deviation is adopted as the ejection-amount information. In this second implementation, an example is explained, in which the darkness of a pattern that is actually printed with the each nozzle row is measured, and this measured darkness information is taken as the ejection-amount information.

The darkness information of each of the nozzle rows indicates the ID values representing the deviation, from a reference darkness, of the darkness of print patterns respectively printed with each of the nozzle rows, based on image data for printing a print pattern of a predetermined darkness, for example. This darkness information is stored in the memory 2401 as a darkness data table correlating the ID values with the nozzle rows. If 256 gradations of darkness given by the values 0 to 255 can be rendered, then the print pattern of predetermined darkness is an image corresponding to the darkness given by one of the 256 gradations. In the case of halftone in which the gradation is expressed with, for example, 128 values, the print pattern is printed based on image data that has been subjected to a known halftone process.

<Example of Method for Generating Darkness Data Table>

Figure 30:
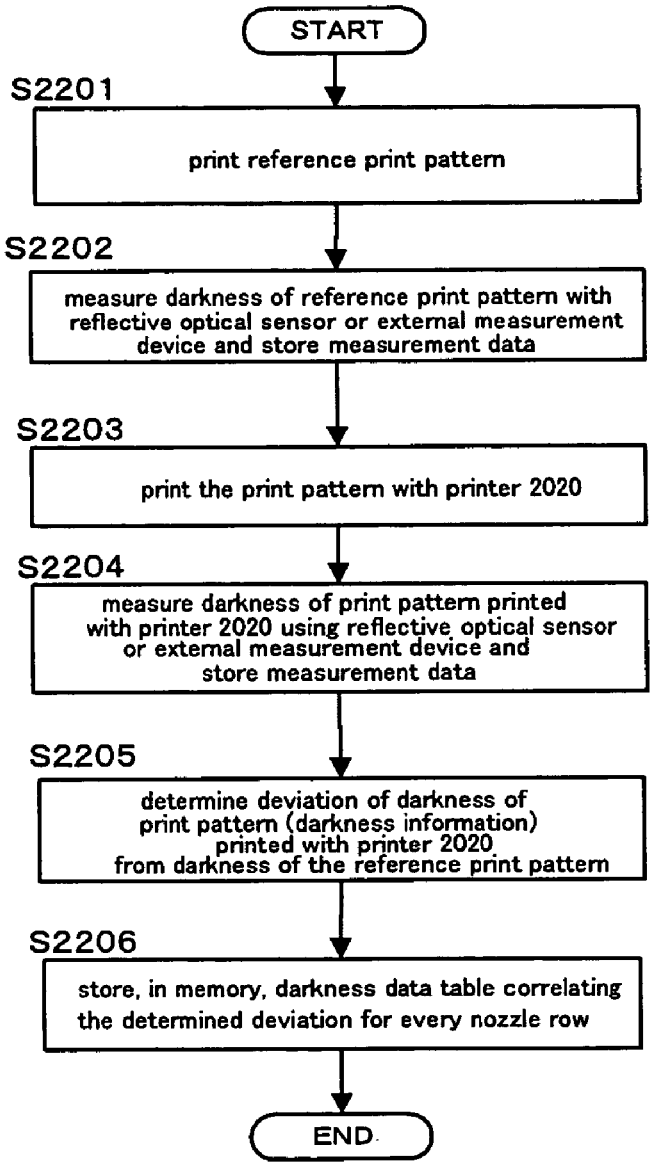
FIG. 30 is a diagram illustrating an example of a method for generating a darkness data table.

FIG. 30 is a diagram illustrating an example of a method for generating a darkness data table.

First, based on the image data for printing a print pattern of a predetermined darkness, a predetermined print pattern is printed with each of the nozzle rows using a reference printer or a reference print head with which a print pattern having a reference darkness can be printed, when printing a predetermined print pattern (S2201). In the following, this predetermined print pattern printed using the reference printer or reference print head is referred to as "reference print pattern."

The print paper on which the reference print pattern has been printed is set in the printer 2020 which is to be color calibrated, and is carried by the print paper carry section 2021. In this situation, the carriage 2030 is moved while the print paper is being carried, and when the reflective optical sensor 2031 mounted on the carriage 2030 comes into opposition to the reference print pattern, the darkness of the reference print pattern is measured with the reflective optical sensor 2031. Then, the output of the reflective optical sensor 2031 is stored, for each nozzle row, as the darkness of the reference print pattern (S2202).

Next, a predetermined print pattern is printed with each of the nozzle rows of the printer 2020, using the same image data as for the reference print pattern (S2203). After this, the carriage 2030 is moved while carrying, with the print paper carry section 2021, the print paper on which the print pattern has been printed, and the output of the reflective optical sensor 2031 is stored, for each nozzle row, as the darkness of the print pattern printed with the printer 2020 (S2204). In the printer 2020, the reflective optical sensor 2031 is arranged downstream in the paper carry direction, so that the darkness can be measured without carrying the paper in the opposite direction after printing the print pattern.

Then, the deviation, from the output of the reflective optical sensor 2031 for the reference print pattern, of the output of the reflective optical sensor 2031 for the print pattern printed with the printer 2020 is taken as the ID value. Here, the output of the reflective optical sensor 2031 for the reference print pattern is taken as the reference value "50". This ID value is determined for every nozzle row (S2205). A darkness data table correlating the determined ID values and the nozzle rows is generated for every print head, and is stored in the memory 2401 (S2206). The ID values are determined by the following Equation 1, where IDx is the ID value to be determined, V0 is the darkness of the reference print pattern, and Vs is the darkness of the print pattern printed with the printer 2020.

$$IDx = Vs/V0 \times 50 \quad \text{(Equation 1)}$$

In this case, when the darkness of the reference print pattern that is output by the reflective optical sensor 2031 is, for example, 3.0V for white, then it is 0.5V for black, 1.5V for cyan, 1.7V for light cyan, 1.5V for magenta, 1.7V for light magenta, and 2.0V for yellow. That is, the higher the darkness is, the lower is the value that is output. Here, the ID values are determined under the assumption that the output of the reflective optical sensor 2031 changes linearly with respect to the darkness of the print pattern.

The principle of the darkness data table that is generated in this manner is similar to the data table of the ejection-amount information shown in FIG. 26. For example, assuming that the data table of the ejection-amount information in FIG. 26 is the darkness data table, then the characteristic information for the nozzle row ejecting black ink K in the first head indicates that an image with the same darkness as when printed using the reference printer or the reference print head will be printed because ink with the theoretical design value (ID50) will be ejected. This darkness data table further shows that, when a print pattern based on the same image data is printed with the nozzle row ejecting black ink in the first head and with the nozzle row ejecting black ink in the second print head, the print pattern printed with the second print head will be printed with higher darkness.

The process of generating the drive signal in this second implementation is similar to the process in the first implementation, in which the ink-ejection amount was measured, so further explanation thereof has been omitted. It should be noted that, although a darkness data table for two print heads is described in this second implementation for the sake of convenience, a darkness data table for every print head is stored in the memory 2401.

By performing the color calibration using such a darkness data table, it is easy to convert the image data such that the non-uniformities in the darkness of the image printed with the nozzle rows are small and such that the difference from the darkness of the image printed with the reference amount of ink becomes small, based on the darkness-correspondence information and the ejection-amount information obtained by measuring the darkness of the print pattern that has been actually printed. Consequently, an appropriate color calibration suitable for actual printers can be performed, and more favorable images with the proper color tone can be printed with little darkness non-uniformities.

Moreover, for the darkness measuring section that measures the darkness of the print pattern, it is possible to use the reflective optical sensor 2031 mounted on the carriage 2030 as the paper detection sensor or the sensor for detecting the paper width. Therefore, it is not necessary to mount a sensor only for performing color calibration, so that the manufacturing costs can be kept low.

In the foregoing embodiment, an example has been explained, in which the reflective optical sensor 2031 is provided downstream in the paper carry direction from the print heads, but the reflective optical sensor 2031 does not necessarily have to be provided downstream from the print heads. For example, it is also possible to arrange the reflective optical sensor 2031 upstream from the printheads. In this case, the print pattern will be positioned further upstream than the reflective optical sensor when the print pattern has been printed. Therefore, the paper on which the print pattern has been printed needs to be carried in a direction that is opposite to the direction when printing. On the other hand, with the printer of the foregoing embodiment, in which the reflective optical sensor 2031 is provided downstream in the paper carry direction from the print heads, the darkness can be measured without carrying the paper, on which the print pattern is printed, in the opposite direction. The foregoing embodiment is therefore more preferable in terms that the process of printing the print pattern and measuring its darkness becomes easy, and can be performed in shorter time and with greater efficiency. Furthermore, in the foregoing embodiment, an example was explained in which one reflective optical sensor is provided, but it is also possible to provide a plurality of reflective optical sensors. In this case, it is possible to shorten the time that is needed to measure the darkness of the print pattern, but there is the possibility that discrepancies are introduced to the measurement values due to variations among individual reflective optical sensors. Therefore, the printer of the first implementation, which is provided with only one reflective optical sensor, can print a more favorable image.

In the foregoing two embodiments, examples were explained in which the measurement of the darkness of the reference print pattern and the print pattern printed with the printer 2020 is performed with the reflective optical sensor 2031 of the printer 2020, but it is also possible to perform this measurement with a separate darkness measurement device (for example an X-Rite938™ by X-Rite Ltd.) that is arranged external to the printer 2020, to determined the ID values. In this case, it is not necessary to provide the printer 2020 with a sensor for measuring the darkness, and it is possible to measure the darkness without setting the reference print pattern to the printer 2020. However, the above-described second implementation using the reflective optical sensor 2031 is superior with regard to the fact that a color calibration with higher precision is possible because the measurement is performed with the actual device.

In the first implementation, an example was described in which a data table based on the ink amount ejected from each of the nozzle rows is stored in the memory 2401 as the ejection-amount information; and in the second implementation, an example was described in which a darkness data table based on the measured darkness of the print patterns printed with ink ejected from each of the nozzle rows is stored in the memory 2401 as the ejection-amount information. These embodiments were explained as separated examples. However, they do not necessarily need to be separate embodiments. For example, it is also possible to store a data table based on the ejection amounts in the memory 2401 when manufacturing the printer, let the user print the print pattern when necessary, measure the darkness of the printed print pattern, and to overwrite the data table based on the ejection amounts with the darkness data table. In such a printer, even after the user has obtained the printer, it is possible to eject ink consistently while suppressing fluctuations of the ejection amount from the nozzles due to temperature and to print a favorable image, by using a data table based on the ejection amount. Furthermore, it is possible to print even more favorable images by overwriting the data table based on the ejection amounts with a darkness data table obtained by printing the print pattern with the printer set up at the location where it is used and in the actual usage environment of the printer. In this case, if, for example, the user overwrites the data table based on the ejection amounts with the darkness data table, then it is preferable that the information indicating the darkness of the reference print pattern is stored in the memory in advance.

===Other Embodiments===

The present invention is not limited to the above-described embodiments, and various modifications of the present invention are possible without straying from the spirit of the invention. For example, the following modifications are possible:

(1) In the foregoing embodiments, some of the configuration that are achieved by hardware may be replaced with software, and conversely, some of the configuration that are achieved by software may be replaced with hardware.

(2) Ordinarily, the present invention can be applied to any type of printing apparatus that ejects ink droplets, and can be applied to a variety of printing apparatuses besides color inkjet printers. For example, it can also be applied to inkjet facsimile devices or copiers.

===Configuration of Printing System Etc.===

Next, a printing system and a computer program serving as an example of an embodiment of the present invention are described with reference to the drawings.

Figure 31:
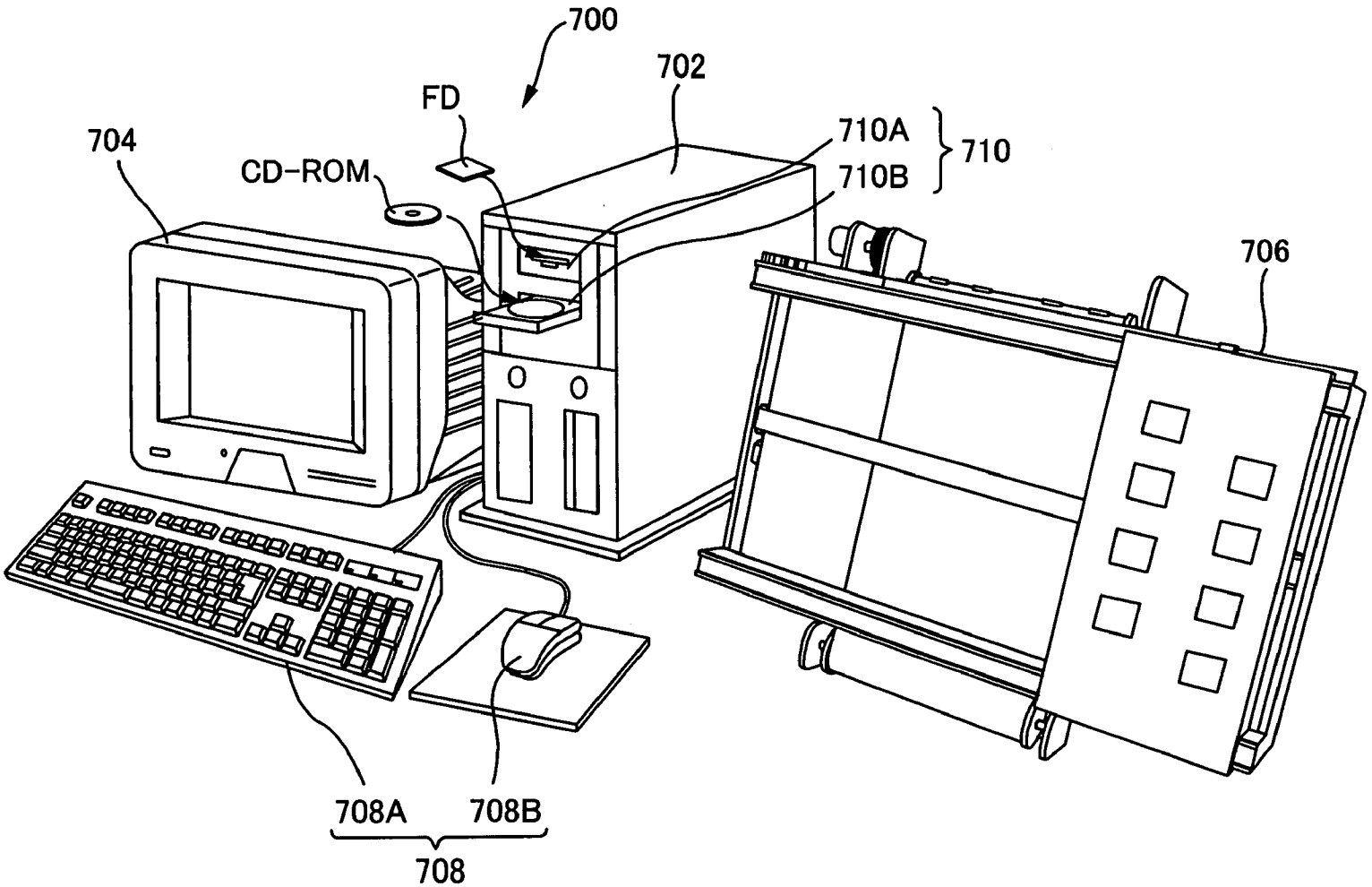
FIG. 31 is an explanatory diagram showing the external structure of a printing system.

FIG. 31 is an explanatory diagram showing the external structure of the printing system. A printing system 700 is provided with a main computer unit 702, a display device 704, a printer 706, an input device 708, and a reading device 710.

A CRT (cathode ray tube), plasma display, or liquid crystal display device, for example, is generally used as the display device 704, but there is no limitation to this. The printer 706 is the printer described above. In this embodiment, the input device 708 is a keyboard 708A and a mouse 708B, but there is no limitation to these. In this embodiment, a flexible disk drive device 710A and a CD-ROM drive device 710B are used as the reading device 710, but there is no limitation to these, and the reading device 710 may also be a MO (magnet optical) disk drive device or a DVD (digital versatile disk), for example.

Figure 32:
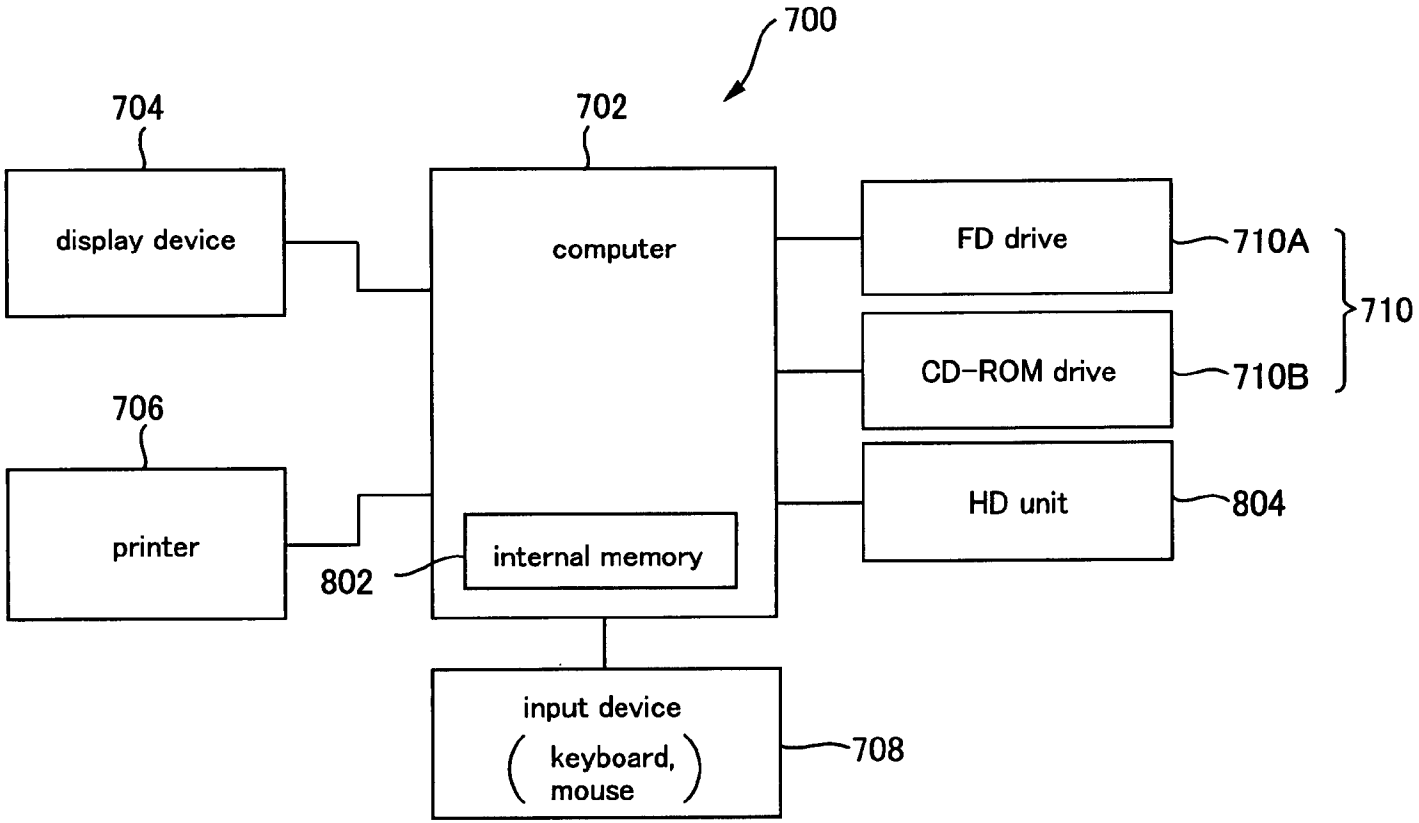
FIG. 32 is a block diagram showing the configuration of the printing system shown in FIG. 31.

FIG. 32 is a block diagram showing the configuration of the printing system shown in FIG. 31. An internal memory 802 such as a RAM is provided within the housing accommodating the main computer unit 702, and also an external memory such as a hard disk drive unit 804 is provided.

In the above description, an example was described in which the printing system is constituted by connecting the printer 706 to the main computer unit 702, the display device 704, the input device 708, and the reading device 710, but there is no limitation to this. For example, the printing system can be made of the main computer unit 702 and the printer 706, and the printing system does not have to be provided with all of the display device 704, the input device 708, and the reading device 710.

It is also possible for the printer 706 to have some of the functions or mechanisms of the main computer unit 702, the display device 704, the input device 708, and the reading device 710. For example, the printer 706 may be configured so as to have an image processing section for carrying out image processing, a display section for carrying out various types of displays, and a recording media attachment/detachment section to and from which recording media storing image data captured by a digital camera or the like are inserted and taken out.

Moreover, the printer operation of the foregoing embodiments can also be achieved by storing, in a memory of a printer controller, a computer program for controlling a printer in accordance with one of the foregoing embodiments and executing the computer program with the printer controller.

As an overall system, the printing system that is thus achieved is superior to conventional systems.

What is claimed is:

1. A printing apparatus comprising:

at least two ink-ejecting section units, each of said ink-ejecting section units having a plurality of ink-ejecting sections, each of said ink-ejecting sections being provided for ejecting an ink of a different color from among a plurality of colors, each of said ink-ejecting sections ejecting the ink based on a gradation value that has been converted;

a memory for storing darkness-correspondence information that correlates, for each of said plurality of colors of ink, darkness of images each printed using a different one of a plurality of predetermined ink-ejecting sections, said predetermined ink-ejecting sections each having an ink-ejection amount different from one another, and a darkness of an image printed using a reference amount of ink; and a converting section for converting, for every pixel, a gradation value of image data to be printed, based on a correlation in said darkness-correspondence information between a darkness of an image printed using the predetermined ink-ejecting section that ejects an amount of ink that corresponds to an average value of the ink-ejection amounts respectively ejected from said plurality of ink-ejecting sections, and said darkness of said image printed using said reference amount of ink.

2. A printing apparatus according to claim 1, wherein the gradation value of the image data to be printed by the ink-ejecting sections that eject ink of the same color but are provided in different ones of said ink-ejecting section units is converted based on the correlation between said darkness of said image printed using said predetermined ink-ejecting section that ejects the amount of ink that corresponds to said average value, and said darkness of said image printed using said reference amount of ink.

3. A printing apparatus according to claim 1, wherein said ink-ejecting section units are movable in a predetermined movement direction; and wherein, when forming dots on a medium to be printed by ejecting ink from said ink-ejecting sections while said ink-ejecting section units are being moved, the dots formed adjacent to one another in said movement direction are not formed by the ink-ejecting sections provided in the same ink-ejecting section unit.

4. A printing apparatus according to claim 1, wherein said medium to be printed is carried intermittently in a carry direction that intersects with said movement direction; and wherein, when forming dots by ejecting ink from said ink-ejecting sections onto said medium to be printed carried in said carry direction, the dots formed adjacent to one another in said carry direction are not formed by the ink-ejecting sections provided in the same ink-ejecting section unit.

5. A printing apparatus according to claim 1, wherein said printing apparatus further comprises a plurality of ink-ejecting section unit groups each including at least two said ink-ejecting section units;

wherein the converting section is provided for each of said ink-ejecting section unit groups; and wherein each of said converting sections uses an average value of the ejection amounts of the corresponding ink-ejecting section unit group to convert the gradation value for the corresponding ink-ejecting section unit group.

6. A printing apparatus according to claim 1, wherein said darkness-correspondence information is indicated as ejection-amount information indicating a deviation of the ink-ejection amount of each of said predetermined ink-ejecting sections from said reference amount;

wherein said ejection-amount information indicating a deviation, from said reference amount of ink that is ejected in response to a predetermined signal, of the ink-ejection amount that is ejected from each of said plurality of ink-ejecting sections in response to said predetermined signal is provided for each of said ink-ejecting sections; and wherein said average value of the ink-ejection amounts respectively ejected from said plurality of ink-ejecting sections is an average value of said ejection-amount information.

7. A printing apparatus according to claim 6, wherein said ejection-amount information is determined based on darkness of predetermined print patterns each printed with ink ejected from a different one of said predetermined ink-ejecting sections, and a darkness of the predetermined print pattern printed by ejecting said reference amount of ink.

8. A printing apparatus according to claim 7, wherein said printing apparatus further comprises a darkness-measurement section that is capable of measuring the darkness of said print patterns; and wherein said ejection-amount information is determined based on a value obtained by measuring the darkness of said predetermined print patterns with said darkness-measurement section.

9. A printing apparatus according to claim 8, wherein said darkness-measurement section is provided in integration with said ink-ejecting section units.

10. A printing apparatus according to claim 8, wherein said print patterns are printed on a medium carried in a predetermined direction; and wherein said darkness-measurement section is arranged downstream in said predetermined direction from said ink-ejecting section units.

11. A printing apparatus according to claim 7, wherein said ejection-amount information is determined based on a value obtained by measuring the darkness of said print patterns with a darkness-measurement device provided external to said printing apparatus.

12. A printing apparatus according to claim 1, wherein said reference amount is a value that is obtained by measuring an ink amount that is actually ejected from an ink-ejecting section ejecting an amount of ink serving as a reference, and said ink-ejection amounts respectively ejected from said plurality of ink-ejecting sections are values that are obtained by measuring the ink amount that is actually ejected from each of said ink-ejecting sections.

13. A printing apparatus according to claim 12, wherein said plurality of ink-ejecting sections are capable of forming a plurality of kinds of dots having different sizes; and wherein said ink-ejection amounts respectively ejected from said plurality of ink-ejecting sections are values that are obtained by measuring the ink amount that is ejected in order to form dots of one of the sizes from among said plurality of kinds of dots.

14. A printing apparatus according to claim 12, wherein said plurality of ink-ejecting sections are capable of forming a plurality of kinds of dots having different sizes; and wherein said ink-ejection amounts respectively ejected from said plurality of ink-ejecting sections are values that are obtained by measuring the ink amount that is ejected in order to form dots of the largest size from among said plurality of kinds of dots.

15. A printing apparatus according to claim 1, wherein said darkness-correspondence information is information that correlates a pixel formation ratio between a number of pixels formed in a predetermined region to a total number of unit pixel formation regions in which a single pixel can be formed and which are provided within said predetermined region, and a darkness of an image printed using an ink-ejecting section that ejects said reference amount of ink based on said pixel formation ratio, and darkness of images each printed using a different one of said predetermined ink-ejecting sections based on said pixel formation ratio.

16. A printing apparatus according to claim 15, wherein said darkness of said image printed using said ink-ejecting section that ejects said reference amount of ink based on said pixel formation ratio, and said darkness of said images each printed using a different one of said predetermined ink-ejecting sections based on said pixel formation ratio, are actually measured values.

17. A printing apparatus comprising:

at least two ink-ejecting section units, each of said ink-ejecting section units having a plurality of ink-ejecting sections, each of said ink-ejecting sections being provided for ejecting an ink of a different color from among a plurality of colors, each of said ink-ejecting sections ejecting the ink based on a gradation value that has been converted;

a memory for storing darkness-correspondence information that correlates, for each of said plurality of colors of ink, darkness of images each printed using a different one of a plurality of predetermined ink-ejecting sections, said predetermined ink-ejecting sections each having an ink-ejection amount different from one another, and a darkness of an image printed using a reference amount of ink; and a converting section for converting, for every pixel, a gradation value of image data to be printed, based on a correlation in said darkness-correspondence information between a darkness of an image printed using the predetermined ink-ejecting section that ejects an amount of ink that corresponds to an average value of the ink-ejection amounts respectively ejected from said plurality of ink-ejecting sections, and said darkness of said image printed using said reference amount of ink;

wherein the gradation value of the image data to be printed by the ink-ejecting sections that eject ink of the same color but are provided in different ones of said ink-ejecting section units is converted based on the correlation between said darkness of said image printed using said predetermined ink-ejecting section that ejects the amount of ink that corresponds to said average value, and said darkness of said image printed using said reference amount of ink;

wherein said ink-ejecting section units are movable in a predetermined movement direction;

wherein, when forming dots on a medium to be printed by ejecting ink from said ink-ejecting sections while said ink-ejecting section units are being moved, the dots formed adjacent to one another in said movement direction are not formed by the ink-ejecting sections provided in the same ink-ejecting section unit;

wherein said medium to be printed is carried intermittently in a carry direction that intersects with said movement direction;

wherein, when forming dots by ejecting ink from said ink-ejecting sections onto said medium to be printed carried in said carry direction, the dots formed adjacent to one another in said carry direction are not formed by the ink-ejecting sections provided in the same ink-ejecting section unit;

wherein said darkness-correspondence information is indicated as ejection-amount information indicating a deviation of the ink-ejection amount of each of said predetermined ink-ejecting sections from said reference amount;

wherein said ejection-amount information indicating a deviation, from said reference amount of ink that is ejected in response to a predetermined signal, of the ink-ejection amount that is ejected from each of said plurality of ink-ejecting sections in response to said predetermined signal is provided for each of said ink-ejecting sections;

wherein said average value of the ink-ejection amounts respectively ejected from said plurality of ink-ejecting sections is an average value of said ejection-amount information;

wherein said reference amount is a value that is obtained by measuring an ink amount that is actually ejected from an ink-ejecting section ejecting an amount of ink serving as a reference, and said ink-ejection amounts respectively ejected from said plurality of ink-ejecting sections are values that are obtained by measuring the ink amount that is actually ejected from each of said ink-ejecting sections;

wherein said plurality of ink-ejecting sections are capable of forming a plurality of kinds of dots having different sizes;

wherein said ink-ejection amounts respectively ejected from said plurality of ink-ejecting sections are values that are obtained by measuring the ink amount that is ejected in order to form dots of the largest size from among said plurality of kinds of dots;

wherein said darkness-correspondence information is information that correlates a pixel formation ratio between a number of pixels formed in a predetermined region to a total number of unit pixel formation regions in which a single pixel can be formed and which are provided within said predetermined region, and a darkness of an image printed using an ink-ejecting section that ejects said reference amount of ink based on said pixel formation ratio, and darkness of images each printed using a different one of said predetermined ink-ejecting sections based on said pixel formation ratio; and wherein said darkness of said image printed using said ink-ejecting section that ejects said reference amount of ink based on said pixel formation ratio, and said darkness of said images each printed using a different one of said predetermined ink-ejecting sections based on said pixel formation ratio, are actually measured values.

18. A computer-readable storage medium having recorded thereon a computer program for causing a printing apparatus that includes at least two ink-ejecting section units, each of said ink-ejecting section units having a plurality of ink-ejecting sections, each of said ink-ejecting sections being provided for ejecting an ink of a different color from among a plurality of colors, each of said ink-ejecting sections ejecting the ink based on a gradation value that has been converted, and a memory for storing darkness-correspondence information that correlates, for each of said plurality of colors of ink, darkness of images each printed using a different one of a plurality of predetermined ink-ejecting sections, said predetermined ink-ejecting sections each having an ink-ejection amount different from one another, and a darkness of an image printed using a reference amount of ink, to convert, for every pixel, a gradation value of image data to be printed, based on a correlation in said darkness-correspondence information between a darkness of an image printed using the predetermined ink-ejecting section that ejects an amount of ink that corresponds to an average value of the ink-ejection amounts respectively ejected from said plurality of ink-ejecting sections, and said darkness of said image printed using said reference amount of ink.

19. A printing system comprising:

a computer; and a printing apparatus that is connectable to said computer and that includes:

at least two ink-ejecting section units, each of said ink-ejecting section units having a plurality of ink-ejecting sections, each of said ink-ejecting sections being provided for ejecting an ink of a different color from among a plurality of colors, each of said ink-ejecting sections ejecting the ink based on a gradation value that has been converted;

a memory for storing darkness-correspondence information that correlates, for each of said plurality of colors of ink, darkness of images each printed using a different one of a plurality of predetermined ink-ejecting sections, said predetermined ink-ejecting sections each having an ink-ejection amount different from one another, and a darkness of an image printed using a reference amount of ink; and a converting section for converting, for every pixel, a gradation value of image data to be printed, based on a correlation in said darkness-correspondence information between a darkness of an image printed using the predetermined ink-ejecting section that ejects an amount of ink that corresponds to an average value of the ink-ejection amounts respectively ejected from said plurality of ink-ejecting sections, and said darkness of said image printed using said reference amount of ink.

20. A printing method comprising the steps of:

preparing at least two ink-ejecting section units, each of said ink-ejecting section units having a plurality of ink-ejecting sections, each of said ink-ejecting sections being provided for ejecting an ink of a different color from among a plurality of colors, each of said ink-ejecting sections ejecting the ink based on a gradation value that has been converted;

storing darkness-correspondence information that correlates, for each of said plurality of colors of ink, darkness of images each printed using a different one of a plurality of predetermined ink-ejecting sections, said predetermined ink-ejecting sections each having an ink-ejection amount different from one another, and a darkness of an image printed using a reference amount of ink; and converting, for every pixel, a gradation value of image data to be printed, based on a correlation in said darkness-correspondence information between a darkness of an image printed using the predetermined ink-ejecting section that ejects an amount of ink that corresponds to an average value of the ink-ejection amounts respectively ejected from said plurality of ink-ejecting sections, and said darkness of said image printed using said reference amount of ink.

21. A printing apparatus comprising:

at least two ink-ejecting section groups, each of said ink-ejecting section groups having a plurality of ink-ejecting sections, each of said ink-ejecting sections being provided for ejecting an ink of a different color from among a plurality of colors, each of said ink-ejecting sections ejecting the ink based on image data that has been converted;

a memory having ejection-amount information indicating a difference between a reference amount of ink taken as a reference and ink-ejection amounts respectively ejected from said plurality of ink-ejecting sections, darkness-correspondence information that correlates, for each of said plurality of colors of ink, darkness of images each printed using a different one of a plurality of predetermined ink-ejecting sections, said ejection-amount information being different among said predetermined ink-ejecting sections, and a darkness of an image printed using said reference amount of ink, and a plurality of storage areas for storing said image data separately for each of said ink-ejecting sections; and a converting section for converting said image data to be printed based said ejection-amount information and said darkness-correspondence information corresponding to the color of ink to be ejected, such that a difference between said darkness of said image printed using said reference amount of ink and darkness of images each printed using a different one of said liquid ejecting sections becomes small, said converting section converting said image data separately for each of said storage areas.

22. A printing apparatus according to claim 21, wherein said ejection-amount information is a deviation, from said reference amount of ink that is ejected in response to a predetermined signal, of the ink-ejection amount that is ejected from each of said plurality of ink-ejecting sections in response to said predetermined signal.

23. A printing apparatus according to claim 21, wherein said reference amount is a value that is obtained by measuring an ink amount that is actually ejected from an ink-ejecting section ejecting an amount of ink serving as a reference, and said ink-ejection amounts respectively ejected from said plurality of ink-ejecting sections are values that are obtained by measuring the ink amount that is actually ejected from each of said ink-ejecting sections.

24. A printing apparatus according to claim 23, wherein said plurality of ink-ejecting sections are capable of forming a plurality of kinds of dots having different sizes; and wherein said ink-ejection amounts respectively ejected from said plurality of ink-ejecting sections are values that are obtained by measuring the ink amount that is ejected in order to form dots of the largest size from among said plurality of kinds of dots.

25. A printing apparatus according to claim 21, wherein said ejection-amount information is determined based on darkness of predetermined print patterns each printed with ink ejected from a different one of said ink-ejecting sections, and a darkness of the predetermined print pattern printed by ejecting said reference amount of ink.

26. A printing apparatus according to claim 25, wherein said printing apparatus further comprises a darkness-measurement section that is capable of measuring the darkness of said predetermined print patterns; and wherein said ejection-amount information is determined based on a value obtained by measuring the darkness of said predetermined print patterns with said darkness-measurement section.

27. A printing apparatus according to claim 26, wherein said darkness-measurement section is provided in integration with said ink-ejecting section groups.

28. A printing apparatus according to claim 26, wherein said print patterns are printed on a medium carried in a predetermined direction; and wherein said darkness-measurement section is arranged downstream in said predetermined direction from said ink-ejecting section groups.

29. A printing apparatus according to claim 25, wherein said ejection-amount information is determined based on a value obtained by measuring the darkness of said print patterns with a darkness-measurement device provided external to said printing apparatus.

30. A printing apparatus according to claim 21, wherein said darkness-correspondence information is information that correlates a pixel formation ratio between a number of pixels formed in a predetermined region to a total number of unit pixel formation regions in which a single pixel can be formed and which are provided within said predetermined region, and a darkness of an image printed using an ink-ejecting section that ejects said reference amount of ink based on said pixel formation ratio, and darkness of images each printed using a different one of said predetermined ink-ejecting sections based on said pixel formation ratio.

31. A printing apparatus according to claim 30, wherein said darkness of said image printed using said ink-ejecting section that ejects said reference amount of ink based on said pixel formation ratio, and said darkness of said images each printed using a different one of said predetermined ink-ejecting sections based on said pixel formation ratio, are actually measured values.

32. A printing apparatus according to claim 21, wherein said image data includes gradation values, each of said gradation values indicating a darkness of a single pixel; and wherein each of said gradation values is converted based on said ejection-amount information and said darkness-correspondence information such that, at each of said gradation values, an image having a darkness that is the same as a darkness of an image printed using an ink-ejecting section that ejects said reference amount of ink is printed.

33. A printing apparatus according to claim 21, wherein said printing apparatus further comprises at least two ink-ejecting section group assemblies each including a plurality of said ink-ejecting section groups, and at least two image processing sections each provided corresponding to a different one of said ink-ejecting section group assemblies; and wherein said image data for the ink-ejecting sections which are provided in the same ink-ejecting section group assembly and which eject ink of the same color is converted by the image processing section that is provided corresponding to that ink-ejecting section group assembly.

34. A printing apparatus comprising:

at least two ink-ejecting section groups, each of said ink-ejecting section groups having a plurality of ink-ejecting sections, each of said ink-ejecting sections being provided for ejecting an ink of a different color from among a plurality of colors, each of said ink-ejecting sections ejecting the ink based on image data that has been converted;

a memory having ejection-amount information that indicates a deviation, from said reference amount of ink that is ejected in response to a predetermined signal, of the ink-ejection amount that is ejected from each of said plurality of ink-ejecting sections in response to said predetermined signal, darkness-correspondence information that correlates a pixel formation ratio between a number of pixels formed in a predetermined region to a total number of unit pixel formation regions in which a single pixel can be formed and which are provided within said predetermined region, and a darkness of an image printed using an ink-ejecting section that ejects said reference amount of ink based on said pixel formation ratio, and darkness of images each printed using a different one of predetermined ink-ejecting sections based on said pixel formation ratio, said ejection-amount information being different among said predetermined ink-ejecting sections, and a plurality of storage areas for storing said image data separately for each of said ink-ejecting sections; and a converting section for converting said image data to be printed based said ejection-amount information and said darkness-correspondence information corresponding to the color of ink to be ejected, such that a difference between said darkness of said image printed using said reference amount of ink and darkness of images each printed using a different one of said liquid ejecting sections becomes small;

wherein said reference amount is a value that is obtained by measuring an ink amount that is actually ejected from an ink-ejecting section ejecting an amount of ink serving as a reference, and said ink-ejection amounts respectively ejected from said plurality of ink-ejecting sections are values that are obtained by measuring the ink amount that is actually ejected from each of said ink-ejecting sections;

wherein said plurality of ink-ejecting sections are capable of forming a plurality of kinds of dots having different sizes;

wherein said ink-ejection amounts respectively ejected from said plurality of ink-ejecting sections are values that are obtained by measuring the ink amount that is ejected in order to form dots of the largest size from among said plurality of kinds of dots;

wherein said darkness of said image printed using said ink-ejecting section that ejects said reference amount of ink based on said pixel formation ratio, and said darkness of said images each printed using a different one of said predetermined ink-ejecting sections based on said pixel formation ratio, are actually measured values;

wherein said image data includes gradation values, each of said gradation values indicating a darkness of a single pixel; and wherein each of said gradation values in said image data is converted, separately for each of said storage areas, based on said ejection-amount information and said darkness-correspondence information such that, at each of said gradation values, an image having a darkness that is the same as a darkness of an image printed using an ink-ejecting section that ejects said reference amount of ink is printed.

35. A computer-readable storage medium having recorded thereon a computer program for causing a printing apparatus that includes at least two ink-ejecting section groups, each of said ink-ejecting section groups having a plurality of ink-ejecting sections, each of said ink-ejecting sections being provided for ejecting an ink of a different color from among a plurality of colors, each of said ink-ejecting sections ejecting the ink based on image data that has been converted, and a memory having ejection-amount information indicating a difference between a reference amount of ink taken as a reference and ink-ejection amounts respectively ejected from said plurality of ink-ejecting sections, darkness-correspondence information that correlates, for each of said plurality of colors of ink, darkness of images each printed using a different one of a plurality of predetermined ink-ejecting sections, said ejection-amount information being different among said predetermined ink-ejecting sections, and a darkness of an image printed using said reference amount of ink, and a plurality of storage areas for storing said image data separately for each of said ink-ejecting sections, to convert said image data to be printed based said ejection-amount information and said darkness-correspondence information corresponding to the color of ink to be ejected, such that a difference between said darkness of said image printed using said reference amount of ink and darkness of images each printed using a different one of said liquid ejecting sections becomes small, said converting section converting said image data separately for each of said storage areas.

36. A printing system comprising:

a computer; and a printing apparatus that is connectable to said computer and that includes:

at least two ink-ejecting section groups, each of said ink-ejecting section groups having a plurality of ink-ejecting sections, each of said ink-ejecting sections being provided for ejecting an ink of a different color from among a plurality of colors, each of said ink-ejecting sections ejecting the ink based on image data that has been converted;

a memory having ejection-amount information indicating a difference between a reference amount of ink taken as a reference and ink-ejection amounts respectively ejected from said plurality of ink-ejecting sections, darkness-correspondence information that correlates, for each of said plurality of colors of ink, darkness of images each printed using a different one of a plurality of predetermined ink-ejecting sections, said ejection-amount information being different among said predetermined ink-ejecting sections, and a darkness of an image printed using said reference amount of ink, and a plurality of storage areas for storing said image data separately for each of said ink-ejecting sections; and a converting section for converting said image data to be printed based said ejection-amount information and said darkness-correspondence information corresponding to the color of ink to be ejected, such that a difference between said darkness of said image printed using said reference amount of ink and darkness of images each printed using a different one of said liquid ejecting sections becomes small, said converting section converting said image data separately for each of said storage areas.

37. A printing method comprising the steps of:

preparing at least two ink-ejecting section groups, each of said ink-ejecting section groups having a plurality of ink-ejecting sections, each of said ink-ejecting sections being provided for ejecting an ink of a different color from among a plurality of colors, each of said ink-ejecting sections ejecting the ink based on image data that has been converted;

preparing a plurality of storage areas for storing said image data separately for each of said ink-ejecting sections;

storing ejection-amount information indicating a difference between a reference amount of ink taken as a reference and ink-ejection amounts respectively ejected from said plurality of ink-ejecting sections;

storing darkness-correspondence information that correlates, for each of said plurality of colors of ink, darkness of images each printed using a different one of a plurality of predetermined ink-ejecting sections, said ejection-amount information being different among said predetermined ink-ejecting sections, and a darkness of an image printed using said reference amount of ink; and converting, separately for each of said storage areas, said image data to be printed based said ejection-amount information and said darkness-correspondence information corresponding to the color of ink to be ejected, such that a difference between said darkness of said image printed using said reference amount of ink and darkness of images each printed using a different one of said liquid ejecting sections becomes small.

* * * * *